US007362985B2

(12) United States Patent
Okabe

(10) Patent No.: US 7,362,985 B2
(45) Date of Patent: Apr. 22, 2008

(54) IMAGE FORMING APPARATUS

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 275 days.

(21) Appl. No.: 11/252,712

(22) Filed: Oct. 19, 2005

(65) Prior Publication Data

US 2006/0083544 A1 Apr. 20, 2006

(30) Foreign Application Priority Data

Oct. 19, 2004 (JP) ..... 2004-304694

(51) Int. Cl.
*G03G 21/16* (2006.01)

(52) U.S. Cl. ..... 399/111

(58) Field of Classification Search ..... 399/107, 399/108, 110, 111, 116, 117
See application file for complete search history.

(56) References Cited

U.S. PATENT DOCUMENTS

| | | | | |
|---|---|---|---|---|
| 6,229,974 | B1 * | 5/2001 | Noda | 399/111 |
| 6,714,750 | B2 * | 3/2004 | Terada et al. | 399/111 |
| 6,751,428 | B2 | 6/2004 | Okabe | |
| 6,917,774 | B2 * | 7/2005 | Terada et al. | 399/111 |
| 7,006,776 | B2 * | 2/2006 | Matsuzaka et al. | 399/111 |
| 2004/0265000 | A1 | 12/2004 | Okabe | |
| 2006/0083544 | A1 | 4/2006 | Okabe | |

FOREIGN PATENT DOCUMENTS

| | | |
|---|---|---|
| CN | 2893756 | 10/2005 |
| JP | 7234552 | 9/1995 |
| JP | 8220818 | 8/1996 |
| JP | 8328446 | 12/1996 |
| JP | 9096937 | 4/1997 |
| JP | 9114322 | 5/1997 |
| JP | 9325552 | 12/1997 |
| JP | 11174765 | 7/1999 |
| JP | 2000206748 | 7/2000 |
| JP | 2002049289 | 2/2002 |
| JP | 2003084647 | 3/2003 |
| JP | 2006-119220 | 5/2006 |

OTHER PUBLICATIONS

Chinese Office Action in CN Publication No. 2005-101141262, dated Dec. 21, 2007.
English translation of previously submitted Chinese Office Action in CN Publication No. 2005-101141262, dated Dec. 21, 2007.

* cited by examiner

*Primary Examiner*—Hoan Tran
(74) *Attorney, Agent, or Firm*—Banner & Witcoff, Ltd

(57) ABSTRACT

An image forming apparatus includes: a process cartridge that is provided in the image forming apparatus to be removable from the image forming apparatus along an attachment-and-detachment path; a first pressing member that is provided to be movable bi-directionally in an advancing direction advancing to the attachment-and-detachment path and in a receding direction receding from the attachment-and-detachment path, the first pressing member being configured to press the process cartridge toward an attachment direction in which the process cartridge is attached in a first state in which the first pressing member is moved toward the advancing direction, and to enable detachment of the process cartridge in a second state in which the first pressing member is moved toward the receding direction.

30 Claims, 31 Drawing Sheets

IMAGE FORMING APPARATUS

BACKGROUND

1. Field

The present invention relates to an image forming apparatus, such as a laser printer.

2. Related Art

A known electrophotographic image forming apparatus has a photosensitive drum, a drum cartridge removably attached to a main body case, a development roller, and a development cartridge removably attached to the drum cartridge.

In such an image forming apparatus, only the development cartridge can be attached to or removed from the drum cartridge mounted on the main body case with the drum cartridge being attached to the main body case, and the drum cartridge can be attached to or detached from the main body case while the development cartridge is attached to the drum cartridge.

In relation to such an image forming apparatus, a known image forming apparatus has a press mechanism which comes into contact with a development cartridge when the development cartridge is attached to a drum cartridge mounted in a main body case, to thus press the development cartridge toward the drum cartridge (see, e.g., JP-A-2003-084647).

In such an image forming apparatus, the development roller is pressed against a photosensitive drum by pressing the development cartridge toward the drum cartridge by means of a press mechanism, to thus form an image.

The press mechanism is provided so as to protrude toward the development cartridge. Accordingly, a path by way of the development cartridge is attached or detached (hereinafter simply called a "attachment-and-detachment path") must be bent so as to avoid the press mechanism. When the attachment-and-detachment path is formed by bending, an increase in the size of the image forming apparatus is unavoidable.

SUMMARY

The present invention provides an image forming apparatus in which an attachment-and-detachment path for a process cartridge can be efficiently arranged and which enables reliable pressing of the process cartridge in a mounting direction.

An image forming apparatus includes: a process cartridge that is provided in the image forming apparatus to be removable from the image forming apparatus along an attachment-and-detachment path; a first pressing member that is provided to be movable bi-directionally in an advancing direction advancing to the attachment-and-detachment path and in a receding direction receding from the attachment-and-detachment path, the first pressing member being configured to press the process cartridge toward an attachment direction in which the process cartridge is attached in a first state in which the first pressing member is moved toward the advancing direction, and to enable detachment of the process cartridge in a second state in which the first pressing member is moved toward the receding direction.

BRIEF DESCRIPTION OF THE DRAWINGS

In the accompanying drawings:

FIGS. 19A and 19B are side views for describing a state where a regulation spring is latched by a drum boss section while the drum cartridge is attached to the process housing section, wherein FIG. 19A shows a state before the spring is latched, wherein FIG. 19B shows a state where the spring is in the course of being latched, and wherein

22A shows a state before the press cam is latched and wherein FIG. 22B shows a state where latching of the press cam has been completed;

FIGS. 23A and 23B are side views for describing a state where a press cam is latched by a drum shaft while the drum cartridge is attached to the process housing section (a mode where the press cam is latched in synchronism with attachment or detachment of the development cartridge), wherein FIG. 23A shows a state before the press cam is latched and wherein FIG. 23B shows a state where latching of the press cam has been completed;

FIG. 32A is a plan view and FIG. 32B is a front view.

DETAILED DESCRIPTION OF THE EMBODIMENT

An embodiment will be described below with reference to the drawings.

Figure 1:
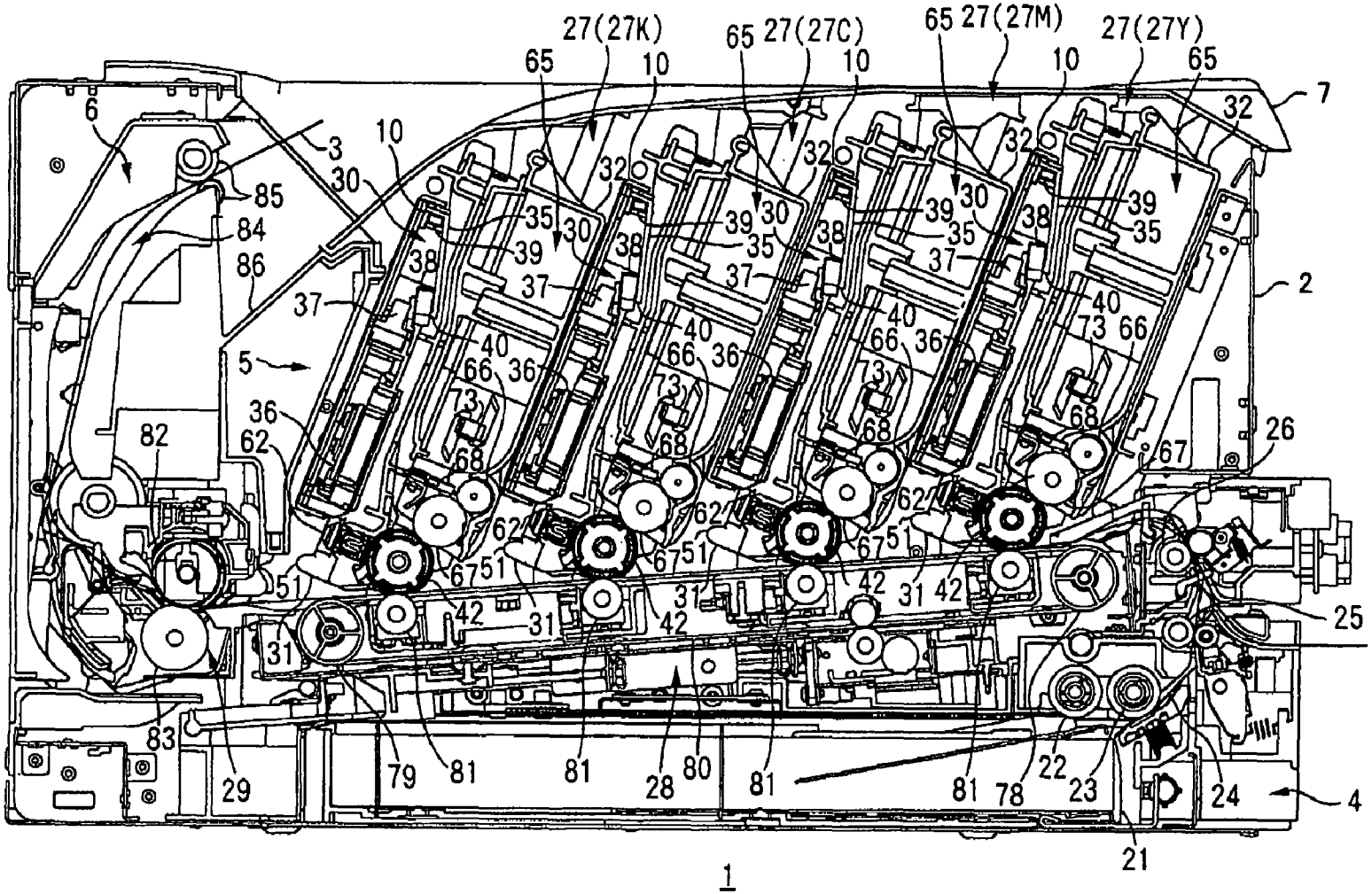
FIG. 1 is a side cross-sectional view of a featuring section showing an embodiment of a color laser printer employed as an image forming apparatus.

FIG. 1 is a side, cross-sectional view of a the principal section showing an embodiment of a color laser printer employed as an image forming apparatus of the present invention.

In FIG. 1, the color laser printer 1 is a horizontal tandem type color laser printer, wherein a plurality of process sections 27 are arranged side by side in a horizontal direction. A sheet feeding section 4 for feeding a sheet 3, an image forming section 5 for forming an image on the fed sheet 3, and a sheet ejection section 6 for outputting the sheet 3 on which the image is formed are provided within a main body casing 2.

The main body casing 2 assumes a box shape whose upper side is opened and which has an substantially-rectangular profile when viewed from the side, and a top cover 7 is placed on top of the main body casing 2. The top cover 7 is supported so as to be pivotable around a hinge (not shown) provided on the back of the main body casing 2 (hereinafter, the left and right sides in FIG. 1 will be called "back" and "front" sides, respectively), and is provided to be able to open or close with respect to the main body casing 2.

Figure 14:
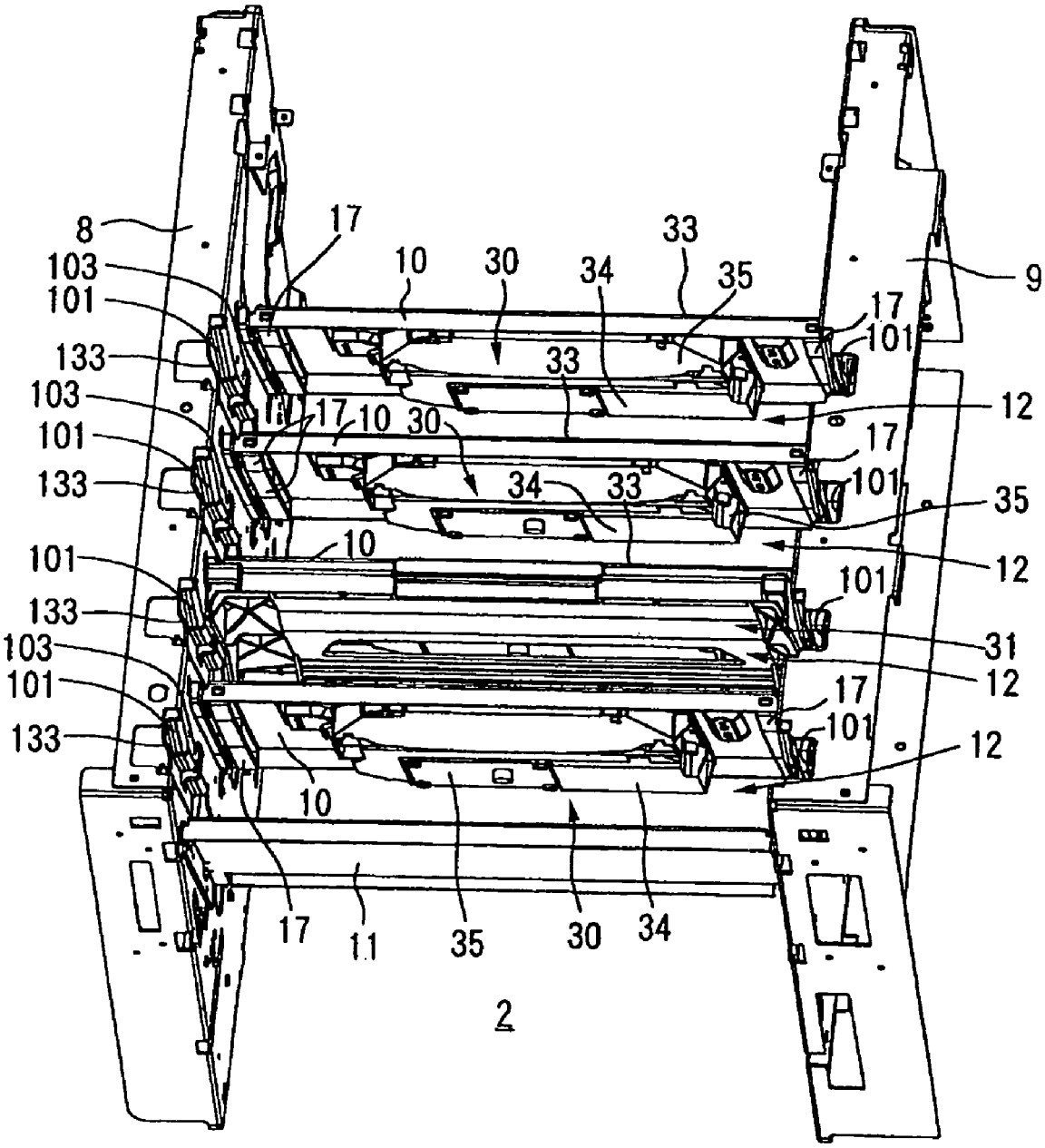
FIG. 14 is a perspective view of a main body casing of the color laser printer shown in FIG. 1 when viewed from an upper front position.

As shown in FIG. 14, the main body casing 2 has a left side plate 8 and a right side plate 9, which oppose each other with an interval therebetween in a transverse direction (i.e., a direction orthogonal to a longitudinal direction and the vertical direction, the same also applies to any counterparts in the following descriptions); and a plurality of (four) partition plates 10 and front plates 11, which extend between the left and right side plates 8 and 9 and serve as positioning members. The respective partition plates 10 and the front plates 11 are disposed so as to divide a longitudinal space—existing between the left side plate 8 and the right side plate 9—into the process sections 27, which will be described later, wherein the partition plates 10 are spaced apart from each other at any locations of the main body casing 2 in the longitudinal direction thereof, and the front plates 11 are provided forward of the respective partition plates 10.

The respective partition plates 10 and the front plates 11 are disposed such that their upper edge portions are inclined forward and their lower edge portions are inclined rearward, with respect to the longitudinal direction (identical with a direction in which the sheet 3 is transported at an image forming position to be described later) and the vertical direction. As shown in FIG. 1, the partition plates 10 and the front plates 11 are arranged such that their upper edge portions are vertically spaced away from the top cover 7, and such that the lower edge portions of the same are vertically spaced away from a transfer section 28 to be described later.

In this main body casing 2, a plurality of (four) process housing sections 12, where the process sections 27 of respective colors are to be disposed and which act as cartridge housing sections, are defined by means of the partition plates 10 and the front plates 11, which are adjacent to each other, and the left and right side plates 8, 9.

Each of the process housing sections 12 has a drum housing section 13 and a development housing section 14. The drum housing section 13 serves as a first housing section which houses a drum cartridge 31 and a development cartridge 32, both of which will be described later, and to which a holder section 43 of the drum cartridge 31 to be described later is attached. The development housing section 14 serves as a second housing section to which the development cartridge 32 to be described later is attached.

The drum housing sections 13 are located below the respective partition plates 10. In the longitudinal direction, the drum housing section 13 is defined by virtual planes formed as a result of the partition plate 10 and the front plate 11 being extended, in their present attitudes, in downwardly oblique directions. In the transverse direction, the drum housing section 13 is defined by the left side plate 8 and the right side plate 9. The thus-defined internal spaces are taken as drum housing spaces 15 which act as first housing regions for housing the holder sections 43 of the drum cartridges 31 to be described later.

The development housing section 14 is provided continuous with the drum housing section 13 at a position upstream in a direction where the drum cartridge 31 to be described later is attached to the drum housing section 13; i.e., a position upward of the drum housing section 13, and along a direction in which the drum cartridge 31 and the development cartridge 32 to be described later are attached. The respective development housing sections 14 are longitudinally defined by the partition plates 10 and the front plates 11, and are laterally defined by the left side plate 8 and the right side plate 9. The thus-defined internal spaces (exclusive of extended-section housing spaces 18 which will be described later) are taken as development housing spaces 16 which act as second housing regions for housing the development cartridges 32 to be described later.

As shown in FIG. 14, rail sections 17—over which tab sections 51 of the drum cartridge 31 to be described later are to slidably contact—are provided on both sides of the development housing section 14 at positions corresponding to both ends of the partition plate 10 in the transverse direction thereof. The respective rail sections 17 are formed into the shape of a thick strip along the direction in which the drum cartridge 31 is attached or removed.

As shown in FIG. 1, the sheet feeding section 4 includes a sheet feeding tray 21 which is removably, horizontally attached to an internal bottom portion of the main body casing 2 from the front thereof; a pickup roller 22 and a sheet feeding roller 23, which serve as feeding mechanism provided, at positions above the front-side of the sheet feeding tray 21; a sheet feeding side U-shaped path 24 provided at a position above the front side of the sheet feeding roller 23; and a transport roller 25 and a registration roller 26, both of which are provided in arbitrary positions on the sheet feeding side U-shaped path 24.

The sheets 3 are stacked in the sheet feeding tray 21, and the topmost sheet of the sheets 3 is picked up by the pickup roller 22 and transported forward, and is then fed to the sheet feeding side U-shaped path 24 by means of the sheet feeding roller 23.

The sheet feeding side U-shaped path 24 is formed as an substantially-U-shaped path for transporting the sheets 3 such that an upstream end of the path is adjacent to the sheet feeding roller 23 at a lower position; such that the sheet 3 is fed forwardly; such that a downstream end of the same is adjacent to a transport belt 80, which will be described later, at a higher position; and such that the sheet 3 is output rearward.

The sheet 3 having been fed forward to the upstream-side end of the sheet feeding side U-shaped path 24 by the sheet feeding roller 23 is transported by the transport roller 25 in the sheet feeding side U-shaped path 24, and the transporting direction of the sheet 3 is reversed. After having been registered, the sheet 3 is output rearward by the registration roller 26.

The image forming section 5 has the process sections 27, the transfer section 28, and a fixing section 29. The process sections 27 are provided for toner of a plurality of colors; namely, the process sections 27 consist of a yellow process section 27Y, a magenta process section 27M, a cyan process section 27C, and a black process section 27K. The process sections 27 are disposed in the respective process housing sections 12 of the main body casing 2, and are sequentially arranged so as to horizontally overlap each other while being spaced apart from each other in the longitudinal direction.

Each of the process sections 27 has a scanner unit 30, the drum cartridge 31 corresponding to a photosensitive cartridge which acts as a first cartridge, and the development cartridge 32 included in the process cartridge which is removably attached to the drum cartridge 31 and acts as a second cartridge. The process cartridge is formed from the drum cartridge 31 and the development cartridge 32 attached to the drum cartridge 31.

The scanner unit 30 has a scanner casing 35 which is provided as a bulging section. A laser emission section (not shown), a polygon mirror 36, two lenses 37, 38, and a reflecting mirror 39 are provided in the scanner casing 35.

As shown in FIG. 14, the scanner casing 35 is positioned in the transverse center position of each partition plate 10 such that the rail sections 17 oppose each other with the scanner casing 35 sandwiched therebetween in the transverse direction; such that a rear wall of the scanner casing 35 remains in contact with the front surface of the partition plate 10; and such that a front wall 34 of the scanner casing 35 bulges forward from the partition plate 10. As mentioned above, since the scanner casing 35 is positioned so as to bulge forward from the partition plate 10, the scanner unit 30, the drum cartridge 31, and the development cartridge 32 can be arranged in close proximity to each other. Accordingly, an attempt to miniaturize the image forming apparatus can be realized.

Since the scanner casing 35 is positioned so as to bulge forward from the partition plate 10 as mentioned above, passage of the drum cartridge 31 through the development housing section 14 is restricted so long as the development cartridge 32 remains attached to the drum cartridge 31. When the development cartridge 32 remains separated from the drum cartridge 31, the development housing section 14 allows the drum cartridge 31 to pass through the development housing space 16.

Figure 15:
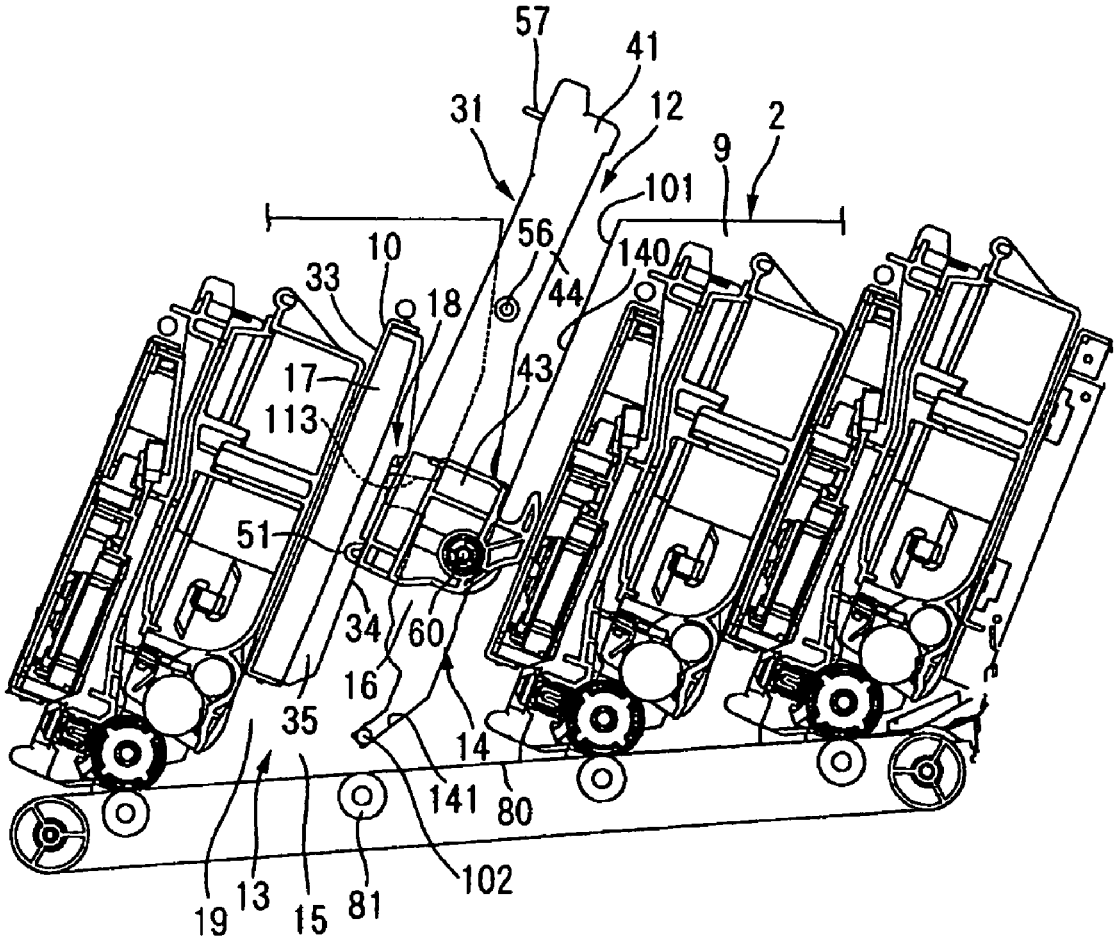
FIG. 15 is a side view for describing a state (a state where the drum cartridge is in the course of passing through the development housing section) where the drum cartridge is attached to a process housing section.

As shown in FIG. 15, the development housing section 14 is formed by the scanner casing 35 so as to become narrower than the drum housing section 13 in a direction in which the drum cartridge 31 and the development cartridge 32 are attached and in another direction orthogonal to the transverse direction (i.e., the thicknesswise direction of the drum cartridge 31 to be attached and that of the development cartridge 32 to be attached, which will hereinafter be simply called "thicknesswise directions").

More specifically, the development housing section 14 is formed so as to become greater, in the thicknesswise direction, than the thickness of the holder section 43 of the drum cartridge 31 to be described later; to be held in the process housing section 12; and to become smaller than the total thickness of the drum cartridge 31 attached to the development cartridge 32.

An expansion space 19 that is wider than the development housing section 14 and acts as an expansion region is ensured for the drum housing section 13 at a position upstream from the scanner casing 35 in the attachment direction of the drum cartridge 31. Therefore, the drum housing section 13 is formed so as to be held in the process housing section 12 in the thicknesswise direction and to become greater than the total thickness of the drum cartridge 31 attached to the development cartridge 32.

As will be described later, in a state where the holder section 43 is positioned in the expansion space 19; namely, in a state where the drum cartridge 31 is housed in the drum housing space 15 of the drum housing section 13 and where the development cartridge 32 is housed in the development housing space 16 of the development housing section 14, even when an attempt is made to cause the drum cartridge 31 to separate, the holder section 43 and the scanner casing 35 come into contact with each other, so that movement of the drum cartridge 31 in the separating direction is restricted. When the drum cartridge 31 is displaced from the scanner casing 35 in the separating direction (the forward direction) over a distance corresponding to the thickness of the development cartridge 32 after the development cartridge 32 has been removed from the development housing section 14, movement of the drum cartridge 31 in the separating direction is allowed, so that the drum cartridge 31 can be caused to separate from the drum housing section 13 while passing through the development housing section 14.

The extended section housing space 18, which houses an extended section 44—which will be described later—of the drum cartridge 31 and acts as an extended section housing region, is formed on both sides of the scanner casing 35 in the transverse direction thereof and above the same within the development housing section 14, as well as in the vicinity of the front wall 34 of the scanner casing 35 (a space between the front wall 34 of the scanner casing 35 and the development housing space 16, where an intermediate plate 54 to be described later is positioned).

As shown in FIG. 1, an exit window 40 from which a laser beam exits is formed in the front wall 34 of the scanner casing 35.

In the scanner unit 30, the laser beam that is illuminated from the laser emission section on the basis of image data is reflected by the polygon mirror 36, and sequentially passes through or is sequentially reflected by the lens 37, the reflecting mirror 39, and the lens 38, to thus exit from the exit window 40.

Figure 2:
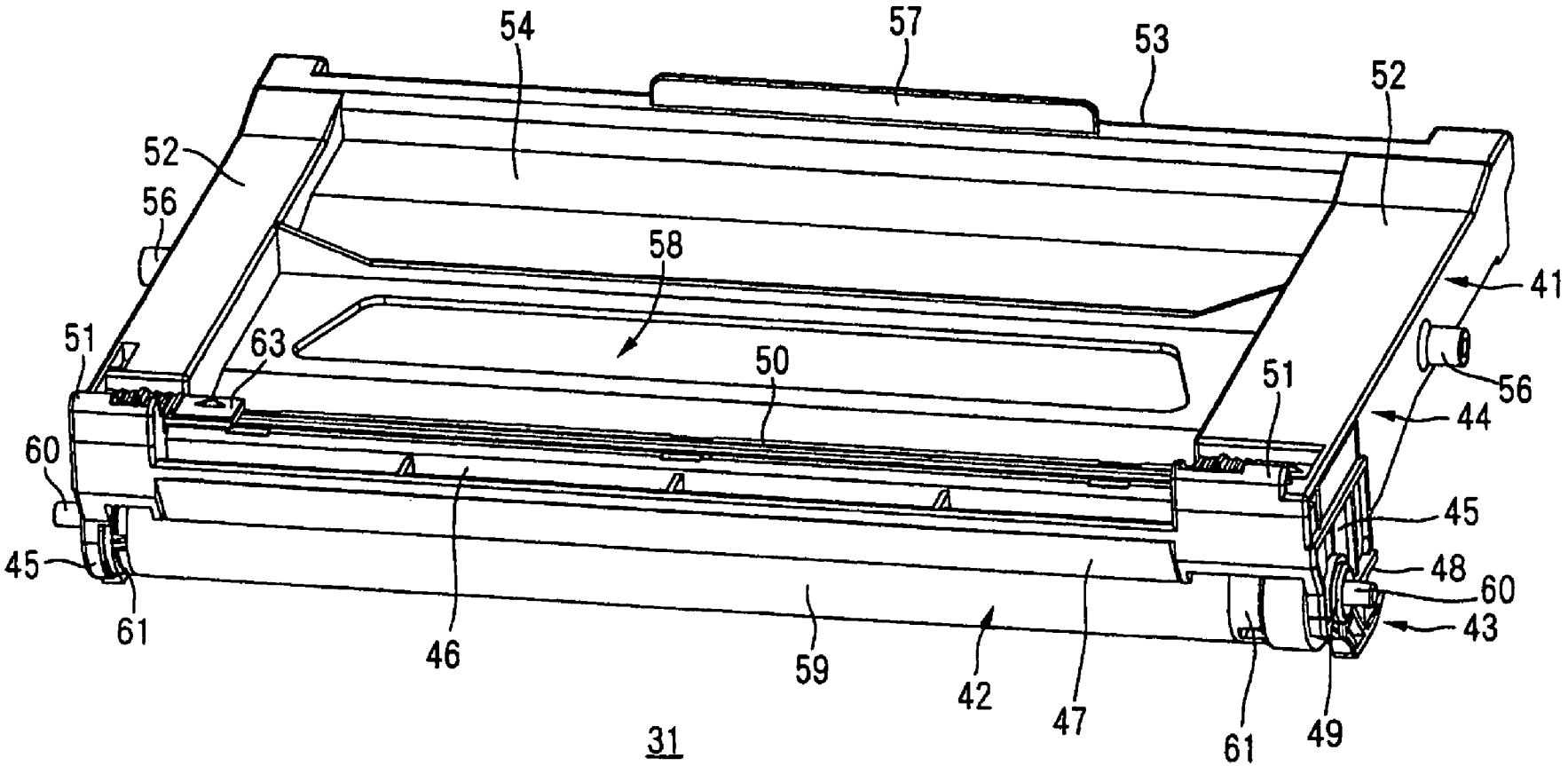
FIG. 2 is a perspective view of a drum cartridge of the color laser printer shown in FIG. 1 when viewed from an upper front position.
Figure 3:
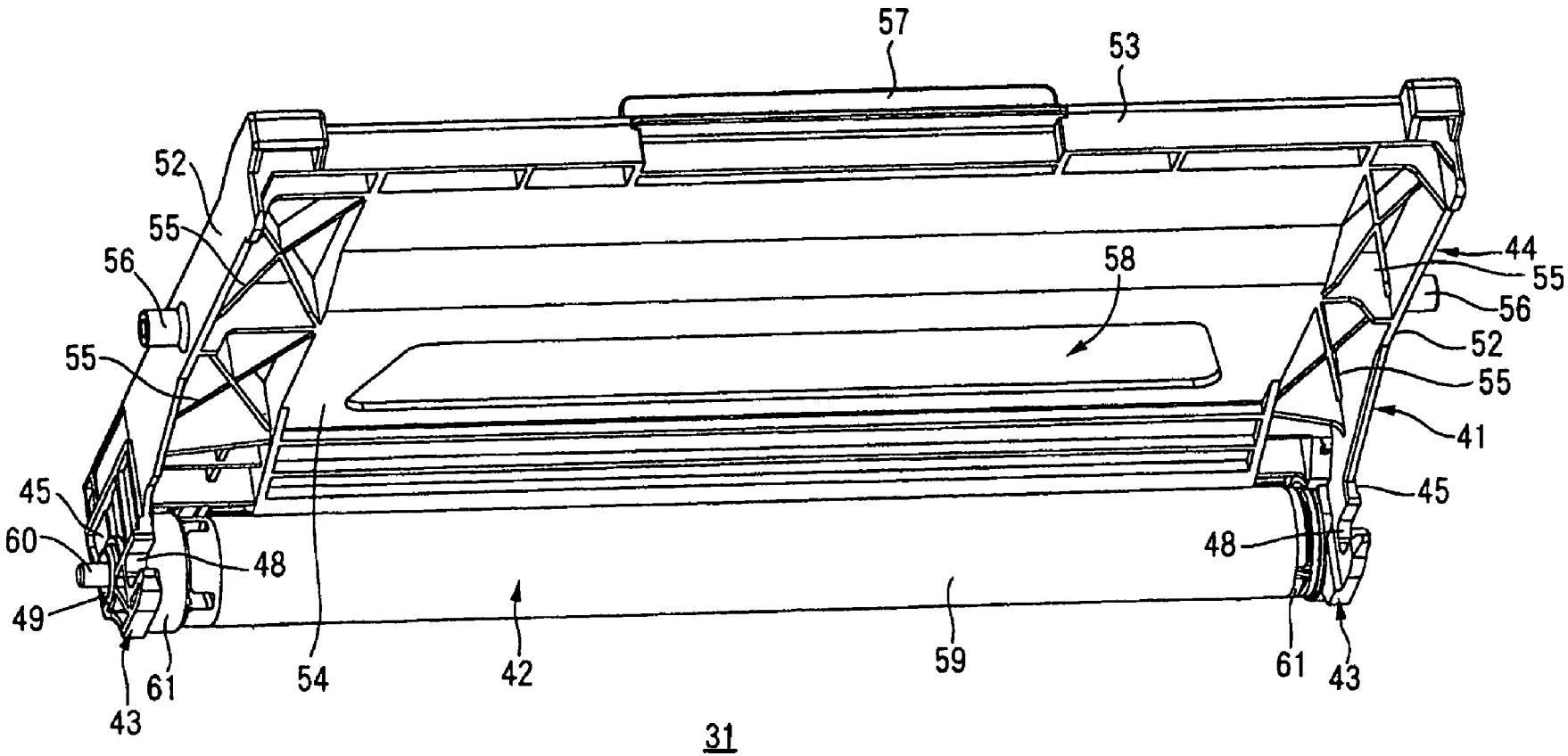
FIG. 3 is a perspective view of a drum cartridge of the color laser printer shown in FIG. 1 when viewed from a lower backward position.

As shown in FIGS. 2 and 3, the drum cartridge 31 has a drum enclosure 41 serving as a first enclosure; a photosensitive drum 42 that is provided in the drum enclosure 41 and corresponds to a photosensitive body acting as the process unit; and a scorotoron electrification device 62 (see FIG. 1) that is a electrification apparatus.

The drum enclosure 41 has the holder section 43 that is a protruding section and acts as the main body section, and the extension section 44 that extends from the holder section 43. The drum enclosure 41 is formed integrally from a resin material.

In descriptions of the drum cartridge 31 which are made by reference to FIGS. 2 to 7, an upper side of a drawing sheet is taken as an upper side (i.e., the back side achieved at the time of attachment of the drum cartridge 31); a lower side of the drawing sheet is taken as a lower side (i.e., the front side achieved at the time of attachment of the drum cartridge 31); a side where the holder section 43 is to be position is taken as a front side (i.e., the lower side achieved at the time of attachment of the drum cartridge 31); and a side where the extension section 44 is positioned is taken as a back side (i.e., the upper side achieved at time of attachment of the drum cartridge 31).

The holder section 43 has two holder side walls 45 opposing each other while being spaced away from each other in the transverse direction; a holder upper wall 46 extending between the upper edges of the respective holder side walls 45; and a holder front wall 47 extending from the front edge of the holder upper wall 46 to vertical-midpoint positions on the respective holder side walls 45.

The thickness (vertical length) of the holder section 43 is determined so as to become greater than the thickness (vertical length) of a development enclosure 64 of the development cartridge 32.

The thickness (vertical dimension) of the holder section 43 is made greater than that (vertical dimension) of the extension section 44. As a result of the holder section 43 being formed to become thicker than the extension section 44, the photosensitive drum 42 and the scorotoron electrification device 62 can be completely housed.

Figure 6:
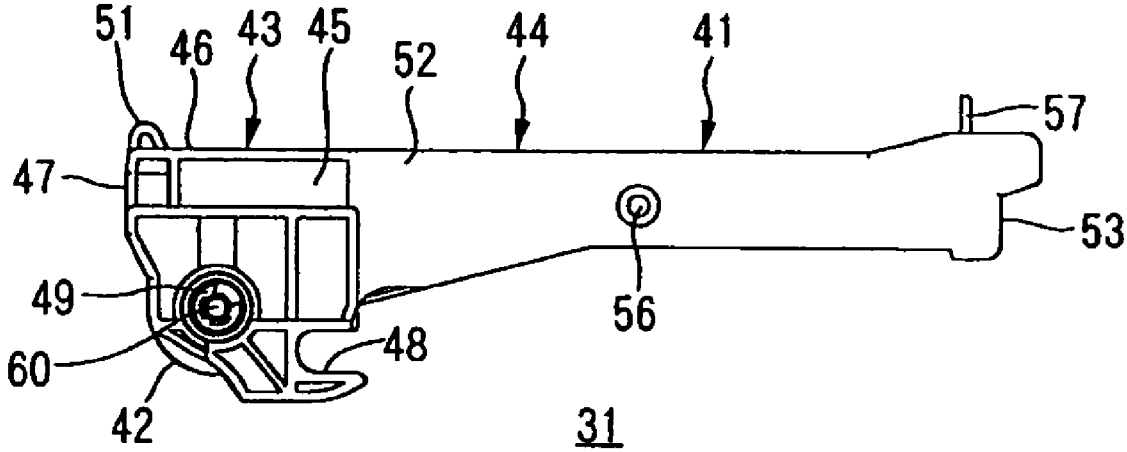
FIG. 6 is a right view of the drum cartridge of the color laser printer shown in FIG. 1.
Figure 7:
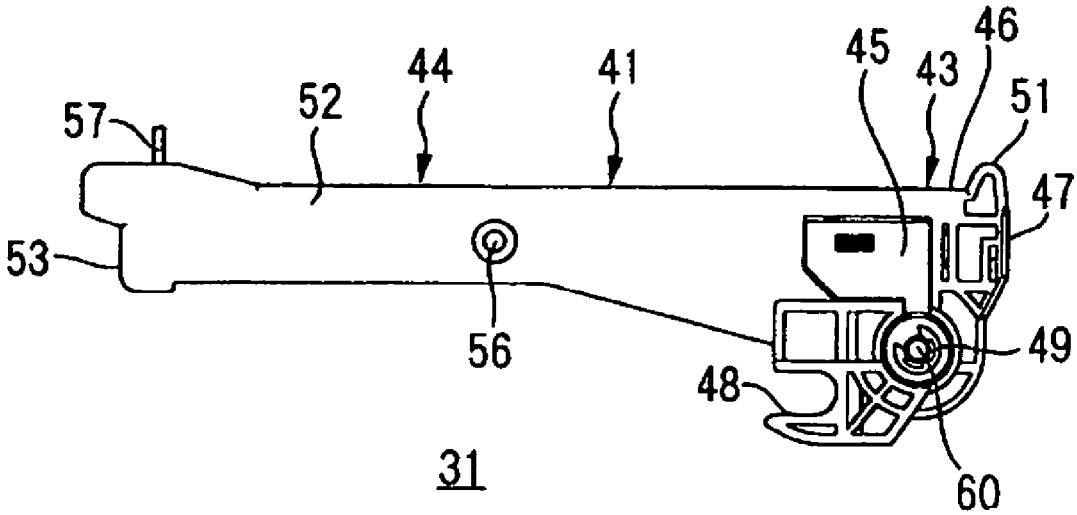
FIG. 7 is a left view of the drum cartridge of the color laser printer shown in FIG. 1.

As shown in FIGS. 6 and 7, an substantially-U-shaped development positioning groove 48, which is opened rearward, is formed in a lower portion of each of the holder side walls 45. An insertion section 49, into which a drum shaft 60 of the photosensitive drum 42 is inserted, is formed forward of the development positioning groove 48.

As shown in FIG. 2, a cleaner fitting section 50, to which a cleaner 63 to be described later slidably fits, is formed in the holder upper wall 46 over the transverse width thereof. As shown in FIGS. 6 and 7, the tab section 51, whose front edge protrudes upward and which acts as a protruding section having an substantially-triangular profile when viewed from the side, is formed on either side of the holder upper wall 46 in the transverse direction thereof.

As shown in FIGS. 2 and 3, the extension section 44 is formed to extend rearward from the holder section 43 in the development housing section 14 so as to extend upward beyond the upper edge portion of the scanner casing 35 with the holder section 43 remaining attached to the drum housing section 13.

The extension section 44 has two extension side sections 52 that oppose each other while being spaced away from each other in the transverse direction; an extension back wall 53 that extends between rear end portions of the respective extension side sections 52 and serve as extension edge section; and an intermediate plate 54 provided in the area that is surrounded by the holder section 43, the respective extension side sections 52, and the extension rear wall 53.

As shown in FIG. 2, each of the extension side sections 52 assumes an substantially-C-shaped cross-sectional profile whose lower portion is opened. Each of outer side faces of the extension side section 52 is formed so as to continuously extend rearward from an upper portion of the development positioning groove 48 of each holder side wall 45 and to extend rearward from both sides of the holder section 43 in the transverse direction thereof.

As shown in FIG. 3, each of the extension side sections 52 has two reinforcement ribs 55 which are provided in the C-shaped space of the extension side section. The reinforcement ribs 55, which serve as reinforcement sections and assume an substantially-X-shaped geometry when viewed from the bottom, are arranged along the longitudinal direction.

A drum boss section 56 protruding outward in the transverse direction is provided at an arbitrary position on the outer side face of each extension side section 52 in the longitudinal direction.

The extension rear wall 53 extends in the transverse direction so as to couple together the rear end portions of the respective extension side sections 52. A drum grip 57 serving as a grip section is provided in the center of the extension rear wall 53 in the transverse direction thereof, wherein the grip section is used for holding the drum cartridge 31 in order to perform operation for detaching or attaching the drum cartridge 31 from or to the drum housing section 13.

Figure 4:
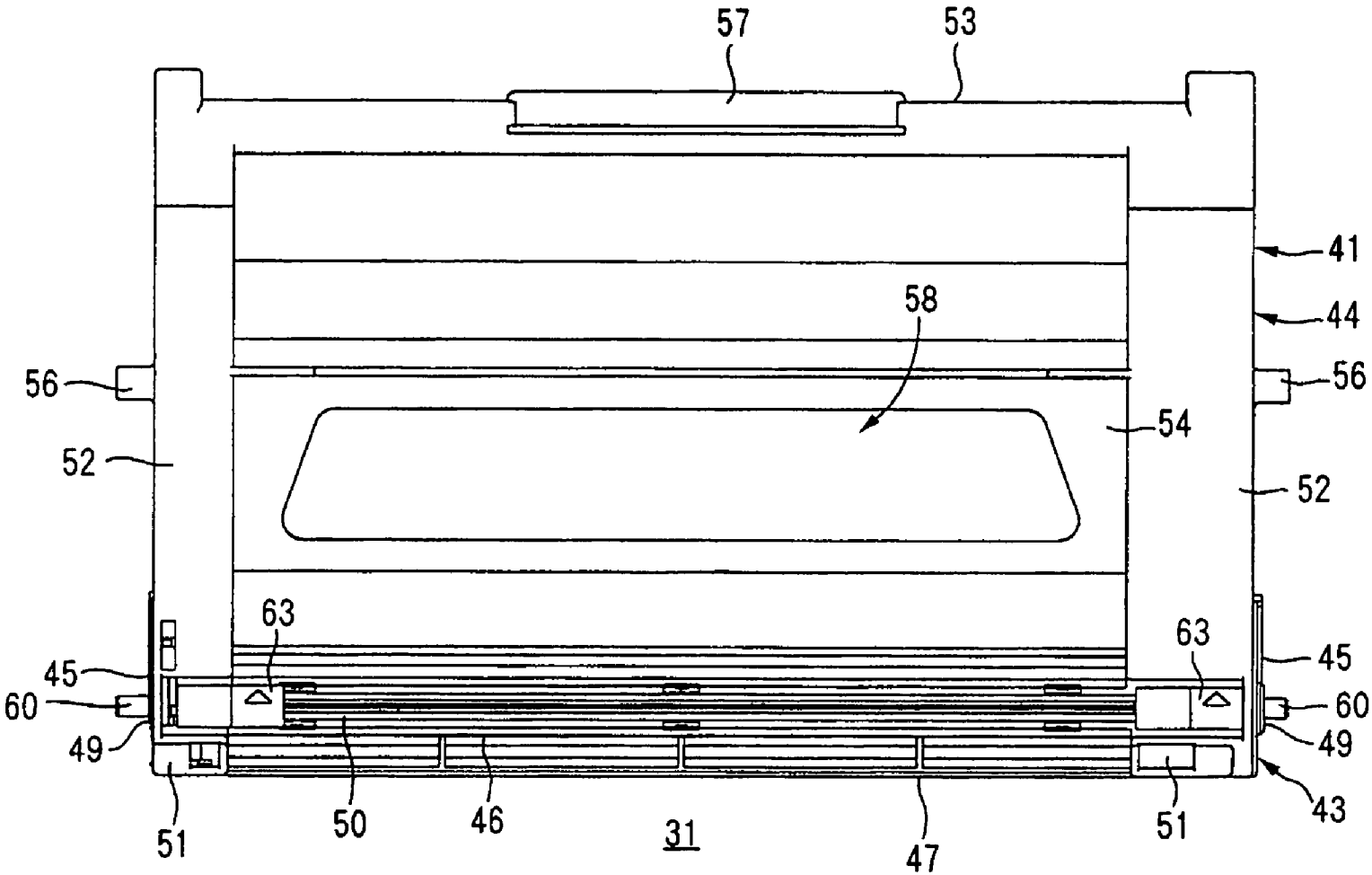
FIG. 4 is a plan view of the drum cartridge of the color laser printer shown in FIG. 1.

The intermediate plate 54 assumes a substantially-plane shape when viewed from the top. As shown in FIG. 2, the intermediate plate 54 is provided such that the holder section 43, the respective extension side sections 52, and the extension rear wall 53 are coupled together within the area surrounded thereby and at a position receded from the upper surfaces of the respective extension side sections 52 and the upper surface of the extension rear wall 53. An opening section 58 is formed in the intermediate plate 54 in order to allow passage of the laser beam emitted from the exit window 40 of the scanner casing 35. As shown in FIG. 4, the opening section 58 is formed into a trapezoidal shape when viewed from the top, wherein the trapezoid has a wide front side and a narrow rear side. As a result of the opening section 58 being formed into the trapezoidal shape as mentioned above, only the area of the intermediate plate 54 through which the laser beam passes is cut, and the strength of the extension section 44 can be enhanced as compared with a case where the opening section 58 is formed into a rectangular shape when viewed from the top.

As shown in FIG. 2, the photosensitive drum 42 is housed in the holder section 43 along the transverse direction. This photosensitive drum 42 has a drum main body 59 which assumes a cylindrical shape and is formed from a positively-electrified photosensitive layer whose outermost layer is formed from polycarbonate; and the drum shaft 60 which serves as a pivot section and a support shaft at the axial center of the drum main body 59 and which extends in the axial direction of the drum main body 59. The axial ends of the drum shaft 60 are inserted into the insertion sections 49 of the respective holder side walls 45 and are supported by the holder side walls 45 in a non-rotatable manner so as to protrude outside the respective holder side walls 45 in the transverse direction thereof.

Figure 5:
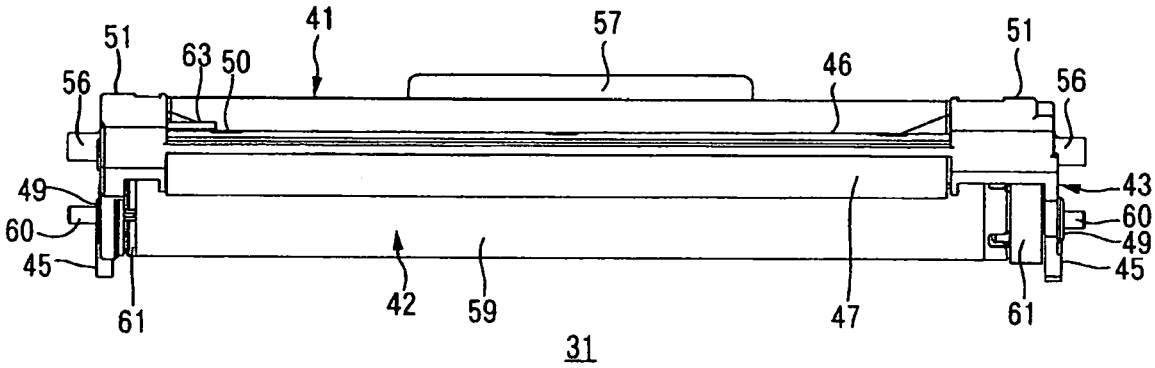
FIG. 5 is a front view of the drum cartridge of the color laser printer shown in FIG. 1.

Pivotal support members 61 are fitted into both axial ends of the drum main body 59 in a non-rotatable manner. The respective pivotal support members 61 are supported by the drum shaft 60 so as to be able to rotate in relation to the drum shaft 60. Thus, the drum main body 59 is supported so as to be rotatable around the drum shaft 60. In this state, as shown in FIG. 5, the photosensitive drum 42 is positioned in the holder section 43 such that the front surface of the photosensitive drum 42 is exposed from the lower portion of the holder front wall 47.

As shown in FIG. 1, the scorotoron electrification device 62 is housed in the holder section 43 along the transverse direction at a position above (rearward in FIG. 2) the tab sections 51. The scorotoron electrification device 62 is a positively-electrified scorotoron-type electrification device which has a wire and a grid and generates corona discharge. The scorotoron electrification device 62 is supported by the holder upper wall 46 at a position rearward of (above in FIG. 2) the photosensitive drum 42, and is spaced from and opposite the photosensitive drum 42 so as not to contact the same. As shown in FIG. 2, this scorotoron electrification device 62 is provided with the cleaner 63 for cleaning a wire such that the cleaner 63 slidably fits to the cleaner fitting section 50 of the holder upper wall 46.

Figure 8:
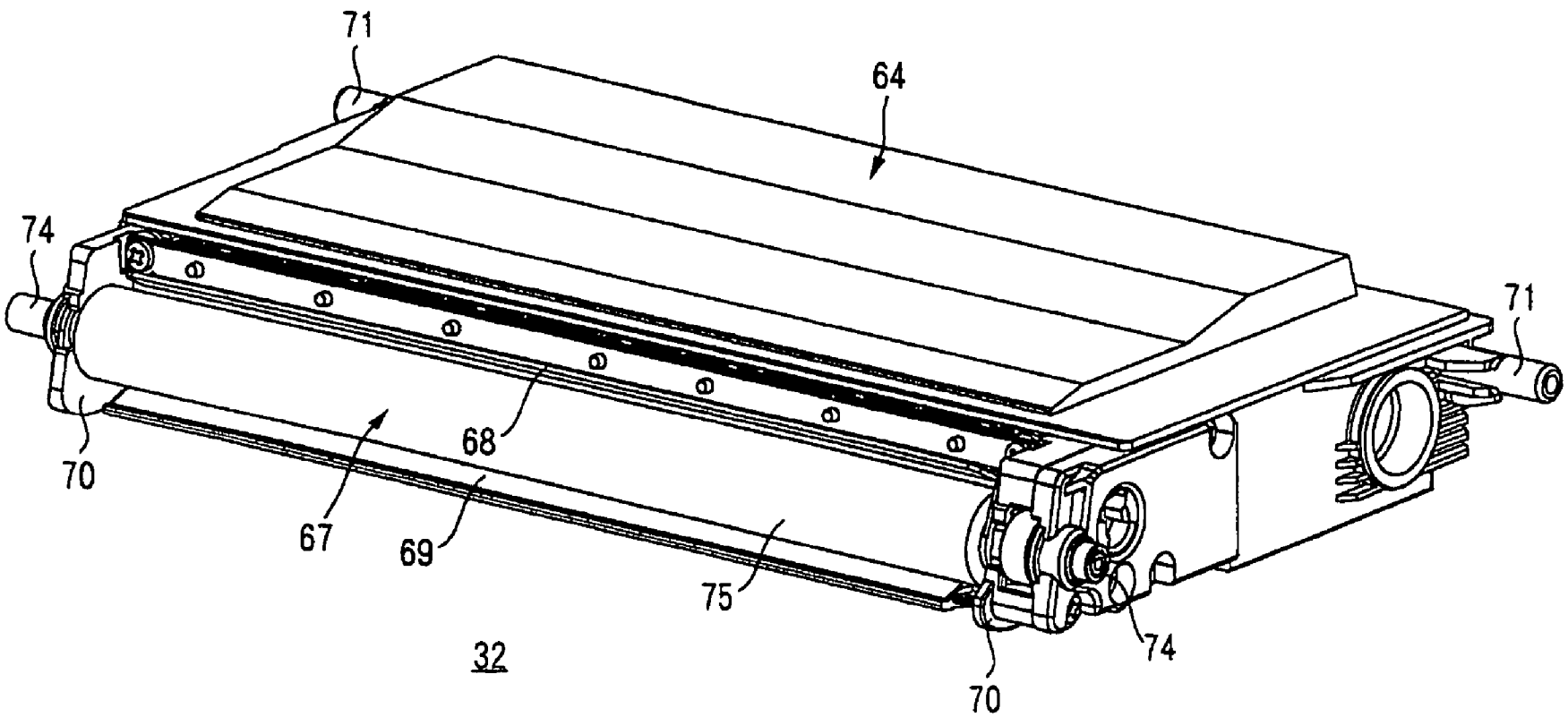
FIG. 8 is a perspective view of a development cartridge of the color laser printer shown in FIG. 1 when viewed from an upper front position.
Figure 9:
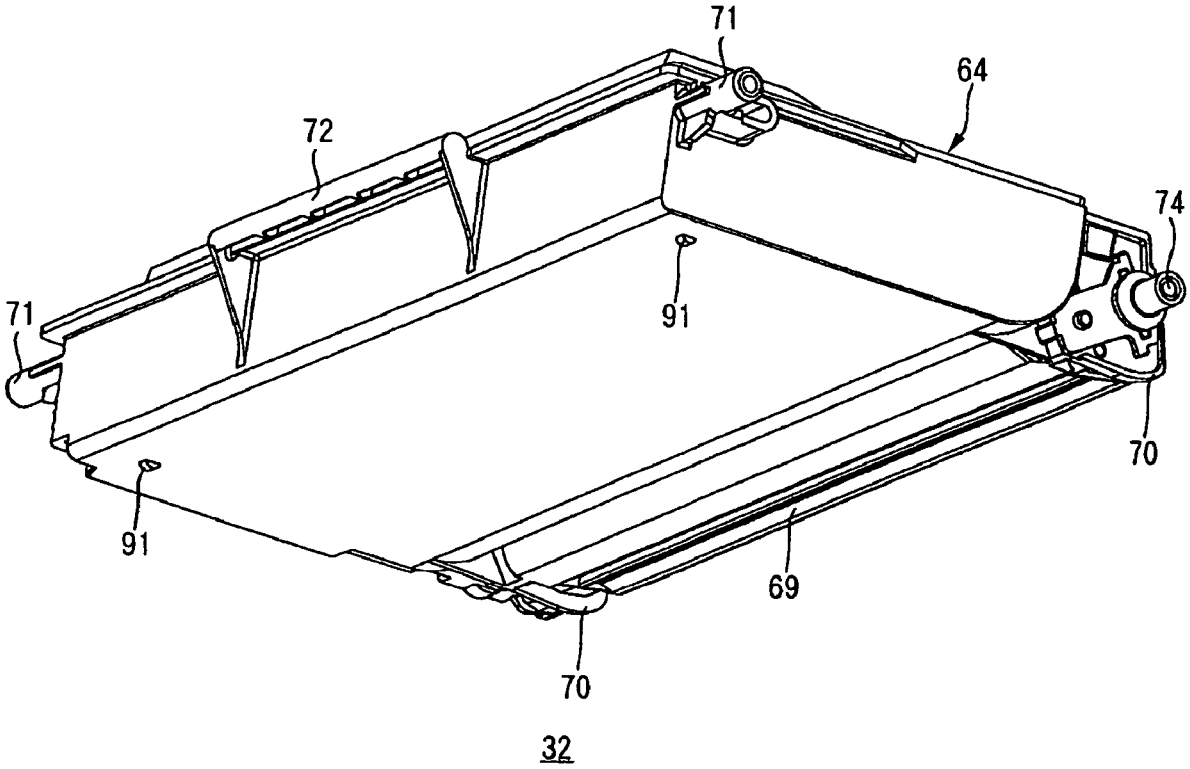
FIG. 9 is a perspective view of a development cartridge of the color laser printer shown in FIG. 1 when viewed from a lower backward position.
Figure 10:
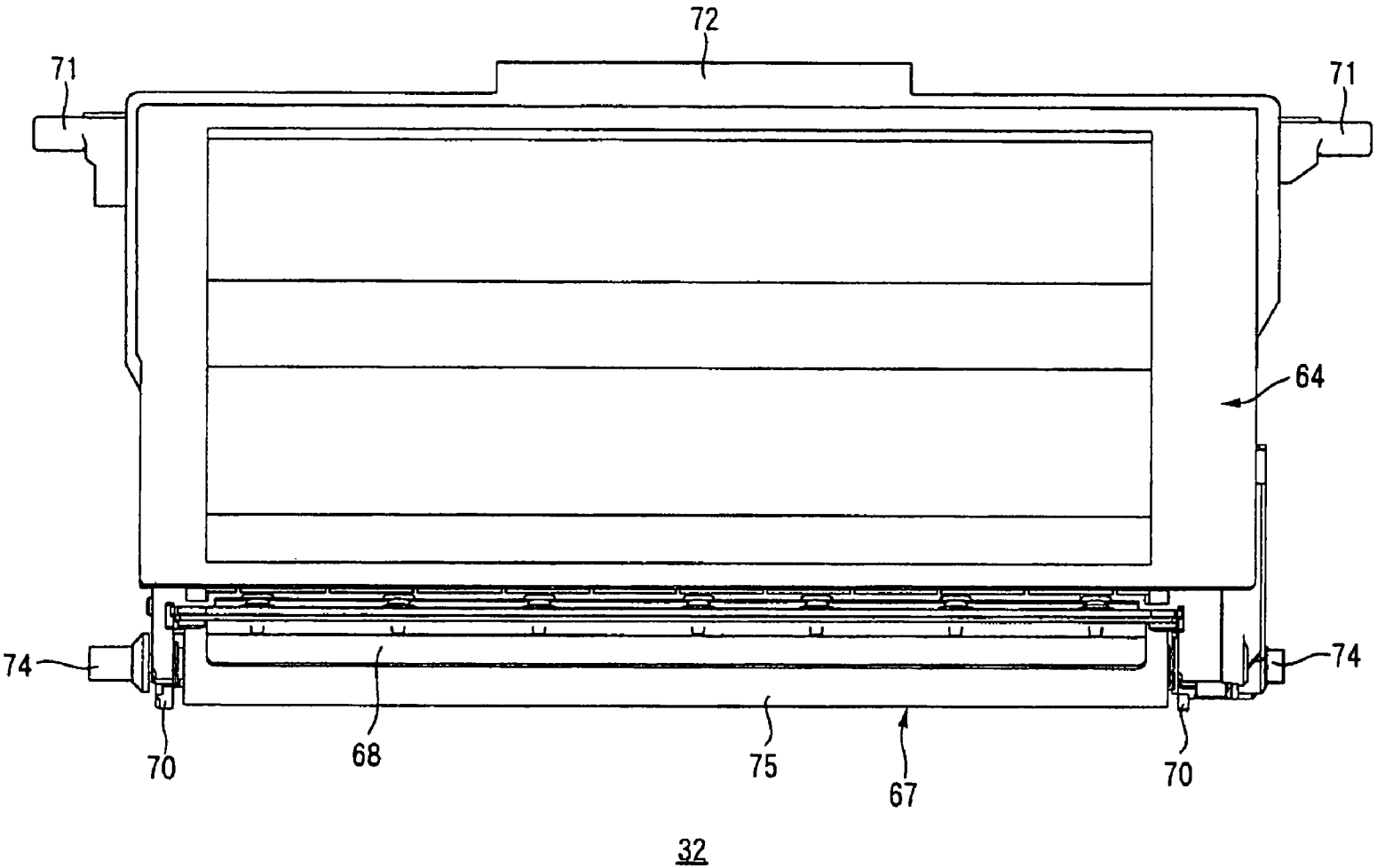
FIG. 10 is a plan view of the development cartridge of the color laser printer shown in FIG. 1.

As shown in FIGS. 8 and 9, the development cartridge 32 has the development enclosure 64 acting as a second enclosure; a toner housing chamber 65 (see FIG. 1) which is a development housing section to be provided in the development enclosure 64 and acts as the process unit; a feed roller 66 (see FIG. 1); a development roller 67 acting as a developing-agent carrier; and a layer thickness regulation blade 68.

In descriptions of the development cartridge 32 which are made by reference to FIGS. 8 to 13, the upper side of the drawing sheet is taken as an upper side (i.e., the back side achieved at the time of attachment of the development cartridge 32); the lower side of the drawing sheet is taken as a lower side (i.e., the front side achieved at the time of attachment of the development cartridge 32); a side where the development roller 67 is positioned is taken as a front side (i.e., the lower side achieved at time of attachment of the development cartridge 32); and a side where the toner housing section 65 is positioned is taken as a back side (i.e., the upper side achieved at time of attachment of the development cartridge 32).

As shown in FIG. 8, the development enclosure 64 is formed into the shape of a box whose front side is opened. A jaw section 69 serving as a press contact section and curved sections 70 serving as slidable contact sections are provided at the lower front end portion of the development enclosure 64.

Figure 11:
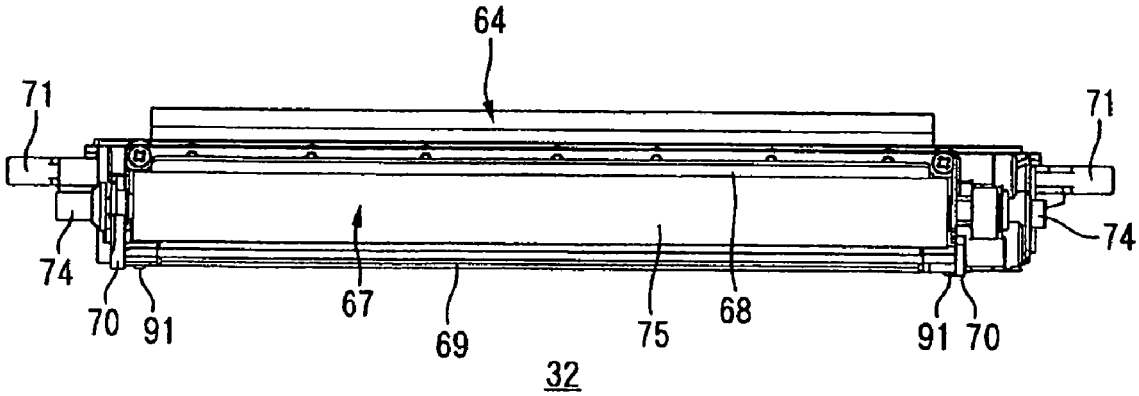
FIG. 11 is a front view of the development cartridge of the color laser printer shown in FIG. 1.

The jaw section 69 is provided at the lower front portion of the development enclosure 64 over the entire width thereof in the transverse direction so as to slightly protrude forward. As shown in FIG. 11, in order to prevent leakage of toner, the jaw section 69 is disposed opposite the development roller so as to come into pressed contact with a peripheral surface of the development roller 67 from below.

Figure 12:
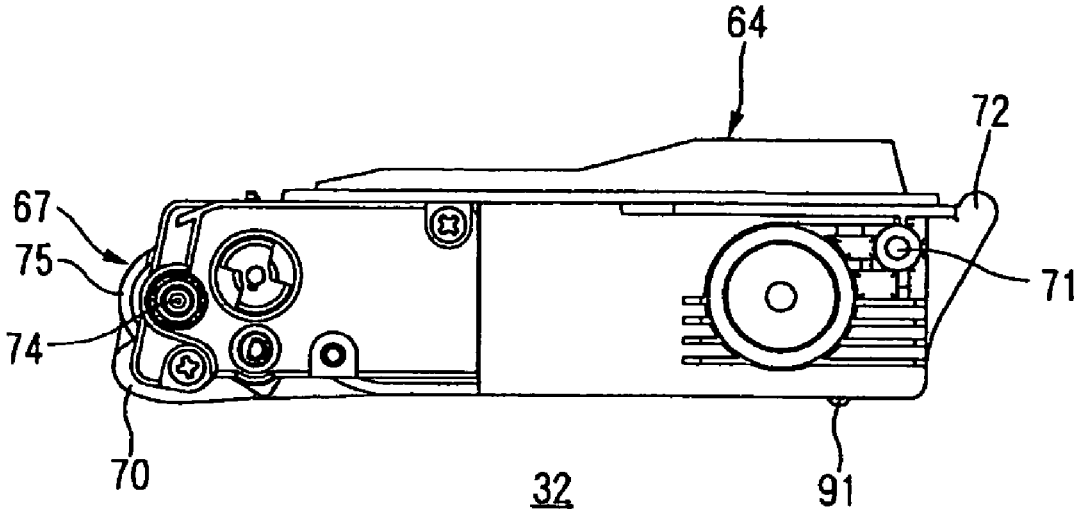
FIG. 12 is a right view of the development cartridge of the color laser printer shown in FIG. 1.
Figure 13:
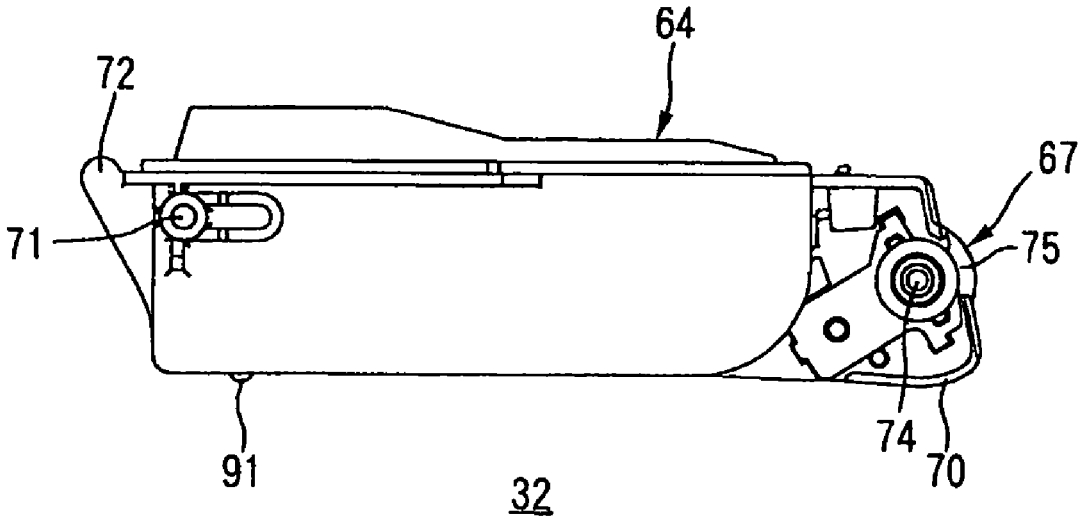
FIG. 13 is a left view of the development cartridge of the color laser printer shown in FIG. 1.

The curved sections 70 are provided at both transverse end portions of the lower front end of the development enclosure 64 with the jaw section 69 being sandwiched between the transverse end portions. As shown in FIGS. 12 and 13, the curved sections 70 are formed into the shape of a substantially-L-shaped curved plate so as to protrude from front to back beyond the jaw section 69.

As shown in FIG. 9, development boss sections 71, which protrude outside in the transverse direction and act as members to be pressed (called "pressed member" throughout the specification), are provided at upper rear end portions of both side walls of the development enclosure 64. A development grip 72 is provided in the transverse center position of the rear wall of the development enclosure 64. This development grip 72 is used in performing operation for detaching or attaching the development cartridge 32 from or to the development housing section 14 while holding the development cartridge 32. Contact protrusions 91, which slightly protrude downward, are formed at positions in the vicinity of both rear ends of the bottom wall of the development enclosure 64.

As shown in FIG. 1, the toner housing chamber 65 is formed as an upper portion (or a rear portion in FIG. 8) of the development enclosure 64. Toner, which is employed as developing agents of respective colors, is housed in the toner housing chamber 65. More specifically, toner is stored in the toner housing chambers 65 of the respective process sections 27. Positively-electrified, nonmagnetic, one-component polymer toner of yellow color is stored in the yellow process section 27Y; positively-electrified, nonmagnetic, one-component polymer toner of magenta color is stored in the magenta process section 27M; positively-electrified, nonmagnetic, one-component polymer toner of cyan color is stored in the cyan process section 27C; and positively-electrified, nonmagnetic, one-component polymer toner of black color is stored in the black process section 27K.

More specifically, substantially-spherical polymer toner obtained by the polymerization method is used as toner of the respective colors. A styrene-based monomer such as styrene and an acrylic monomer such as an acrylic acid, alkyl (C1 to C4) acrylate, alkyl (C1 to C4) meta-acrylate are copolymerized by a known polymerization method such as suspension polymerization, to thus obtain a binding resin. The thus-obtained binding agent is formulated, while being taken as a principal constituent, together with a coloring agent, a charge-controlling agent, and wax, thereby forming toner base particles. External additives are added to the toner base particles with a view toward enhancing fluidity. Thus, the polymer toner is formed.

The yellow coloring agent, the magenta coloring agent, the cyan coloring agent, and the black coloring agent, all of which are described above, are formulated as coloring agents. A charge-controlling resin is obtained by copolymerization of an ionic monomer having an ionic functional group, such as ammonium salt, with a monomer which can be copolymerized with an ionic monomer, such as a styrene-based monomer or an acrylic monomer. This charge control resin is formulated as the charge-controlling agent. For instance, powder of metallic oxides such as silica, an aluminium oxide, a titanium oxide, strontium titanate, a cerium oxide, or a magnesium oxide; or inorganic powder such as a powder of a carbide or a powder of a metallic salt, are formulated as external additives.

An agitator 73 for agitating toner is rotatably supported on both side walls of the development enclosure 64 at a lower position in the toner housing chamber 65 (the front position in FIG. 8).

The feed roller 66 is rotatably supported on both side walls of the development enclosure 64 at a lower front position (a forward lower position in FIG. 8) of the toner housing chamber 65. This feed roller 66 is formed by coating a metal roller shaft with a roller portion which is formed from a conductive spongy member.

The development roller 67 is disposed opposite the feed roller 66 at a position below the feed roller 66 (a forward position in FIG. 8), and is pressed against the feed roller 66. As shown in FIG. 8, the development roller 67 is disposed at the front end portion of the development enclosure 64 in the transverse direction such that the front surface of the development roller 67 is exposed. As mentioned previously, the thus-exposed lower end portion is compressed against the jaw section 69.

The development roller 67 is formed by coating a metal roller shaft 74 with a roller portion 75 which is formed from an elastic member such as a conductive rubber material. More specifically, the roller portion 75 is formed into two-layer structure consisting of a roller section of an elastic body and a coating layer. The roller section is formed from conductive urethane rubber or silicon rubber, both of which contain fine carbon particles, or EPDM rubber. The coating layer to be applied over the surface of the roller section is formed from a principal constituent such as urethane rubber, a urethane resin, or a polyimide resin. The roller shaft 75 is rotatably supported on both side walls such that both axial ends of the roller shaft 75 protrude to the outside, in the transverse direction, from the respective side walls of the development enclosure 64.

The layer thickness regulation blade 68 is provided across the entirety of the upper front end portion of the development enclosure 64 in the transverse direction. As shown in FIG. 1, the layer thickness regulation blade 68 is formed by providing free end portions of a blade, which is made from a metal leaf spring member, with press sections, each being formed from insulating silicon rubber and having a semi-circular cross-sectional profile. A base end portion of the blade is supported by a front end portion of the upper wall of the development enclosure 64, and the press sections provided on the free ends portions are arranged so as to press the rear surface of the development roller 67.

As shown in FIG. 14, in the main body casing 2, guide grooves 101 into which the drum shaft 60 of the drum cartridge 31 is inserted are formed in each of the process housing sections 12 in order to guide attachment or detachment of the drum cartridge 31. The guide grooves 101 are formed in the left side plate 8 and the right plate 9 in a mutually-opposing manner so as to bow outward in the transverse direction, and are positioned along attachment-and-detachment directions of the drum cartridge 31 so as to incline rearward from above to below.

As shown in FIG. 19, each of the guide grooves 101 has an upstream guide section 140 and a downstream guide section 141. The upstream guide section 140 is formed to become wider toward an upstream position in the longitudinal direction and is for guiding passage of the drum cartridge 31 through the development housing section 14. The downstream guide section 141 is formed downwardly, continuously to the upstream guide section 140; is bent in a rear oblique direction with reference to the upstream guide section 140; is formed such that the width of the downstream guide section becomes gradually smaller toward the lower end portion; and guides attachment of the drum cartridge 31 to the drum housing section 13 such that the holder section 43 extends toward the expansion space 19 after the drum cartridge 31 has passed through the development housing section 14.

The lower end portion (the deepest portion) of the downstream guide section 141 of each guide groove 101 is taken as a receiving section 102 for receiving the drum shaft 60. The receiving section 102 is longitudinally formed into a recessed shape into which the drum shaft 60 precisely fits, and is arranged such that, when the drum shaft 60 has butted against the receiving section 102, the photosensitive drum 42 comes into contact with the transport belt 80 to be described later.

A drum-positioning groove 103, which bows rearward into a rectangular shape when viewed from the side and acts as a first, positioning section, is formed at arbitrary position on the upstream guide section 140 of each guide groove 101 and in the longitudinal direction. The drum-positioning groove 103 is formed in each of mutually-opposing positions on the left side plate 8 and the right side plate 9 in the transverse direction, so as to be able to receive the drum boss sections 56.

Figure 24:
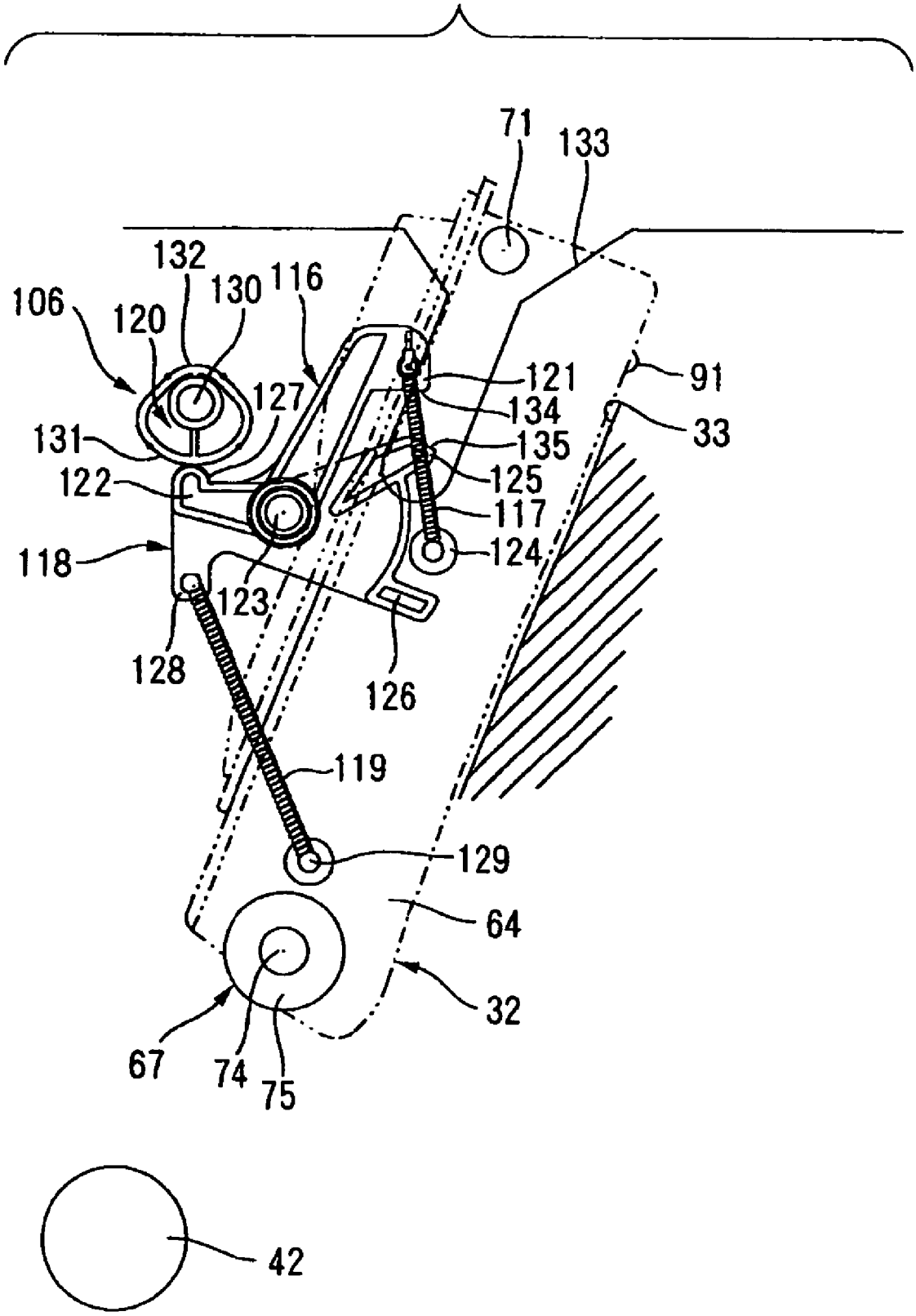
FIG. 24 is a side view for describing a state where the development cartridge is attached to the process housing section (a state achieved before a development boss section is inserted into a boss insertion groove)

As shown in FIG. 14, boss insertion grooves 133—into which the development boss sections 71 of the development cartridge 32 are to be inserted—are formed in an upper side of the upstream guide section 140 of each guide groove 101, so as to cut the left side plate 8 and the right side plate 9. As shown in FIG. 24, the boss insertion grooves 133 are cut straight cut from the upper end portion of the left side plate 8 and that of the right side plate 9 into an substantially-U-shaped shape in the attachment-and-detachment directions of the development cartridge 32; more specifically, in a rear downward direction along a travel path along which the development boss sections 71 are moved in the attachment direction or the detachment direction during attachment or detachment of the development cartridge 32. The boss insertion groove 133 is formed to a depth deeper than (lower than) the position where the development boss sections 71 are situated when the development cartridge 32 is attached to the drum cartridge 31. Moreover, the width of the boss insertion groove 133 in the longitudinal direction is made to such an extent that the development boss sections 71 can be loosely fitted into the groove. An upper end portion of the boss insertion groove 133 is formed into an substantially triangular shape, which becomes wider upward, in order to facilitate receipt of the development boss sections 71.

The guide groove 101 has a drum shaft lock mechanism 104 (see FIG. 22) for restricting movement of the drum shaft 60 received by the receiving section 20; a regulation spring 105 (see FIG. 19) serving as rotation regulation member for restricting rotation of the drum cartridge 31; and a contacting/separating mechanism 106 (see FIG. 24) for causing the development cartridge 32 to contact or separate from the drum cartridge 31.

As shown in FIG. 22, the drum shaft lock mechanism 104 has a set consisting of a press cam 107, which serves as a pressing member, and an urging spring 108, wherein each set is provided at a position on the left side plate 8 of the drum housing section 13 in the vicinity of the receiving section 102 as well as at a position on the right side plate 9 of the same in the vicinity of the receiving section 102.

The press cam 107 assumes the shape of an substantially-rectangular plate, and is supported by a support shaft 109—which is provided so as to transversely protrude to the outside from an outer surface of the left side surface 8 and an outer surface of the right side surface 9—such that rear lower portions of the press cams 107 are able to pivot. A rear upper angular portion of the press cam 107 is formed into a contacting section 110 which butts against the drum shaft 60. Further, a contacting shaft 112 is provided on the front upper portions of the press cams 107, wherein the contacting shaft 112 transversely, inwardly protrudes to the attachment-and-detachment path of the drum cartridge 31 (the travel path of the drum shaft 60) by way of oval apertures 111 formed in the left side plate 8 and the right side plate 9.

The urging spring 108 is formed from a coil spring. A coil section of the urging spring 108 is coiled around the support shaft 109. Single ends of the coil sections are each fastened to the left side plate 8 or the right side plate 9, and the other ends of the same are latched by the lower end portions of the respective press cams 107. As a result, the press cam 107 is urged by urging force of the urging spring 108 so as to pivot in a direction where the contacting section 110 butts the drum shaft 60 against the receiving section 102 and a direction where the contacting shaft 112 advances to the attachment-and-detachment path of the drum cartridge 31 (in a counterclockwise direction in FIG. 22).

As shown in FIG. 19, the regulation spring 105 is provided at a position on the outer surface of the left side plate 8 in the vicinity of the drum-positioning groove 103 as well as at a position on the outer surface of the right side plate 9 in the vicinity of the drum-positioning groove 103. The regulation spring 105 is formed from a coil spring. A coil section of the coil spring 105 is coiled around a stationary shaft 115 which transversely protrudes to the outside from the outer surface of the left side plate 8 and the outer surface of the right side plate 9. Single ends of the coil sections are each fastened to the left side plate 8 or the right side plate 9. The other ends of the regulation springs 105 are arranged to face the drum-positioning groove 103; can advance to and recede from the drum-positioning groove 103 by means of elastic force; and remain advanced to the drum-positioning groove 103 at all times.

As shown in FIG. 24, the contacting/separating section 106 is provided at a position on the outer surface of the left side plate 8 in the vicinity of the boss insertion groove 133 as well as at a position on the outer surface of the right side plate 9 in the vicinity of the same. The contacting/separating section 106 includes a first pressing member 116 for pressing the development boss section 71 in the attachment direction; a first urging spring 117 for urging the first pressing member 116; a second pressing member 118 for pressing the development boss section 71 in a separating direction; a second urging spring 119 for urging the second pressing member 118; and a cam 120 serving as a cam member opposing the first pressing member 116 and the second pressing member 118.

The first pressing member 116 assumes a substantially-V-shaped form, wherein one piece and another piece are continuous with each other by way of a bent portion. In a separated state which will be described later, one piece is positioned in parallel to the boss insertion groove 133, and the other piece is positioned along the longitudinal direction. A boss-contacting section 121, which butts against the development boss section 71, is formed at one end of the one piece so as to be bent from the one end forward and extend in the separated state. A lower surface of the boss-contacting section 121 is formed as an upper press face 134 which acts as a first press face for pressing the development boss section 71 from above. The upper press face 134 is formed to obliquely come into contact with the development boss section 71 and simultaneously generates, upon contact with the development boss section 71, the pressing force for pressing the development boss section 71 in the attachment direction and the pressing force for pressing the development boss section 71 toward a front edge which serves as a reference plane of the boss insertion groove 133. A cam-contacting section 122, which butts against the cam 120, is formed at the other end portion of the other piece as a protuberance which protrudes upward from the other end portion in a separated state.

The bent portion of the first pressing member 116 is rotatably supported by a support shaft 123. This support shaft 123 is provided so as to transversely protrude to the outside from rearward of the lower end portion (the deepest portion) of the boss insertion groove 133 on the outer side surface of the left side plate 8 and that of the right side plate 9. Thereby, the boss-contacting section 121 is provided so as to be able to longitudinally advance or recede with respect to the boss insertion groove 133; namely, the travel path of the development boss section 71. The cam-contacting section 122 is provided so as to be able to contact or separate from the cam 120 from below at a position opposite the boss insertion groove 133 with the support shaft 123 located therebetween.

In such an arrangement, the support shaft 123 is positioned downstream of the boss contacting section 121 of the first pressing member 116 in the attachment direction of the development boss section 71.

The first urging spring 117 is formed from a tension spring. One end of the tension spring is fastened to a first stationary shaft 124 which protrudes from a position on the outer surface of the left side plate 8 and a position on the outer surface of the right side plate 9, both positions being located lower than the lower end portion (the deepest portion) of the boss insertion groove 133. The other end of the tension spring is latched by the cam-contacting section 122. Thereby, the first pressing member 116 is urged at all times by the urging force of the first urging spring 117 in a (forward) direction where the boss-contacting section 121 advances with respect to the travel path of the development boss section 71 as well as in a (upward) direction where the cam-contacting section 122 comes close to the cam 120.

The second pressing member 118 assumes the shape of an substantially-rectangular plate. A boss-contacting lug section 125, which protrudes to a forward upward direction at an angle and butts against the development boss section 71 in a separated state, is provided in an upper front end portion of the second pressing member 118. A rotation regulation lug section 126, which protrudes to a forward downward direction at an angle and can come into contact with the first stationary shaft 124 in a separated state, is provided in lower front portion of the second pressing member 118. A cam contacting protrusion 127, which in the spaced state protrudes upwardly and comes into contact with the cam 120, is provided on an upper rear portion of the second pressing member 118. Further, a spring latch protrusion 128, which downwardly protrudes and latches the other end of the second urging spring 119 in a separated state, is provided in a lower rear end portion of the second pressing member 118.

A longitudinally intermediate position on the second pressing member 118 is rotatably supported by the support shaft 123. Thereby, the boss-contacting lug section 125 faces the boss insertion groove 133; i.e., any position on the travel path of the development boss section 71, at a position downstream of the boss-contacting section 121 of the first pressing member 116 in the attachment direction of the development boss section 71. In that travel path, the boss-contacting lug section 125 becomes movable in the attachment-and-detachment directions of the development boss section 71. The rotation regulation lug section 126 becomes able to contact or separate from the first stationary shaft 124. A cam-contacting protuberance 127 is provided at a position opposite the boss insertion groove 133 with the support shaft 123 located therebetween, so as to be able to contact or separate from the cam 120 from below.

The second urging spring 119 is formed from a tension spring. One end of the tension spring is fastened to a second stationary shaft 129 which protrudes, to the outside in the transverse direction, from a position on the outer surface of the left side plate 8 and a position on the outer surface of the right side plate 9, both positions being located lower than the first stationary shaft 124. The other end of the tension spring is latched by the spring latch protrusion section 128. Thereby, the second pressing member 118 is urged at all times by the urging force of the second urging spring 119 in a (upward) direction where the boss-contacting lug section 125 presses the development boss section 71 in the travel path thereof in a separating direction; in a (upward) direction where the rotation regulation lug section 126 comes into close proximity to the first stationary shaft 124; and in a (downward) direction where the cam-contacting protrusion 127 separates from the cam 120.

The spring constant of the second urging spring 119 is set to become smaller than the spring constant of the first urging spring 117.

Figure 28:
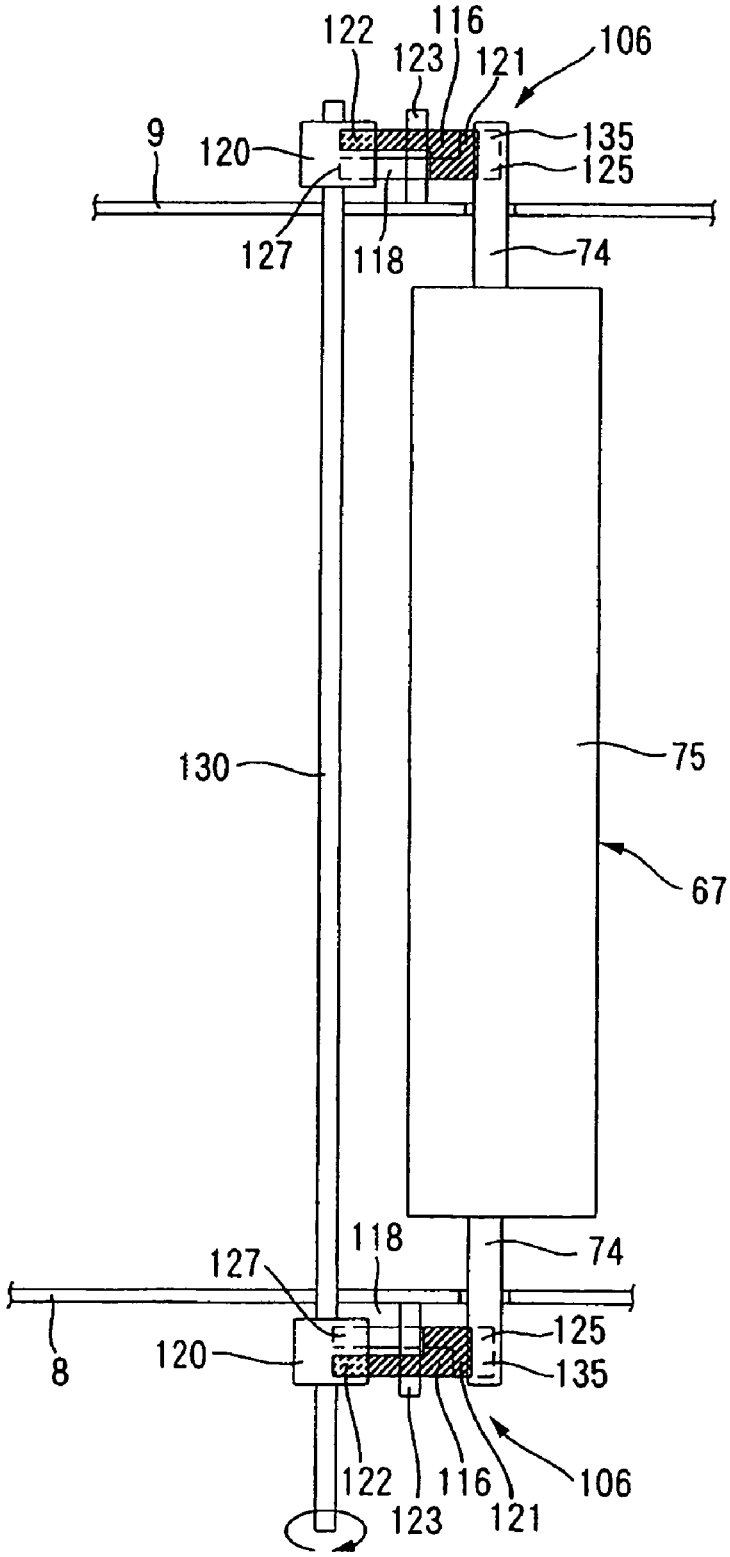
FIG. 28 is a plan view for describing a state where the development cartridge is attached to the process housing section (the separated state)
Figure 29:
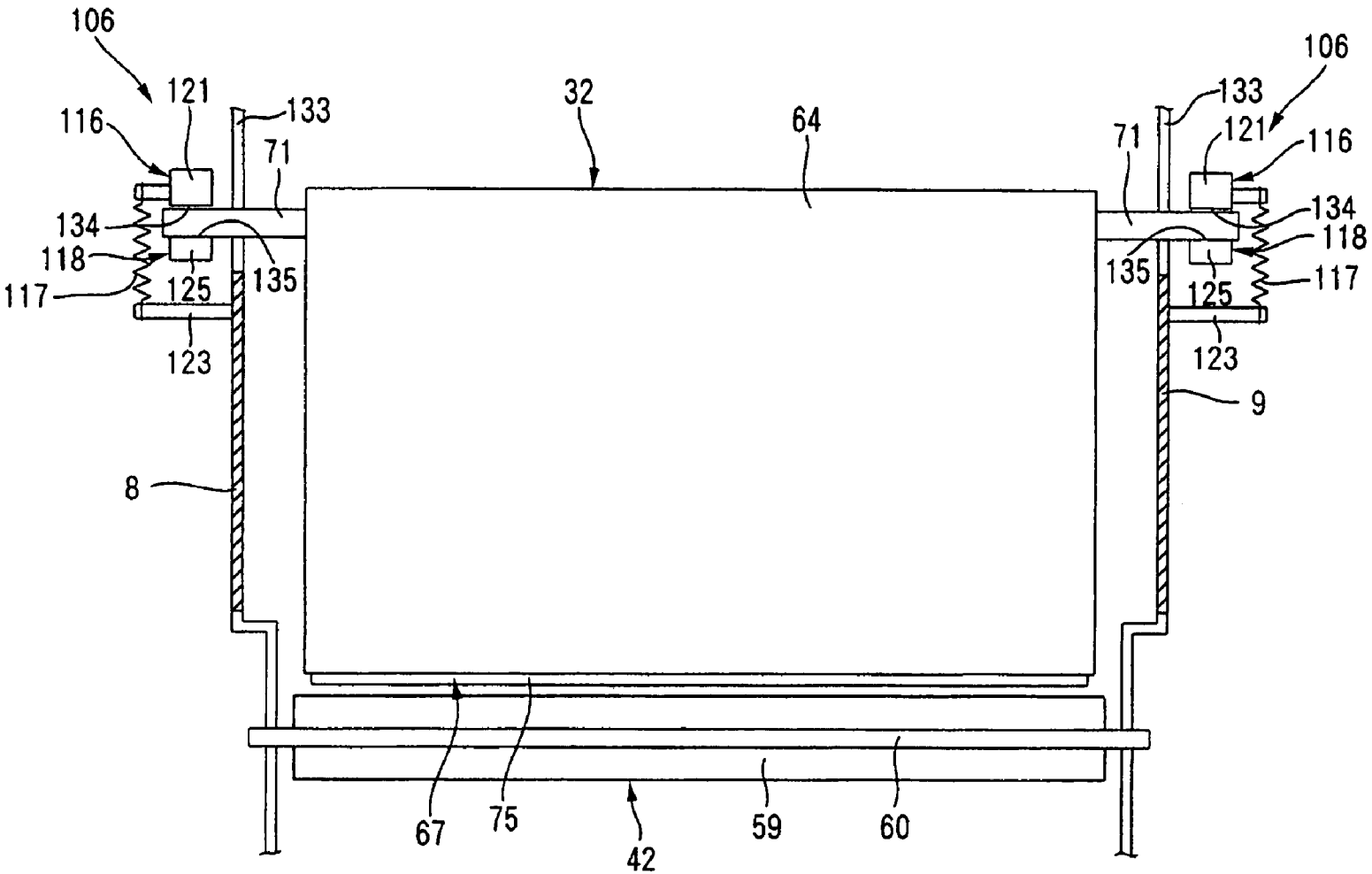
FIG. 29 is a front view for describing a state where the development cartridge is attached to the process housing section (the separated state)
Figure 30:
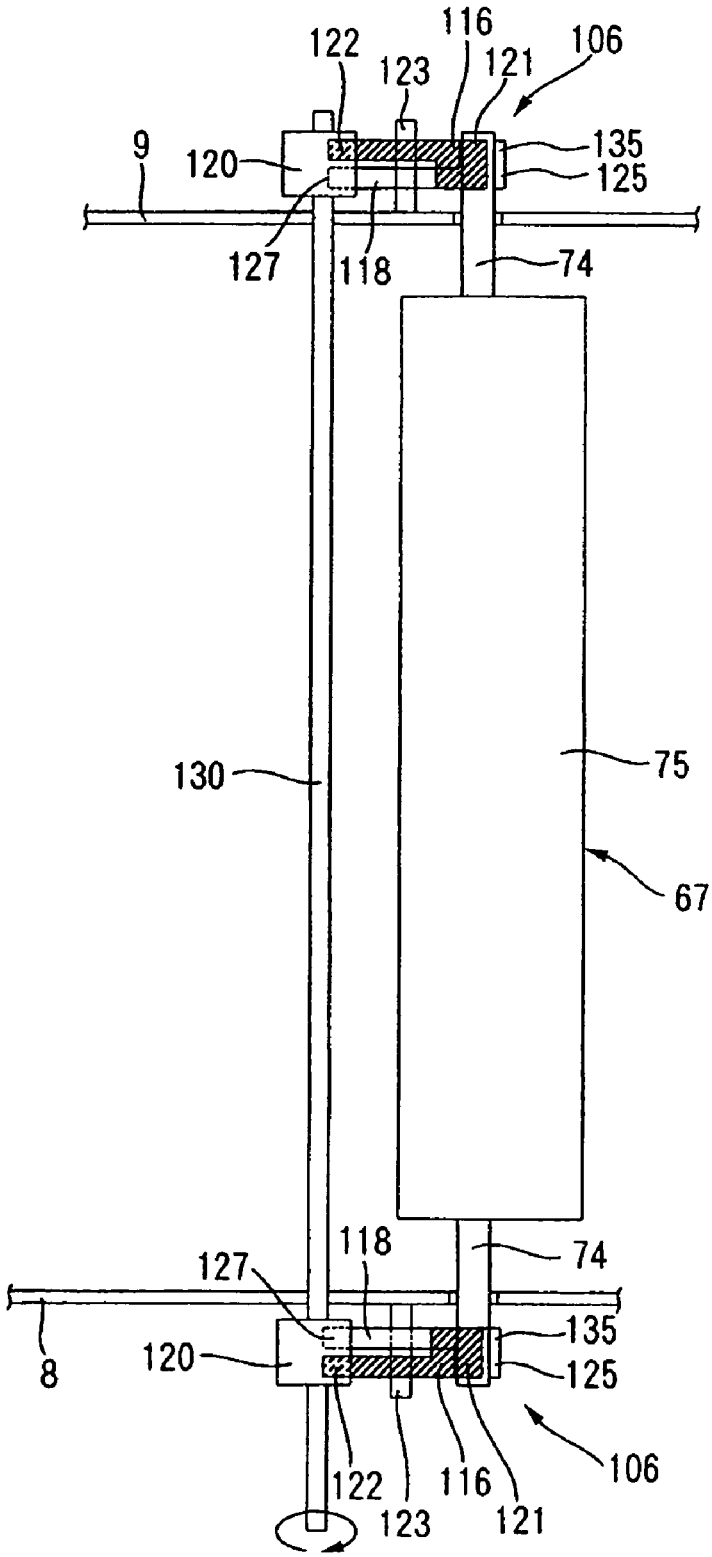
FIG. 30 is a plan view for describing a state where the development cartridge is attached to the process housing section (the contact state)
Figure 31:
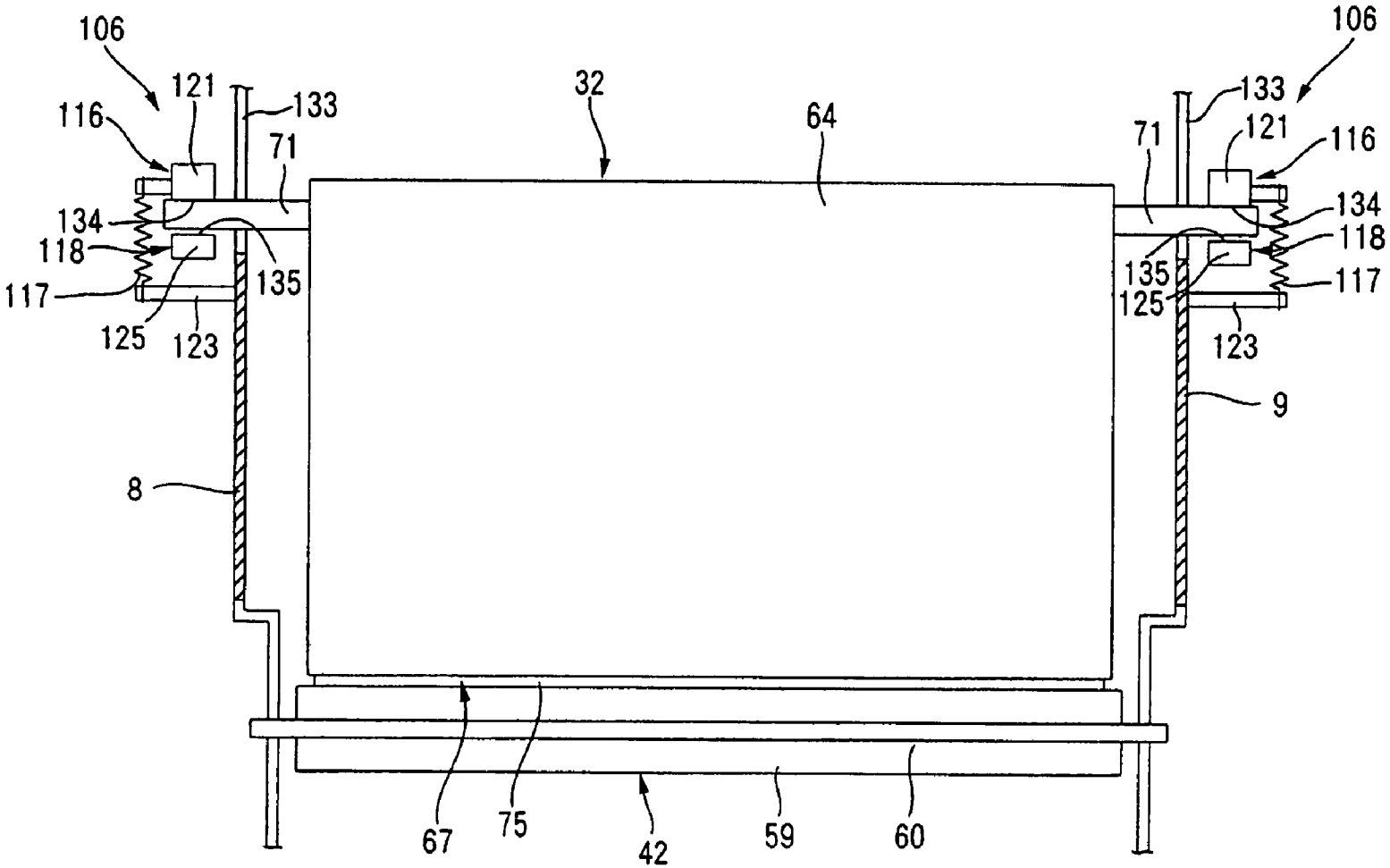
FIG. 31 is a front view for describing a state where the development cartridge is attached to the process housing section (the contact state)

As shown in FIG. 28, the first pressing member 116 and the second pressing member 118 are pivotally supported by the support shaft 123. The first pressing member 116 is disposed outside of the second pressing member 118 in the transverse direction. Moreover, the boss-contacting section 121 of the first pressing member 116 is formed so as to bulge inwardly in the transverse direction. The boss-contacting lug section 125 of the second pressing member 118 is formed so as to bulge outward in the transverse direction. Accordingly, the upper press face 133 of the boss-contacting section 121 and a lower press face 135 of the boss-contacting lug section 125 are arranged so as to overlap each other in the moving direction of the development boss section 71.

As shown in FIG. 24, the cam 120 is formed into an substantially sector shape, and is provided so as to protrude to the outside in the transverse direction from the left side plate 8 and the right side plate 9 at a position upwardly rearward of the support shaft 123. The cam 120 is joined to the cam shaft 130, which is rotatably supported and serves as a rotary shaft, in a relatively non-rotatable manner. A contacting face 131, which serves as a circular-arc-shaped second face, and a separation face 132, which is provided on the side opposite the contacting face 131 with the cam shaft 130 interposed therebetween and acts as an substantially-V-shaped first face defining a central angle, are continuously formed on an outer peripheral surface of the cam 120.

By means of rotation of the cam shaft 130, the contacting face 131 of the cam 120 and the separation face 132 of the same are selectively caused to oppose the cam-contacting section 122 of the first pressing member 116 and the cam-contacting protuberance 127 of the second pressing member 118.

The development cartridge 32 remains attached to the development housing section 14. However, during non-image forming operation, the contacting face 131 of the cam 120 comes into contact with the cam-contacting section 122 of the first pressing member 116 and the cam-contacting protrusion 127 of the second pressing member 118 such that the photosensitive drum 42 and the development roller 67 separate from each other, thereby downwardly pressing the cam-contacting section 122 and the cam contact protuberance 127.

As mentioned above, in the separated state, the first pressing member 116 has already been pivoted in a direction where the first urging spring 117 is withdrawn and the boss-contacting section 121 recedes with respect to the travel path of the development boss section 71 against the urging force of the first urging spring 117. In this separated state, the boss-contacting section 121 has already moved in the receding direction. However, the boss-contacting section 121 remains slightly advanced with respect to the travel path of the development boss section 71 within a range where attachment and detachment of the development cartridge 32 is allowed.

In the separated state, the second pressing member 118 has already been pivoted in a direction where the second urging spring 119 is compressed and the boss-contacting lug section 125 presses the development boss section 71 in a separating direction by means of a force, which is greater than the urging force of the second urging spring 119, as well as in a direction where the rotation regulation lug section 126 comes into close proximity to the first stationary shaft 124. In this separated state, the boss-contacting lug section 125 is placed, in the travel path of the development boss section 71, at a position upstream of the development boss section 71 in the attachment direction, as opposed to a position in a contact state which will be described later.

Figure 32A:
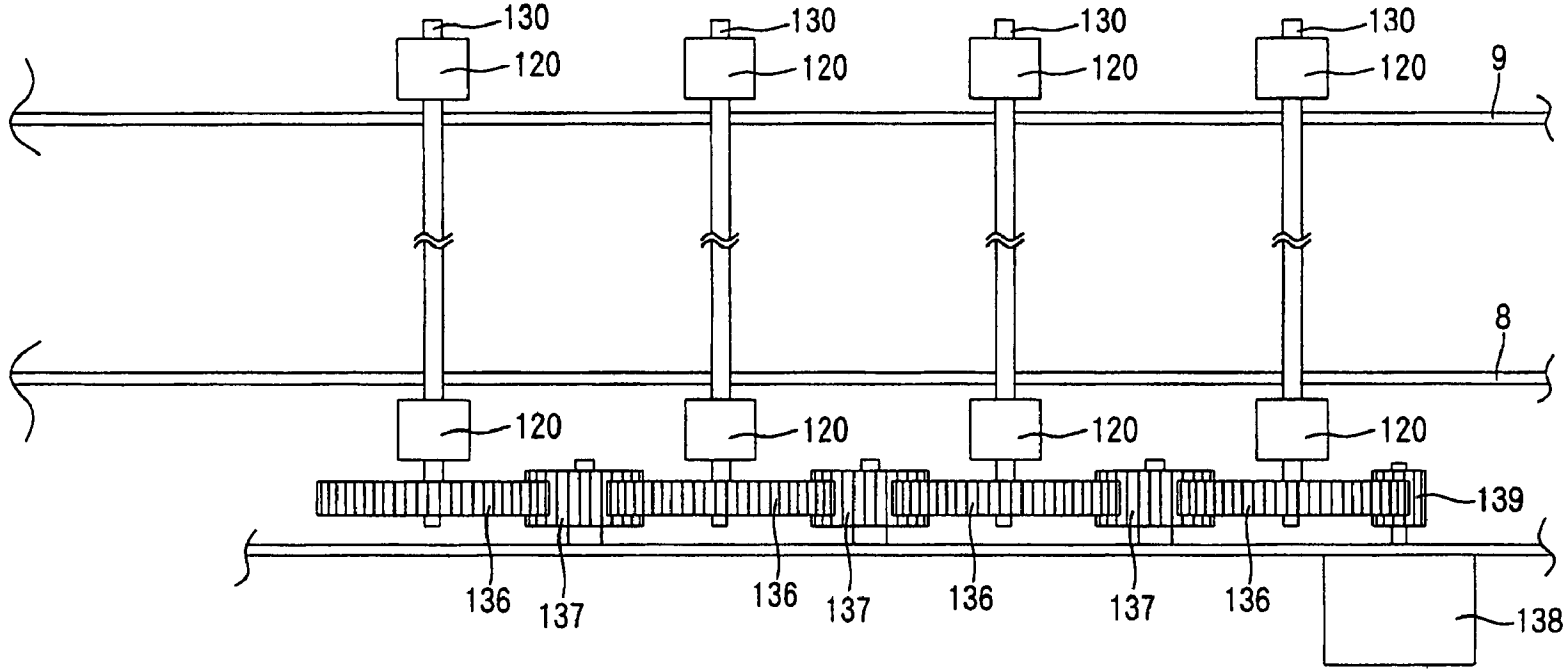
FIGS. 32A and 32B are block diagrams of a featuring section of a drive path of the cam.

As shown in FIG. 32A, in each of the process housing sections 12, a cam shaft 130 extends between the left side plate 8 and the right side plate 9 in the contacting/separating mechanism 106, and is rotatably supported by the left side plate 8 and the right side plate 9. In each of the process housing sections 12, the cams 120 are coupled, as a pair, to both end portions of the cam shaft 130. Although not illustrated, the first pressing member 116 and the second pressing member 118 are provided, as a single pair, in association with one pair of cams 120 for each of the process housing sections 12.

Figure 32B:
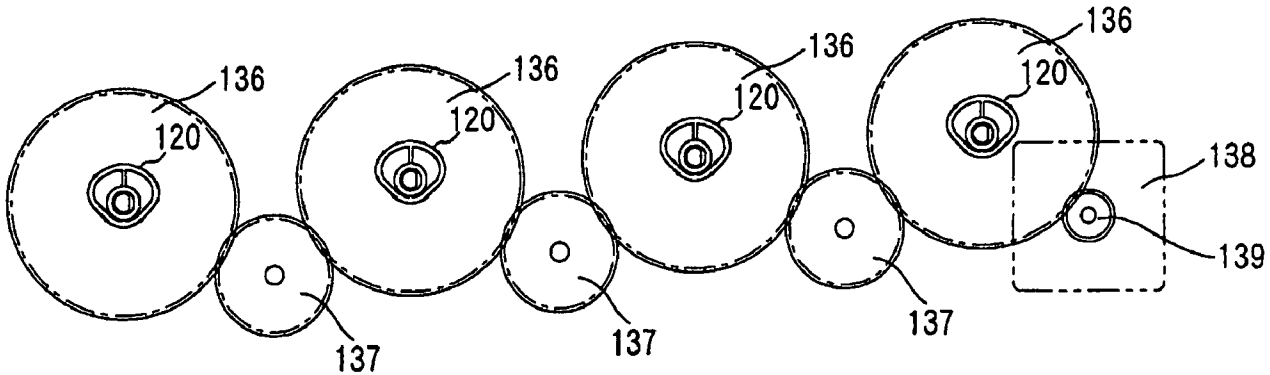

On the left side plate 8, a cam drive gear 136 is coupled, in a relatively non-rotatable manner, to an end portion of each of the cam shafts 130 protruding outside of the left side plate 8. Intermediate gears 137, which mesh with the adjacent cam drive gears 136, are provided between the cam drive gears 136. As shown in FIG. 32B, drive force is input from a motor 138, by way of a pinion gear 139, to a gear train consisting of the respective cam drive gears 136 and the respective intermediate gears 137. As a result, the drive force is input to the respective cam shafts 130 by way of the gear train, to thus rotate the respective cam shafts 130. The cams 120 of the single pair are simultaneously rotated, to thus cause the contacting face 131 and the separation face 132, both constituting the single pair of cams 120, to selectively oppose the cam-contacting sections 122 of the single pair of the first pressing members 116 and the cam-contacting protuberances 127 of the single pair of second pressing members 118.

In the color laser printer 1, the drum cartridges 31 of respective colors are attached to the corresponding drum housing sections 13 in the respective process housing sections 12. Thereby, the respective drum cartridges 31 are attached to the main body casing 2, and the development cartridges 32 of respective colors are attached to the corresponding development housing sections 14. Thus, the respective drum cartridges 31 attached to the main body casing 2 are attached to the respective development cartridges 32.

Attachment of the drum cartridges 31 and the development cartridges 32 to the main body casing 2 will now be described by reference to FIGS. 15 to 22.

First, in order to attach the drum cartridges 31 to the drum housing sections 15 of the process housing section 12, the drum grip 57 is actuated as shown in FIG. 15, thereby inserting the respective drum boss sections 56 of the drum cartridges 31 into the respective guide grooves 101, and the drum cartridges 31 are pressed downward. As a result, the respective drum boss sections 56 are first inserted into the upstream guide sections 140, and the drum cartridges 31 are guided so as to pass through the development housing sections 14. Next, the respective drum boss sections 56 are inserted into the downstream guide sections 141, so that the holder sections 43 are guided towards the expansion spaces 19. Thus, the drum cartridges 31 are attached to the drum housing sections 13. Thus, smooth attachment of the drum cartridges 31 can be ensured.

Figure 20:
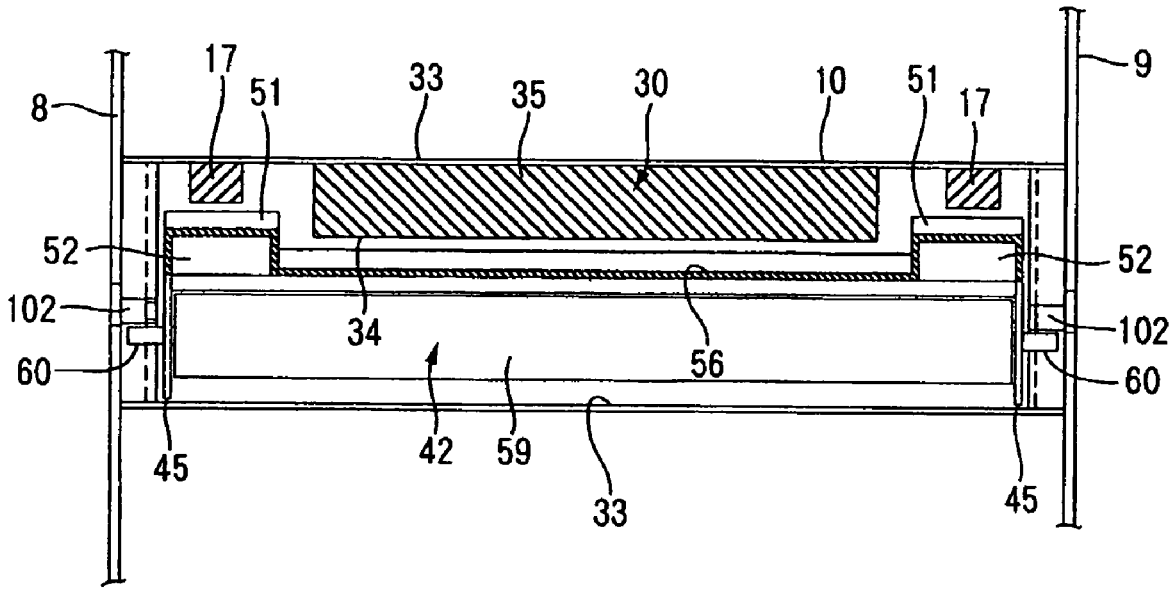
FIG. 20 is a front view for describing a state (a state where the drum cartridge is in the course of passing through the development housing section) where the drum cartridge is attached to a process housing section.

When the holder section 43 of the drum cartridge 31 passes through the development housing space 16 of the development housing section 14, as shown in FIG. 20, the respective tab sections 51 of the drum cartridge 31 are caused to oppose the respective rail sections 17 of the development housing section 14, and the respective tab sections 51 frequently come into slidable contact with the rail sections 17 during the course of attachment action. Thus, as a result of the respective tab sections 51 and the respective rail sections 17 being brought into slidable contact with each other, the respective tab sections 51 protrude toward the respective rail sections 17 from the holder upper wall 56 opposing the scanner casing 35. Since the rail sections 17 are formed into the shape of a thick strip, clearance is formed between the front wall 34 of the scanner casing 35 and the holder upper wall 56 by bringing the respective tab sections 51 into contact with the respective rail sections 17, thereby preventing occurrence of slidable contact between the front wall 34 and the holder upper wall 56.

During attachment of the drum cartridge 31, the respective tab sections 51 come into slidable contact with the respective rail sections 17, thereby preventing the holder upper wall 56 from coming into slidable contact with the front wall 34 of the scanner casing 35. Thus, infliction of damage to the drum cartridge 31, which would otherwise be caused during attachment of the drum cartridge 31, can be prevented. Most of all, the respective tab sections 51 are brought into slidable contact with the respective rail sections 17 which are set opposite each other in the transverse direction with the scanner casing 35 being sandwiched therebetween, and hence the holder section 43 can be reliably prevented from coming into slidable contact with the scanner casing 35.

The scorotoron electrification device 62 is positioned at a position in the holder section 43 of the drum cartridge 31 rearward of the tab sections 51 in FIG. 2. Specifically, during attachment of the drum cartridge 31, the scorotoron electrification device 62 is positioned in the holder section 43 at a position downstream of the tab sections 51 in the attachment direction of the drum cartridge 31. As a result, during attachment of the drum cartridge 31, the tab sections 51 are located ahead of the scorotoron electrification device 62 at all times, and hence infliction of damage to the scorotoron electrification device 62 can be prevented without fail.

Figure 16:
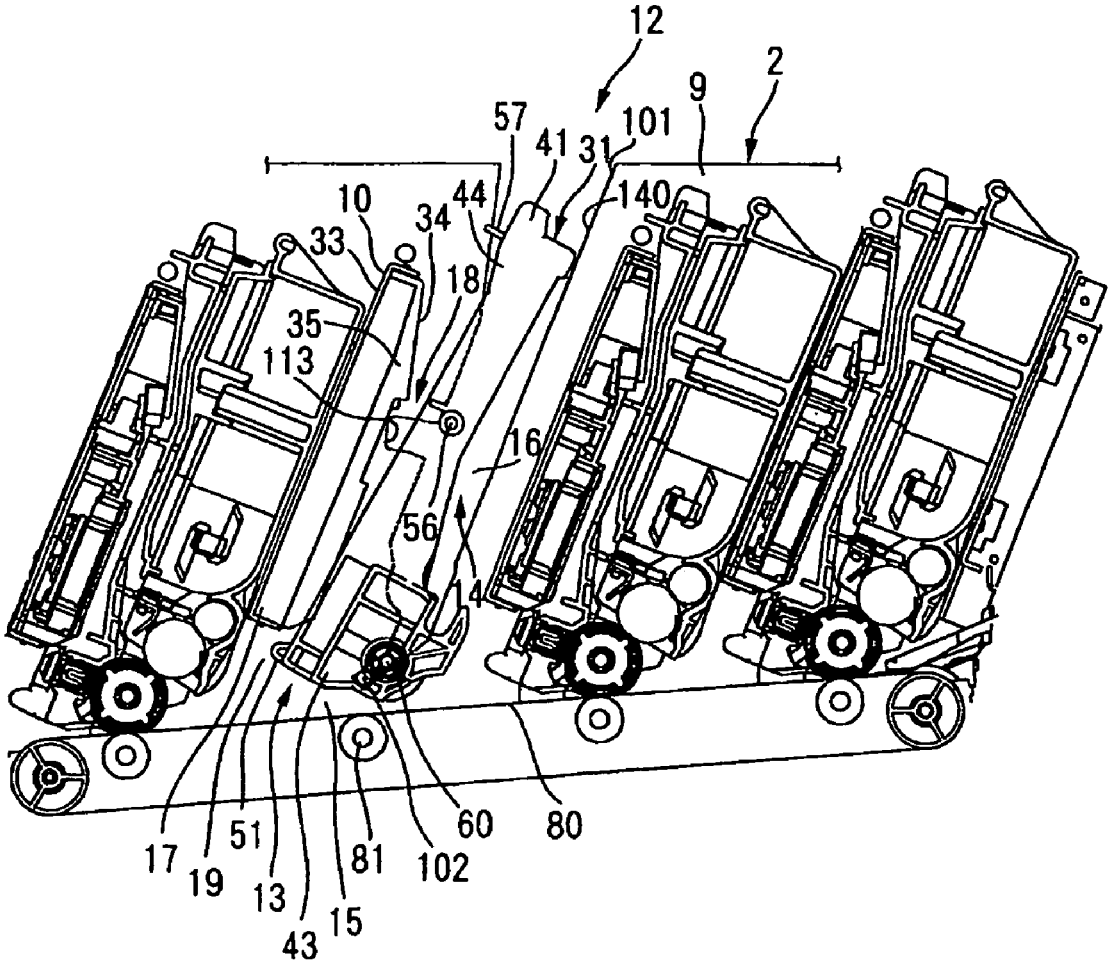
FIG. 16 is a side view for describing a state (where the drum cartridge has arrived at the drum housing section) where the drum cartridge is attached to the process housing section.
Figure 17:
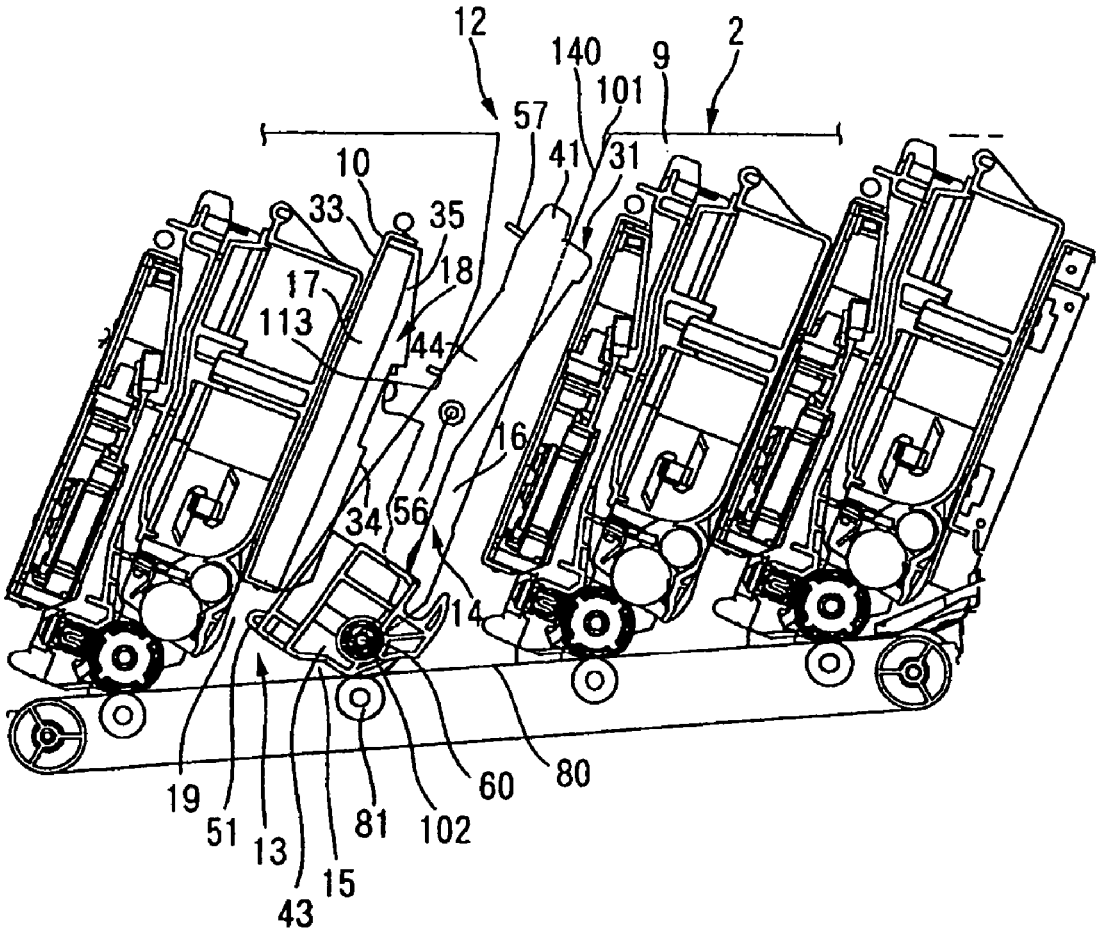
FIG. 17 is a side view for describing a state (a state where the drum cartridge is in the course of pivotal movement) where the drum cartridge is attached to the process housing section.

When the holder section 43 of the drum cartridge 31 has reached the drum housing section 13, the drum shaft 60 guided into the downstream guide section 141 is moved in an oblique rearward direction, as shown in FIG. 16, because the downstream guide section 141 is bent in an oblique rearward direction with respect to the upstream guide section 140. When the drum shaft 60 has butted against the receiving section 102, the drum enclosure 41 is positioned at an inclination, as shown in FIG. 17, such that the holder section 43 is directed rearward and such that the extension section 44 is directed forward. In this state, the development housing space 16 of the development housing section 14 is closed by the extension section 44.

Figure 18:
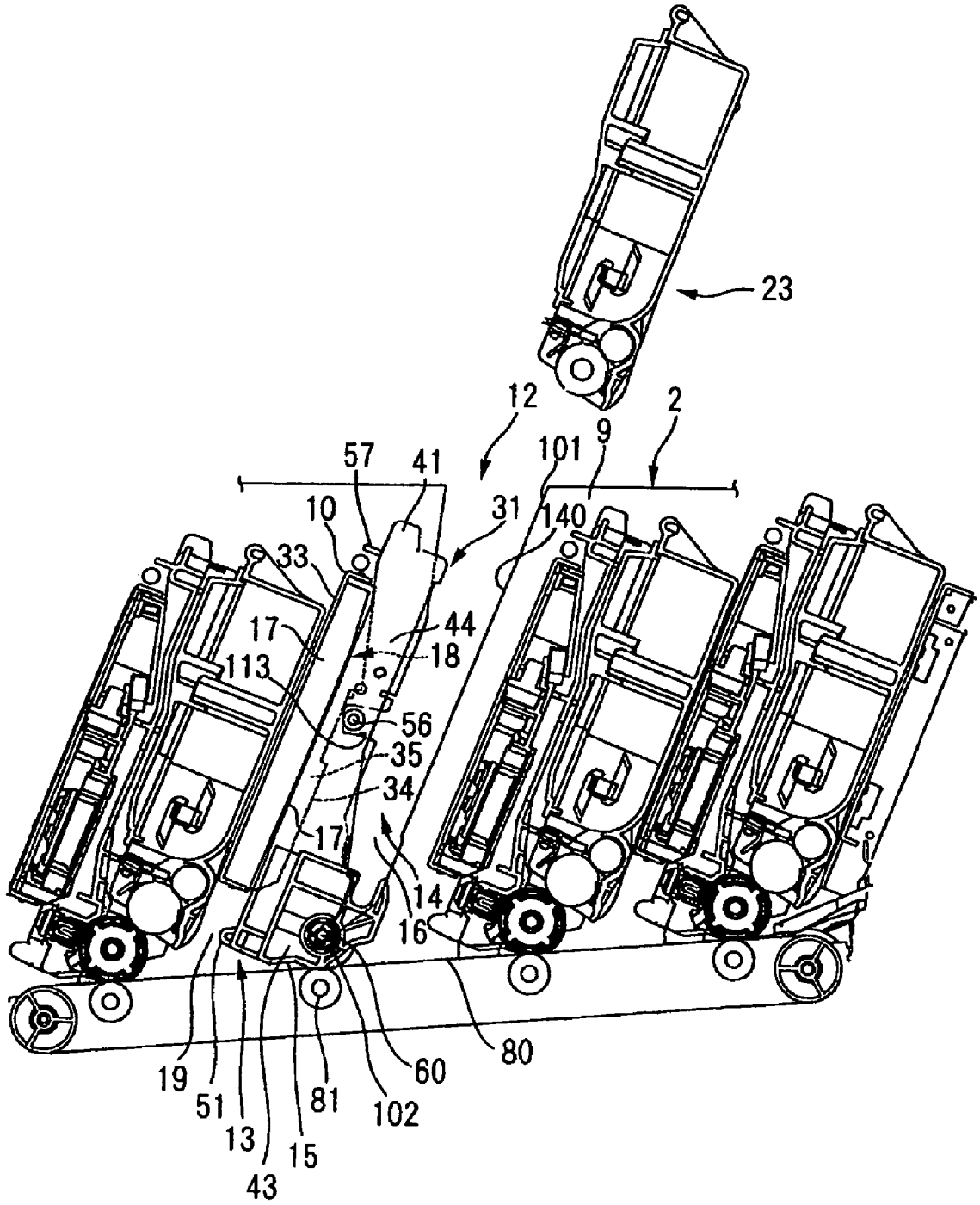
FIG. 18 is a side view for describing a state (a state where attachment of the drum cartridge has been completed) where the drum cartridge is attached to the process housing section.

Therefore, after the drum shaft 60 has butted against the receiving section 102, the drum grip 57 is actuated to pivot the extension section 44 from front to back by taking the drum shaft 60 as a pivot while the drum section 60 is being supported by the receiving section 102. As shown in FIG. 18, the extension section 44 can be caused to recede from the development housing space 16 to the extension housing space 18. As a result, the development housing space 16 can be opened so that the development cartridge 32 can be housed in the development housing space 16.

Figure 19A:
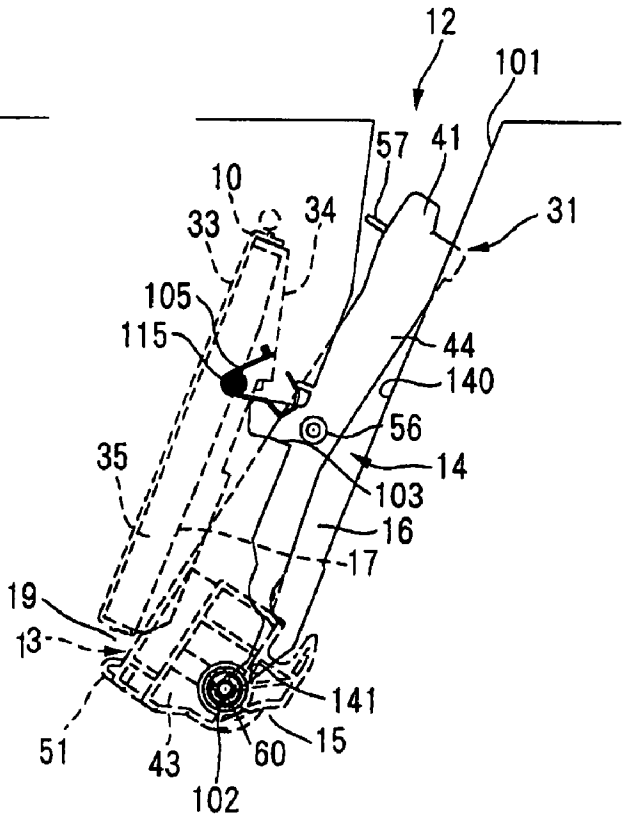
Figure 19B:
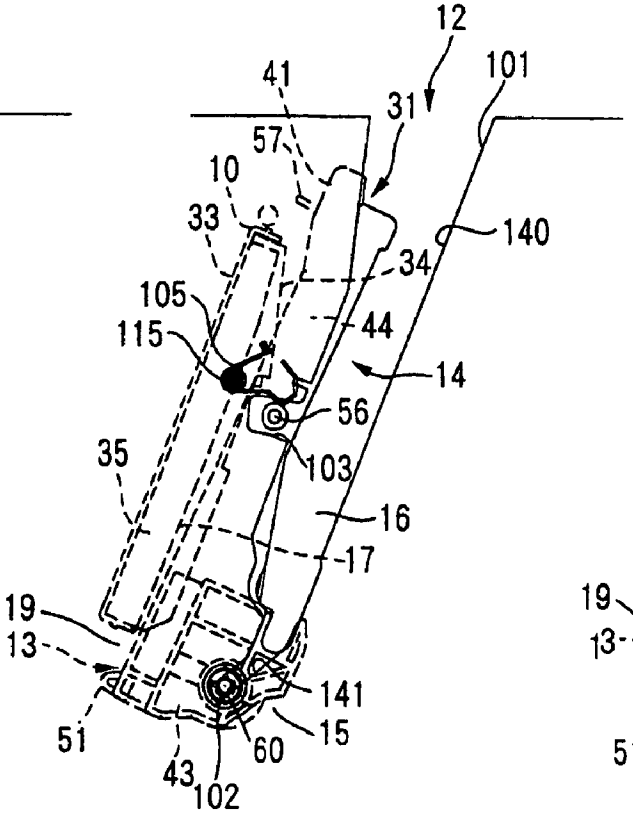
Figure 19C:
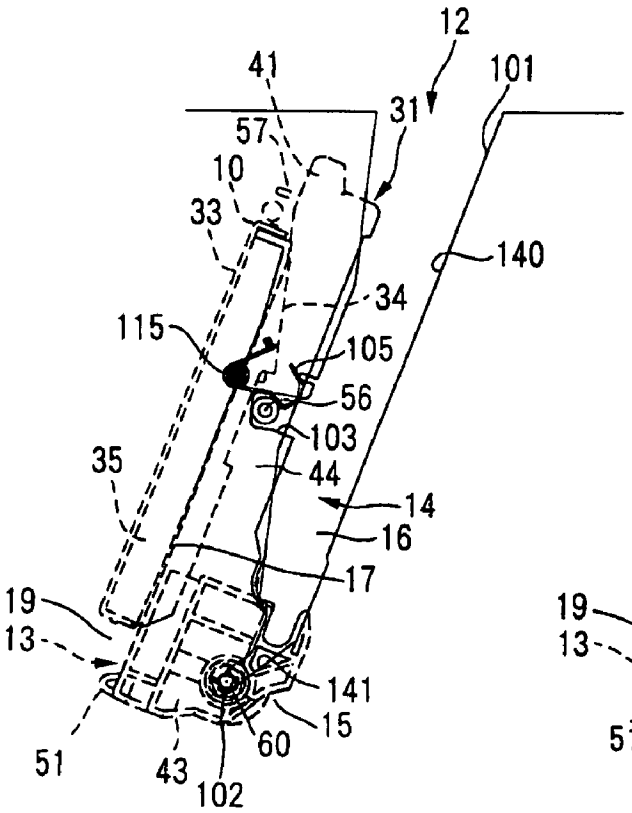
FIG. 19C shows a state where latching of the spring has been completed.

As shown in FIG. 19A, when the extension section 44 has receded from the development housing space 16 to the extension section housing space 18, the respective drum boss sections 56 oppose the respective drum-positioning grooves 103. As shown in FIG. 19B, the respective drum boss sections 56 are received by the respective drum-positioning grooves 103. The respective drum boss sections 56 having been received by the respective drum-positioning grooves 103 are further housed in the deepest portions of the respective drum-positioning grooves 103 while remaining in slidable contact with the other end portions of the respective regulation springs 105, as shown in FIG. 19C.

Meanwhile, the other end portions of the respective regulation springs 105 are pressed by the respective drum boss sections 56, and hence temporarily recede from the respective drum-positioning grooves 103 by means of the elastic force of the springs. After passage of the respective drum boss sections 56, the other end portions of the regulation springs 56 again advance to the respective drum-positioning grooves 103 by means of the elastic force of the springs.

Therefore, the respective drum boss sections 56 received in the deepest portions of the respective drum-positioning grooves 103 are restricted in separation from the respective drum-positioning grooves 103 by means of the other end portions of the respective regulation springs 105 that again advance toward the respective drum-positioning grooves 103. Thus, the extension sections 44 can be restricted in pivotal movement from back to front. The extension sections 44 having temporarily receded from the development housing spaces 16 to the extension section housing spaces 18 can be prevented from inadvertently advancing from the extension section housing spaces 18 to the development housing spaces 16 and are reliably positioned.

During detachment of the drum cartridge 31, the extension section 44 is pivoted from back to front by actuation of the drum grip 57. As a result, the other end portions of the regulation springs 105 are pressed by the respective drum boss sections 56, and temporarily recede from the respective drum-positioning grooves 103 by means of the elastic force of the regulation spring 105. After passage of each of the drum boss sections 56, the other end portions of the regulation springs 105 again advance to the drum-positioning grooves 103 by means of the elastic force. Thereby, the respective drum boss sections 56 can be separated from the respective drum-positioning grooves 103.

Figure 22A:
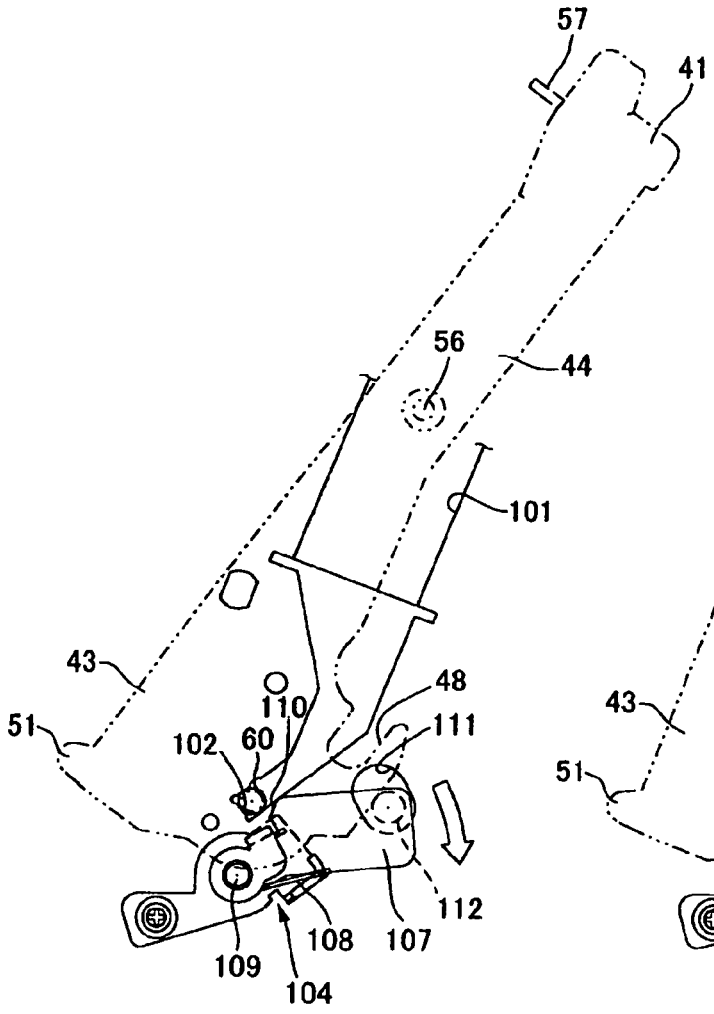
FIGS. 22A and 22B are side views for describing a state where a press cam is latched by a drum shaft while the drum cartridge is attached to the process housing section (a mode where the press cam is latched in synchronism with attachment or detachment of the drum cartridge), wherein FIG.

Moreover, the drum enclosure 41 is arranged at an inclination with the drum shaft 60 butted against the receiving section 102; the holder section 43 heading rearward; and the extension section 44 heading forward. In this state, as shown in FIG. 22A, in the drum shaft lock mechanism 104, the lower end portions of the holder side walls 45 press the respective contacting shafts 112, thereby pivoting the press cams 107 in a direction (the clockwise direction in FIG. 22) where the contacting shafts 112 recede from the attachment-and-detachment paths of the drum cartridges 31 in defiance of the urging forces of the urging springs 108.

Figure 22B:
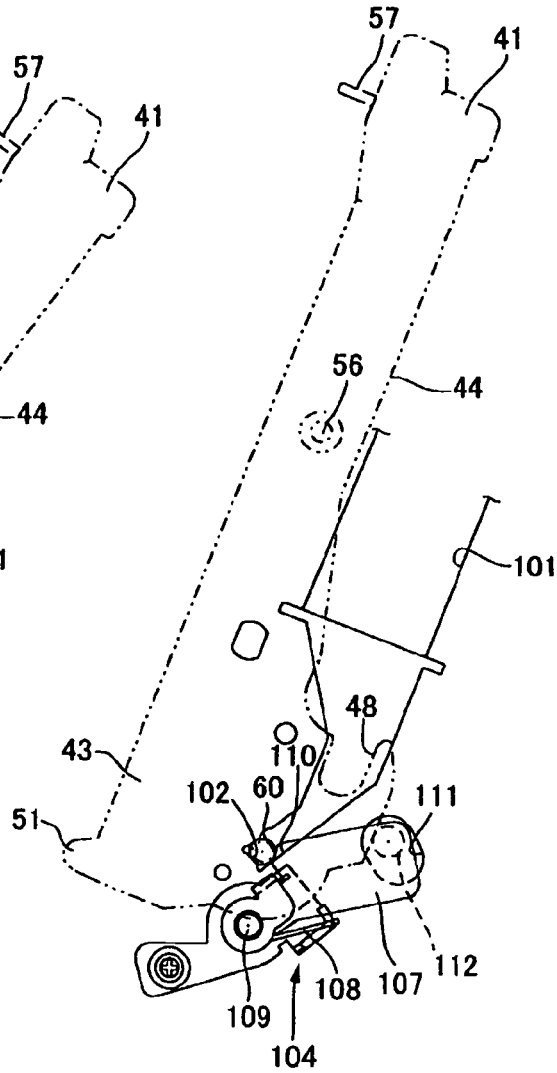

As mentioned above, when the extension section 44 is pivoted from front to back, as shown in FIG. 22B, the press cams 107 pivot in a direction (the counterclockwise direction in FIG. 22) where the contacting shafts 112 advance toward the attachment-and-detachment paths of the drum cartridges 31 by means of the urging force of the urging springs 108. As a result, the contacting section 110 advances toward the guide groove 101 so as to close the same, and presses the drum shaft 60 toward the receiving section 102, to thus restrict movement of the drum shaft 60 received by the receiving section 102.

During detachment of the drum cartridge 31, the extension section 44 is pivoted from back to front by actuation of the drum grip 57. Then, the lower end portions of the holder side walls 45 press the contacting shafts 112, thereby pivoting the press cams 107 in a direction (the clockwise direction in FIG. 22) where the contacting shafts 112 recedes from the attachment-and-detachment path of the drum cartridge 31 against the urging forces of the urging springs 108. As a result, the contacting section 110 recedes from the guide groove 101 so as to open the same, and is separated from the drum shaft 60. Thus, movement of the drum shaft 60 received by the receiving section 102 is released from a restricted state.

As mentioned above, the drum cartridge 31 is attached to the main body casing 2 as a result of the holder section 42 having been housed in the drum housing space 15 including the extension space 19 of the drum housing section 13, and the extension section 44 having been housed in the extension section housing space 18 of the development housing section 14.

In the color laser printer 1, the front wall 34 of the scanner casing 35 is positioned in each of the process housing sections 12 so as to expand toward the front from the partition plate 10; i.e., the development housing space 16. In the development housing section 14, passage of the drum cartridge 31 through the development housing section 14 is restricted while the development cartridge 32 is attached to the drum cartridge 31. However, when the development cartridge 32 is separated from the drum cartridge 31, passage of the drum cartridge 31 through the development housing space 16 in the development housing section 14 is allowed.

Therefore, even if a space measuring the sum of the attachment-and-detachment path of the drum cartridge 31 and that of the development cartridge 32 is not assured, as a result of the front wall 34 of the scanner casing 35 expanding toward the development housing space 16, the drum cartridge 31 is caused to pass through the development housing space 16 without interfering with the front wall 34 of the scanner casing 35 while the drum cartridge 31 is separated from the development cartridge 32, and can be attached to the drum housing section 13 and housed in the drum housing space 15. As will be described later, so long as the development cartridge 32 is housed in the development housing region 16 while being attached to the development housing section 14, the drum cartridge 31 and the development cartridge 32 can be attached.

Specifically, in the color laser printer 1, the drum cartridge 31 separated from the development cartridge 32 is caused to pass while avoiding the front wall 34 of the scanner casing 35 by utilization of the development housing space 16 of the development housing section 14 where the development cartridge 32 is to be housed, and accordingly can be attached to the drum housing section 13. Therefore, there can be realized an attempt to save spaces for the attachment-and-detachment paths for the drum cartridge 31 and the development cartridge 32, and an attempt can be made to miniaturize the apparatus.

As described above, even when the development housing section 14 is formed so as to become thinner than the drum cartridge 31 and the development cartridge 32, both of which are housed in the process housing section 12, only the drum cartridge 31 is first caused to pass through the development housing section 14. After attachment of the drum cartridge 31 into the drum housing section 13, the development cartridge 32, which is thinner than the holder section 43 of the drum cartridge 31, is next attached to the development housing section 14. Thus, the drum cartridge 31 and the development cartridge 32 can be attached. Therefore, there can be realized an attempt to save spaces for the attachment-and-detachment paths for the drum cartridge 31 and the development cartridge 32, and an attempt to miniaturize the apparatus can also be realized.

In a state where the drum cartridge 31 and the development cartridge 32 remain attached to the drum housing section 13 and the development housing section 14, respectively, in the process housing section 12, the holder section 43 is positioned in the extension space 19 of the drum housing section 13. However, as mentioned previously, in a state where the holder section 43 remains positioned in the extension space 19 of the drum housing section 13, movement of the drum cartridge 31 in the attachment-and-detachment direction is restricted. When the holder section 43 is displaced from the extension space 19 in the thicknesswise direction over a distance corresponding to the thickness of the development carriage 32, movement of the drum cartridge 31 in the attachment-and-detachment direction is allowed. Accordingly, so long as the holder section 43 is positioned in the extension space 19 after the drum cartridge 31 has been caused to pass through the development housing section 14, the drum cartridge 31 can be attached to the drum housing section 13, and the development cartridge 32 can be attached to the development housing section 14. Therefore, when the development cartridge 32 is subsequently attached to the development housing section 14, attachment of the drum cartridge 31 and the development cartridge 32 can be performed. Therefore, there can be realized an attempt to save spaces for the attachment-and-detachment paths for the drum cartridge 31 and the development cartridge 32, and an attempt to miniaturize the apparatus can also be realized.

As a result, the drum cartridge 31 is housed in the drum housing space 15 of the drum housing section 13, and the development cartridge 32 can be housed in the development housing space 16 of the development housing section 14. Hence, reliable housing of the drum cartridge 31 and the development cartridge 32 can be achieved.

In the color laser printer 1, during attachment of the drum cartridge 31, the drum shaft 60 is taken as a pivot while being supported by the receiving section 102, and the extension section 44 is caused to pivot from front to back, to thus cause the extension section 44 to recede from the development housing space 16 to the extension section housing space 18. As a result, the development housing space 16 is opened so as to be able to house the development cartridge 32. Therefore, the drum cartridge 31 can be attached to the drum housing section 13 by a simple operation so as to be able to house the development cartridge 32 in the development housing space 16 of the development housing section 14.

Moreover, the drum shaft 60 doubles as the pivot, and hence there can be realized an attempt to enhance the positioning accuracy of the photosensitive drum 42 during attachment of the drum cartridge 31, and the number of components can be diminished.

While the drum cartridge 31 is attached to the drum housing section 13, detachment of the drum boss sections 56 from the drum-positioning groove 113 is prevented by the regulation spring 105, thereby restricting pivotal movement of the extension section 44 from back to front. Accordingly, attachment of the drum cartridge 31 is reliably retained, and a hindrance to attachment of the development carriage 32 can be prevented.

During attachment (pivotal movement) of the drum cartridge 31, the drum shaft lock mechanism 104 recedes from the attachment-and-detachment path of the drum cartridge 31, and the contacting section 110 of the press cam 107, which opens the guide groove 101, presses the drum shaft 60 toward the receiving section 102 by means of the urging force of the urging spring 108 when the drum shaft 60 is received by the receiving section 102, thereby restricting movement of the drum shaft 60 received in the receiving section 102. Therefore, the drum cartridge 31 can be smoothly attached to the drum housing section 13 without undergoing great resistance from the contacting section 110. Consequently, the rigidity of the drum cartridge 31 does not need to be made much greater, and hence an attempt to miniaturize the drum cartridge 31 can be realized. After attachment of the drum cartridge 31, the contacting section 110 presses the drum shaft 60 toward the receiving section 102, and hence reliable attachment of the drum cartridge 31 and reliable positioning of the photosensitive drum 42 can be achieved.

As a result of the lower end portion of the holder side wall 45 pressing the contacting shaft 112, the drum shaft lock mechanism 104 pivots the press cam 107 against the urging force of the urging spring 108. Shortly, the contacting section 110 of the press cam 107 advances to or recedes from the travel path of the guide groove 101; i.e., the drum shaft 60, in synchronism with attachment or detachment of the drum cartridge 31 to or from the drum housings section 13. Therefore, reliable attachment or detachment of the drum cartridge 31 can be ensured.

The drum shaft lock mechanism 104 restricts movement of the drum shaft 60 received by the receiving section 102. Therefore, an attempt to enhance positioning accuracy of the photosensitive drum 42 can be realized, and the number of components can be diminished.

Figure 21:
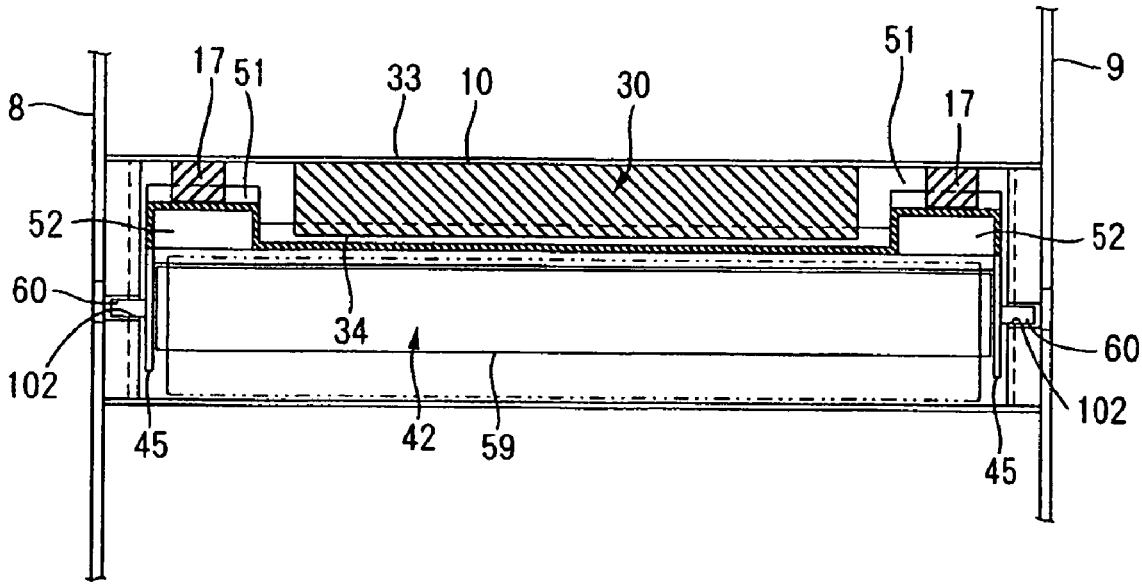
FIG. 21 is a front cross-sectional view for describing a state (a state where attachment of the drum cartridge has been completed) where the drum cartridge is attached to the process housing section.

As shown in FIG. 21, in a state where the holder section 43 is housed in the drum housing space 15 of the drum housing section 13, the respective tab sections 51 are positioned below the scanner casing 35 after having gone over the respective rail sections 17. As shown in FIG. 18, the upper portion of the scorotoron electrification device 62 is also positioned below the scanner casing 35. In addition, the photosensitive drum 42 comes into contact with the transport belt 80 to be described later.

As shown in FIG. 21, in a state where the extension section 44 is housed in the extension section housing space 18 of the development housing section 14, the respective extension side sections 52 come into contact with the respective rail sections 17 with the scanner casing 35 being sandwiched in the transverse direction therebetween. As a result, the extension section 44 can be prevented from interfering with the scanner casing 35. Further, the reinforcement rib 55 is formed on each of the extension side sections 52, and the strength of each of the extension side sections 52 is enhanced. Therefore, deformation of the extension side section 52, which would otherwise be caused upon contact with the respective rail section 17, can be prevented. As shown in FIG. 18, the extension rear wall 53 is positioned above the scanner casing 35. Since the extension rear wall 53 is provided with the drum grip 57, holding of the drum grip 57 is facilitated, and an attempt to enhance operability can be realized. Although not illustrated, the intermediate plate 54 is positioned opposite the front wall 34 of the scanner casing 35 while the opening section 58 of the intermediate plate 54 opposes the exit window 40 of the scanner casing 35.

As mentioned above, the drum cartridge 31 has, as the drum enclosure 41, the holder section 43 and the extension section 44 and can be increased in size. However, the extension section 44 can be housed in the extension section housing space 18 during attachment of the drum cartridge 31, and hence an attempt to miniaturize the apparatus can be realized.

In the drum enclosure 41, the holder section 43 and the extension section 44 are integrally formed from a resin material, and the scorotoron electrification device 62 and the photosensitive drum 42 are positioned. Further, as will be described later, the drum enclosure 41 is formed to be able to position the development cartridge 32 while taking the roller shaft 74 as a reference, by receiving the roller shaft 74 of the development roller 67 through use of the development positioning groove 48. As a result, the drum enclosure 41 positions all of the scorotoron electrification device 62, the photosensitive drum 42, and the development cartridge 32. Hence, an attempt can be made to enhance relative positioning accuracy by means of a simple configuration. Moreover, since the development cartridge 32 is positioned while the roller shaft 74 of the development roller 67 is taken as a reference, there can be realized an attempt to enhance accuracy of positioning of the development roller 67 to the photosensitive drum 42. Further, since the scorotoron electrification device 62 is provided in the holder section 43, an attempt to miniaturize the apparatus can be realized while the scorotoron electrification device 62 is located in an appropriate position.

Figure 25:
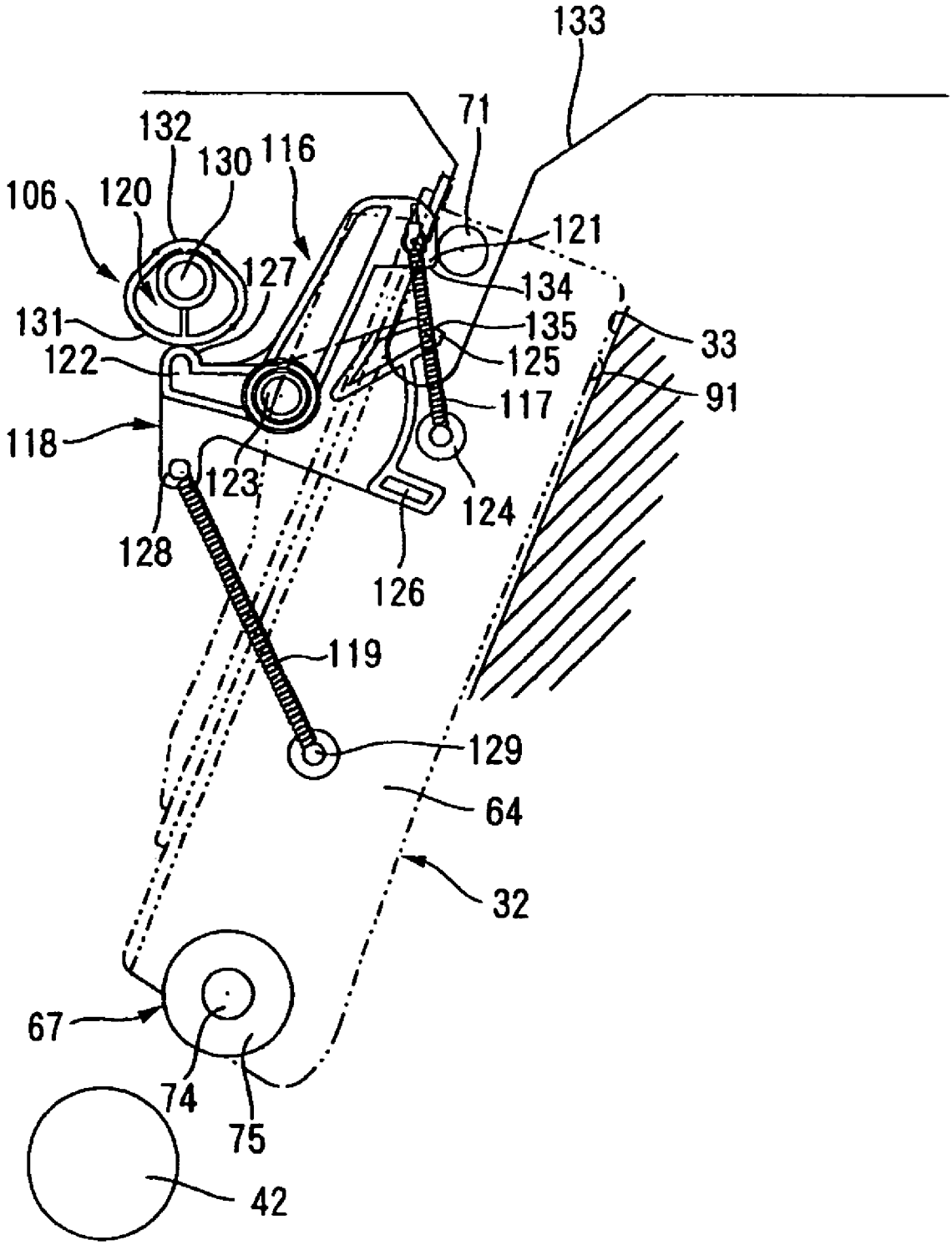
FIG. 25 is a side view for describing a state where the development cartridge is attached to the process housing section (a state achieved when the development boss section has butted against the boss insertion groove)
Figure 26:
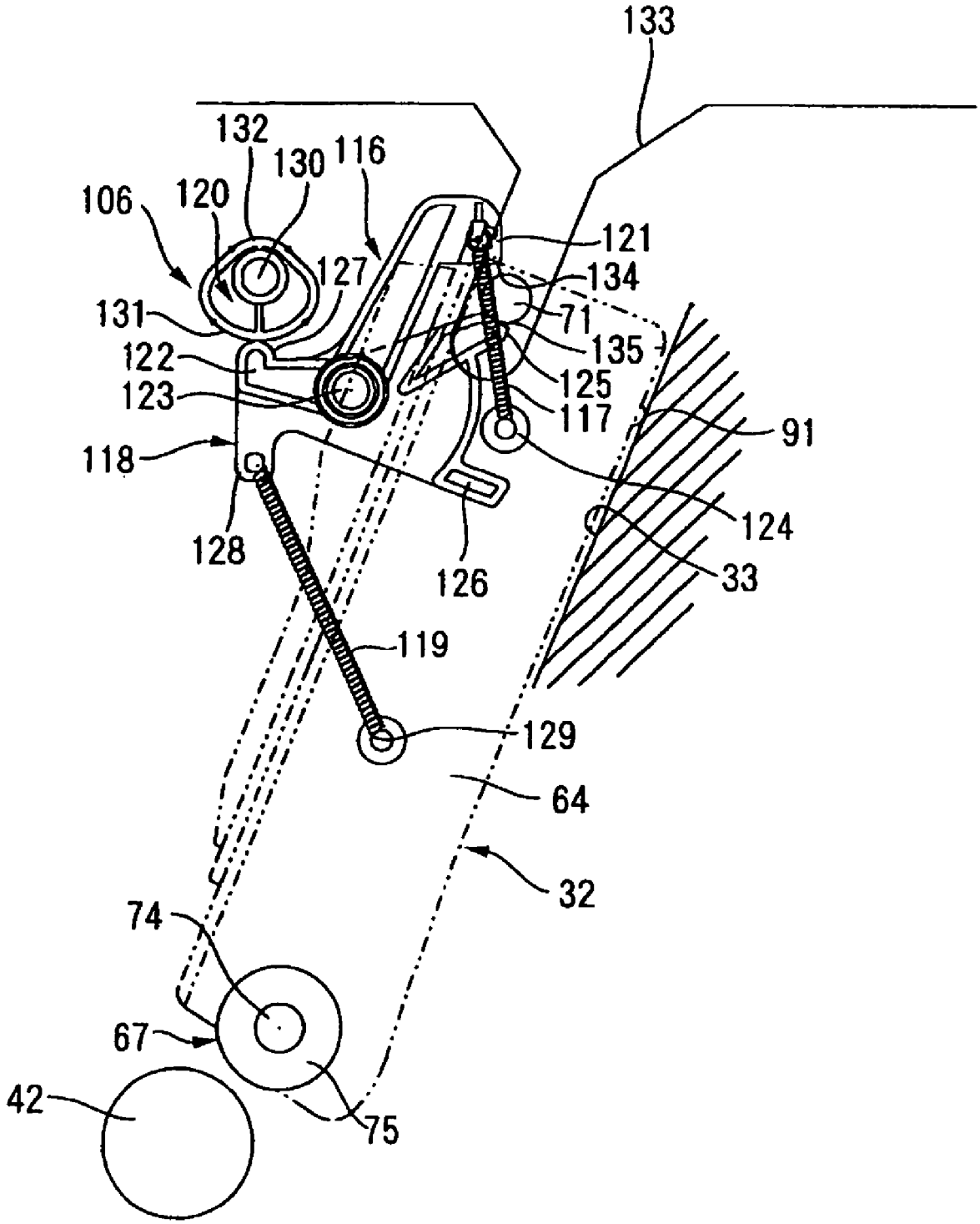
FIG. 26 is a side view for describing a state where the development cartridge is attached to the process housing section (a separated state)

In order to attach the development cartridge 32, in the development housing section 14, to the drum cartridge 31 attached to the main body casing 2, as shown in FIG. 24, the respective development boss sections 71 of the development cartridge 32 are caused to oppose the respective boss insert grooves 133. As shown in FIG. 25, the development cartridge 32 is pressed downward. In turn, the respective development boss sections 71 are inserted into the respective boss insertion grooves 133, to thus contact the boss-contacting sections 121 of the respective first pressing members 116 that remain slightly advanced to the travel paths of the respective development boss sections 71. As shown in FIG. 26, after having gone over the boss-contacting sections 121, the development boss sections 71 contact the respective boss-contacting lug sections 125 facing the travel paths of the respective development boss sections 71. Although the respective boss-contacting lug sections 125 are pressed by the respective development boss sections 71 in the attachment direction, the cam-contacting sections 122 remain in contact with the contacting faces 131 of the cams 120, and hence pivotal movement of the first pressing members 116 is restricted. Therefore, the respective development boss sections 71 are restricted in further movement in the attachment direction, and come to a standstill at the positions where the development boss sections 71 butt against the respective boss-contacting lug sections 125. Consequently, the development cartridge 32 is retained by the drum cartridge 31 while slight clearance exists between the photosensitive drum 42 and the development roller 67. As a result, the development cartridge 32 is housed in the development housing space 16 of the development housing section 14, and is attached to the drum cartridge 31 attached to the main body casing 2.

In the color laser printer 1, during a time other than during image forming operation, the development cartridge 32 operates to remain spaced from the drum cartridge 31 such that the photosensitive drum 42 and the development roller 67 are separated from each other. During the image forming operation, the development cartridge 32 operates such that the photosensitive drum 42 comes into contact with the development roller 67.

Specifically, in order to switch the separated state to the contact state in the color laser printer 1, the cam 120 is first rotated in the separated state where the contacting face 131 of the cam 120 remains in contact with the cam-contacting section 122 of the first pressing member 116 and the cam contact protuberance 127 of the second pressing member 118. Thereby, the separation face 132 of the cam 120 is caused to oppose the cam-contacting section 122 of the first pressing member 116 and the cam-contacting protuberance 127 of the second pressing member 118.

As shown in FIG. 32, in order to rotate the respective cams 120, drive force is input from the motor 138 to the respective cam shafts 130 by way of the gear train consisting of the pinion gear 139, the respective cam drive gears 136, and the respective intermediate gears 137, to thus rotate the respective cam shafts 130. Thereby, the pair of cams 120 is simultaneously rotated, and the separation faces 132 of the pair of cams 120 oppose the cam contacting sections 122 of the single pair of first pressing members 116 and the cam-contacting protuberances 127 of the single pair of second pressing members 118.

Figure 27:
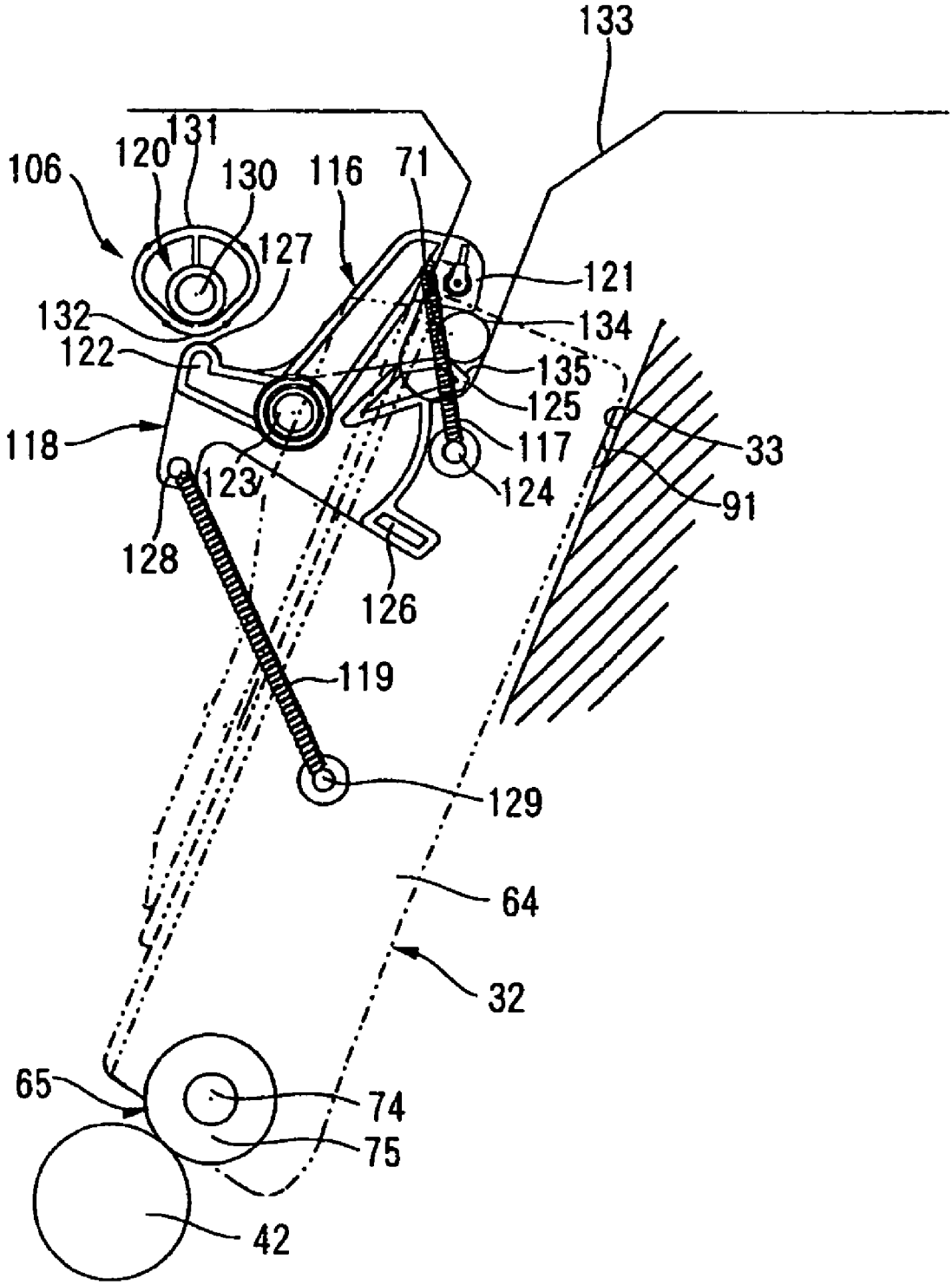
FIG. 27 is a side view for describing a state where the development cartridge is attached to the process housing section (a contact state)

As shown in FIG. 27, when the separation face 132 of the cam 120 opposes the cam-contacting section 122 of the first pressing member 116 and the cam-contacting protuberance 127 of the second pressing member 118, the contacting face 131 of the cam 120 is released from the downward pressing force. In turn, the first urging spring 117 restores its original contacted shape, and the first pressing member 116 is pivoted, by the restoration force of the first urging spring 117, in a direction where the boss-contacting section 121 advances to the travel path of the development boss section 71 while taking the support shaft 123 as a fulcrum. Further, the second urging spring 119 restores its original stretched shape, and the second pressing member 118 is pivoted, by means of restoration force of the second urging spring 119, in the travel path of the development boss section 71 toward a direction in which the boss contacting claw section 125 is moved, in the separated state, downstream in the attachment direction of the development boss section 71.

As a result of pivotal movement of the first pressing member 116, the upper press face 134 of the boss-contacting section 121 butts against the development boss section 71, thereby pressing the development boss section 71 in the attachment direction and toward the front edge of the boss insertion groove 133. As a result of pivotal movement of the second pressing member 118, the boss-contacting lug section 125 is moved, in the separated state, downstream in the attachment direction of the development boss section 71. In this state, the lower press face 135 of the boss-contacting lug section 125 butts against the development boss section 71 that remains pressed by the upper press face 134 of the boss-contacting section 121, and the development boss section 71 is elastically received by means of urging force of the second urging spring 119.

Since the spring constant of the second urging spring 119 is set so as to become smaller than the spring constant of the first urging spring 117. Hence, the development boss section 71 is moved, in the separated state, downstream in the attachment direction by means of the pressing force exerted by the upper press face 134 of the boss-contacting section 121. In this state, the development boss section 71 is received by the lower press face 135 of the boss-contacting lug section 125. As a result of movement of the development boss section 71 downstream in the attachment direction, the development roller 67 comes into contact with the photosensitive drum 42. Thereby, the photosensitive drum 42 and the development roller 67 come into contact with each other.

In this contact state, the development boss section 71 butts against the front edge of the boss insertion groove 133 by means of the pressing force exerted by the upper press face 134.

In the contact state, the first pressing member 116 and the second pressing member 118 are urged by the first urging spring 117 and the second urging spring 119. Hence, a clearance is formed between the separation face 132 of the cam 120, the cam-contacting section 122 of the first pressing member 116, and the cam-contacting protuberance 127 of the second pressing member 118.

In order to switch the contact state to the separated state, the cam 120 is rotated in the same manner as mentioned previously, in the contact state, with the separation face 132 of the cam 120 opposing and being separated from the cam-contacting section 122 of the first pressing member 116 and the cam-contacting protuberance 127 of the second pressing member 118. Thereby, the contacting face 131 of the cam 120 is brought into contact with the cam-contacting section 122 of the first pressing member 116 and the cam-contacting protuberance 127 of the second pressing member 118.

As shown in FIG. 26, when the contacting face 131 of the cam 120 opposes the cam-contacting section 122 of the first pressing member 116 and the cam-contacting protuberance 127 of the second pressing member 118, the contacting face 131 of the cam 120 comes into contact with the contacting section 122 of the first pressing member 116 and the cam-contacting protuberance 127 of the second pressing member 118, thereby pressing downward the cam-contacting section 122 and the cam-contacting protuberance 127. The first urging spring 117 is withdrawn, and the first pressing member 116 is pivoted in a direction where the boss-contacting section 121 recedes from the travel path of the development boss section 71, in defiance of the urging force of the first urging spring 117 while taking the support shaft 123 as a fulcrum. The second urging spring 119 is compressed, and the second pressing member 118 is pivoted in the travel path of the development boss section 71 by means of the pressing force—which is greater than the urging force of the second urging spring 119—in a direction where the boss-contacting lug section 125 moves, in the contact state, upstream in the attachment direction of the development boss section 71, while the support shaft 123 is taken as a fulcrum.

As a result of pivotal movement of the first pressing member 116, the upper press face 134 of the boss-contacting section 121 is separated from the development boss section 71, and the boss-contacting section 121 slightly advances to the travel path of the development boss section 71. Further, as a result of pivotal movement of the second pressing member 118, the boss-contacting lug section 125 is moved, in the contact state, upstream in the attachment direction of the development boss section 71. In association with movement of the boss-contacting lug section 125, the lower press face 135 of the boss-contacting lug section 125 presses the development boss section 71 in a separating direction. As a result of movement of the development boss section 71 upstream in the attachment direction thereof, the development roller 67 is separated from the photosensitive drum 42. Thereby, the photosensitive drum 42 and the development roller 67 are separated from each other. In this separated state, the boss-contacting section 121 moves in the direction receding from the travel path of the development boss section 71, and comes into a slightly-advanced state. Therefore, the development cartridge 32 can be separated from the development housing section 14.

As mentioned previously, in the contacting/separating mechanism 106 of the color laser printer 1, the boss-contacting section 121 of the first pressing member 116 has already receded, in the separated state, from the travel path of the development boss section 71. Hence, the development boss section 71 is moved in the travel path without the boss-contacting section 121 interfering with the development boss section 71 in the travel path, and the development cartridge 32 can be attached or detached.

In the contact state, the boss-contacting section 121 of the first pressing member 116 has already advanced to the travel path of the development boss section 71, and hence the boss-contacting section 121 can reliably press the development boss section 71 in the attachment direction.

Consequently, the travel path of the development boss section 71 can be formed as the efficient, substantially-straight boss insertion groove 133, regardless of the boss-contacting section 121. Further, the development boss section 71 can be pressed in the attachment direction without fail by means of the boss-contacting section 121.

Since a result of the boss insertion groove 133 can be formed substantially straight, there can be realized an attempt to miniaturize the apparatus and to enhance operability required to attach or detach the development cartridge 32.

In the separated state, the boss-contacting section 121 has already moved in the receding direction. However, the boss-contacting section 121 remains slightly advanced to the travel path of the development boss section 71 within the range where attachment or detachment of the development cartridge 32 is allowed. Therefore, during attachment or detachment of the development cartridges 32, the boss-contacting section 121 is elastically brought into contact with the development boss section 71 within the range where the boss-contacting section 121 does not interfere with attachment or detachment of the development boss section 71. By means of this contact, during attachment or detachment of the development cartridge 32, a tactile click can be imparted to the operator. Hence, positioning of the development cartridge 32 in a midway position in the attachment-and-detachment path can be prevented.

Even in the contact state where the boss contacting section 121 have moved in the receding direction, so long as the development cartridge 32 is withdrawn from the development housing section 14 at tensile force of a predetermined level or more by actuation of the development grip 72, the boss contacting section 121 moves in the receding direction in defiance of the urging force of the first urging spring 117. Accordingly, for instance, even in the case where an unexpected accident, such as a power failure, continues, the development cartridge 32 can be forcefully separated without inflicting damage to the first pressing member 116.

In the contact state, the upper press face 134 of the boss contacting section 121 presses the development boss section 71 in the attachment direction thereof and toward the front edge of the boss insertion groove 133, and the development boss section 71 remains in contact with the front edge of the boss insertion groove 133. Accordingly, in the contact state, the development cartridge 32 can be positioned with high accuracy.

Further, in the separated state, the lower press face 135 of the boss contacting claw section 125 of the second pressing member 118 in the contacting/separating mechanism 106 presses the development boss section 71 in the detachment direction without fail. Hence, during the non-image forming operation, the development cartridge 32 can be receded upstream in the attachment direction.

Since the boss contacting claw section 125 of the second pressing member 118 butts against the development boss section 71 at any position during the course of attachment of the development cartridge 32. Hence, even when the development cartridge 32 is vigorously attached, the force of the development cartridge 32 can be mitigated by the boss contacting claw section 125 as a result of the development cartridge 32 butting against the boss contacting claw section 125. Therefore, the development cartridge 32 and the drum cartridge 31 can be protected from damage.

In the travel path of the development boss section 71, the boss contacting claw section 125 is positioned downstream of the boss contacting section 121 in the attachment direction of the development boss section 71. Therefore, in the contact state, the development boss section 71 is pressed by the boss contacting section 121 in the attachment direction between the boss contacting section 121 and the boss contacting claw section 125. Simultaneously, the development boss section 71 is pressed in the detachment direction by the boss contacting claw section 125, thereby adjusting the pressing force exerted on the development cartridge 32 in the attachment direction thereof. Thus, the appropriate attached state of the development cartridge 32 can be ensured.

In the contact state, the separation face 132 of the cam 120 becomes out of contact with the cam contacting section 122 and the cam contacting protuberance 127 in the contacting/separating mechanism 106. Hence, all the urging force of the first urging spring 117 can be exerted on the cam contacting section 122. The pressing force exerted on the development boss section 71 in the attachment direction thereof can be adjusted by the spring constant of the first urging spring 117. Moreover, the all of the urging force of the second urging spring 119 can be exerted on the boss contacting claw section 125, and the pressing force exerted on the development boss section 71 in the attachment direction thereof can be adjusted by the preset spring constant of the second urging spring 119. By means of the urging force of the first urging spring 117, the boss contacting section 121 reliably presses the development cartridge 32 at the preset pressing force in the attachment direction. By means of the urging force of the second urging spring 119, the boss contacting claw section 125 reliably presses the development cartridge 32 at the preset pressing force in the separating direction.

Since the spring constant of the second urging spring 119 is set so as to become smaller than the spring constant of the first urging spring 117. Hence, in the contact state, the development boss section 71 can be held between the boss contacting section 121 and the cam contacting protuberance 127 with the pressing force exerted on the development cartridge 32 in the attachment direction thereof being stably lessened, and appropriate attachment of the development cartridge 32 can be assured.

Specifically, in the separating mechanism 106, during the image forming operation the separation face 132 of the cam member 120 opposes the cam contacting section 122 and the cam contacting protuberance 127 without involvement of a contact. In turn, the boss contacting section 121 is moved by means of the urging force of the first urging spring 117 in the advancing direction with respect to the attachment-and-detachment path, thereby pressing the development boss section 71. By pressing in the separating direction the development boss section 71 pressed by the boss contacting section 121 by means of the urging force of the second urging spring 119, the boss contacting claw section 125 resiliently receives the development boss section 71. As a result, the development roller 67 and the photosensitive drum 42 can be brought into contact with each other at stable pressing force by means of the urging force of the first urging spring 117 and the urging force of the second urging spring 119.

During the non-image forming operation, the contacting face 131 of the cam member 120 opposes the cam contacting section 122 and the cam contacting protuberance 127, and presses them downwardly. The boss contacting section 121 recedes from the attachment-and-detachment path in defiance of the urging force of the first urging spring 117, and separates from the development boss section 71. The boss contacting claw section 125 presses the development boss section 71 in the detachment direction at pressing force which is greater than the urging force of the second urging spring 119. Thus, detachment of the development cartridge 32 can be facilitated.

As long as the separation face 132 and the contacting face 131 are selectively caused to oppose the cam contacting section 122 and the cam contacting protuberance 127 by means of rotation of the cam member 120, the boss contacting section 121 and the boss contacting claw section 125 can be appropriately caused to advance to or recede from the travel path of the development boss section 71. The pressing force exerted on the development boss section 71 in the attachment direction thereof can be stably adjusted. Further, detachment of the development cartridge 32 can be facilitated.

As mentioned above, during the image forming operation, the development roller 67 and the photosensitive drum 42 are brought into contact with each other. During the non-image forming operation, the development roller 67 and the photosensitive drum 42 are separated from each other. Since the development roller 67 and the photosensitive drum 42 come into contact with each other only when necessary, their lives can be prolonged.

Moreover, in the separating mechanism 106, the first pressing member 116 and the second pressing member 118 are pivotally supported by the common support shaft 123. Therefore, an attempt can be made to make the configuration simple and reduce the number of components.

Since the support shaft 123 is positioned at a location downstream of the location where the boss contacting section 121 presses the development boss section 71 in the attachment direction, with respect to the attachment direction of the development boss section 71, the amount of pivotal movement of the first pressing member 116 can be reduced, and an attempt can be made to miniaturize the apparatus.

The boss contacting section 121 of the first pressing member 116 is formed so as to bulge inwardly in the transverse direction. The boss contacting claw section 125 of the second pressing member 118 is formed so as to bulge to the outside in the transverse direction. The upper press face 134 of the boss contacting section 121 and the lower press face 135 of the boss contacting claw section 125 are positioned so as to overlap each other in the movement direction of the development boss section 71. Therefore, the position where the upper press face 134 presses the development boss section 71 and the position where the lower press face 135 presses the development boss section 71 overlap each other in the movement direction of the development boss section 71. Hence, the development boss section 71 can be stably pressed by the boss contacting section 121 and the boss contacting protuberance section 125.

In this contacting/separating mechanism 106, when the drive force is input from the motor 138 to the gear train formed from the respective cam drive gears 136 and the respective intermediate gears 137, the pair of cams 120 are simultaneously rotated. Therefore, the plurality of pairs of cams 120 provided in association with the plurality of pairs of first pressing members 116 and the plurality of pairs of second pressing members 118 can be reliably rotated by means of a simple configuration. Consequently, reliable attachment or detachment of the plurality of development cartridges 32 can be achieved by means of appropriate operation of the plurality of pairs of first member 116 and appropriate operation of the plurality of pairs of second pressing members 118.

In the thus-attached development cartridge 32, the curved section 70 of the development enclosure 64 comes into contact with the rear face 33 of the partition plate 10 faster than does the jaw section 69. The development cartridge 32 is attached with the curved section 70 remaining in slidable contact with the rear face 33 of the partition plate 10. Therefore, infliction of damage to the jaw section 69 can be reliably prevented, and leakage of toner from the peripheral surface of the development roller 67 can be prevented without fail.

In the development cartridge 32 attached to the drum cartridge 31, the roller shaft 74 of the development roller 67 fits to the positioning groove 48 of the drum enclosure 41 so that the development cartridge 32 can be selectively positioned in a separated state or a contact state in the development housing section 14, whereby the development cartridge 32 is positioned with respect to the drum cartridge 31. Further, the contacting protuberance 91 on a bottom wall of the development enclosure 64 butts against the rear face 33 of the partition plate 10, whereby the development cartridge 32 is positioned with respect to the development housing section 14. Specifically, in the color laser printer 1, the drum boss section 56 is brought into contact with the deepest portion of the drum positioning groove 113, and detachment of the drum boss section 56 from the drum positioning groove 113 is restricted by means of the regulation spring 105. Thereby, the drum enclosure 41 of the drum cartridge 31 is positioned in a backward location. In the meantime, the contacting protuberance 91 on the bottom wall butts against the rear face 33 of the partition plate 10, whereby the development enclosure 64 of the development cartridge 32 is positioned in a forward location. Thereby, the drum cartridge 31 and the development cartridge 32 are respectively positioned in the longitudinal direction. Hence, when compared with a case where either the drum cartridge 31 or the development cartridge 32 is positioned with respect to the other, tolerance is difficult to arise. Accordingly, the drum cartridge 31 and the development cartridge 32 can be positioned with high accuracy.

Further, in the color laser printer 1, the drum cartridge 31 having the photosensitive drum 42 and the development cartridge 32 having the toner housing chamber 65 can be detached or attached, and hence the drum cartridge 31 and the development cartridge 32 can be individually replaced according to the life of the photosensitive drum 42 and the life of the toner housing chamber 65.

When the drum cartridge 31 is attached to the drum housing section 13, the photosensitive drum 42 is connected to the earth by means of a connection among unillustrated contact points. During the image forming operation, an electrification bias is applied to the scorotoron electrification device 62. Further, during the image forming operation, the drive force is input from the motor 138 by means of meshing action of an unillustrated gear, whereby the photosensitive drum 42 is rotated.

When the development cartridge 32 is attached to the development housing section 14, the development bias is applied to the roller shaft 74 of the development roller 67 during the image forming operation by means of a connection between unillustrated contact points. During the image forming operation, the drive force is input from the motor 138 by means of connection between unillustrated couplings, whereby the agitator 73, the feeding roller 66, and the development roller 67 are rotated.

As will be referred to FIG. 1, during the image forming operation, in the respective development cartridges 32 of the respective process sections 27, the toner of respective colors stored in the toner housing chamber 65 is agitated by the agitator 73, and the toner is then fed to the feeding roller 66. The toner fed to the feeding roller 66 is fed to the development roller 67 by means of rotation of the feeding roller 66. At this time, the toner is positively electrified between the feeding roller 66 and the development roller 67 added with an application of the development bias.

In association with rotation of the development roller 67, the toner fed to the development roller 67 enters between the layer thickness regulation blade and the development roller 67, and the toner is applied over the surface of the development roller 67 as a thin layer of a predetermined thickness.

In the meantime, in the drum cartridge 31, the scorotoron electrification device 62 generates a corona discharge by means of application of an electrification bias, to thus uniformly, positively electrify the surface of the photosensitive drum 42. After having been uniformly, positively electrified by the scorotoron electrification device 62 in association with rotation of the photosensitive drum 42, the surface of the photosensitive drum 42 is exposed to a high-speed scan of the laser beam output from the scanner unit 30, whereupon an electrostatic latent image corresponding to the image to be formed on the sheet 3 is formed.

As a result of further rotation of the photosensitive drum 42, when the toner opposes and contact the photosensitive drum 42 by means of rotation of the development roller 67, the toner that has been applied over the surface of the development roller 67 and positively electrified is supplied to the electrostatic latent image formed on the surface of the photosensitive drum 42; namely, exposed areas on the uniformly, positively-electrified surface of the photosensitive drum 42, electric potentials of the areas having been reduced upon exposure to the laser beam. As a result, the electrostatic latent image of the photosensitive drum 42 is visualized, and toner images of respective colors are formed on the surface of the photosensitive drum 42.

As shown in FIG. 1, the transfer section 28 is longitudinally placed in a position within the main body casing 2, above the sheet feeding section 4, and below the respective process housing sections 12; and has the drive roller 78, a driven roller 79, the transfer belt 80, and the transfer roller 81.

The drive roller 78 is disposed ahead of the process housing section 12 where the yellow process section 16Y is housed. The driven roller 79 is disposed behind the process housing section 12 where the black process section 16K is housed.

The transport belt 80 is formed from an endless belt, and made of conductive resin, such as polycarbonate or polyimide, wherein conductive particles such as carbon are dispersed. This transport belt 80 is wound around the drive roller 78 and the driven roller 79.

By means of driving of the drive roller 78, the driven roller 79 is driven, whereby the transport belt 80 is rotated in a circulating manner between the drive roller 78 and the driven roller 79 in the same direction as is the photosensitive drum 42, in the image forming apparatus where the transport belt contacts the photosensitive drums 42 of the respective process sections 27 while opposing the same.

The transfer rollers 81 are provided, within the transport belt 80 wound around the drive roller 79 and the driven roller 79, so as to oppose the photosensitive drums 42 of the respective process sections 16 with the transport belt 80 therebetween. In this transport roller 81, a metal roller shaft is coated with a roller portion made of an elastic member such as a conductive rubber material. In the image forming apparatus where the transfer roller 81 contacts the transport belt 80 while opposing the same, the transfer roller 81 is provided so as to be able to rotate in the same direction where the transport belt 80 is rotated in a circulating manner.

The sheet 3 having been fed from the sheet feeding section 4 is transported from front to back by the transport belt 80, which is moved in a circulating manner by driving action of the drive roller 78 and driven action of the driven roller 79, so as to sequentially pass through image forming positions between the transport belt 80 and the photosensitive drums 42 of the respective process sections 27. During the course of transport operation, the toner images of respective colors formed on the photosensitive drums 42 of the respective process sections 27 are sequentially transferred, whereby a color image is formed on the sheet 3.

For example, when the yellow toner image formed on the surface of the photosensitive drum 42 of the yellow process section 27Y is transferred to the sheet 3, the magenta toner image formed on the surface of the photosensitive drum 42 of the magenta process section 27M is then transferred, in an overlapping manner, on the sheet 3 where the yellow toner image has already been transferred. By means of similar operation, the cyan toner image formed on the surface of the photosensitive drum 42 of the cyan process section 16C and the black toner image formed on the surface of the photosensitive drum 42 of the black process section 16K are transferred in an overlapping manner. As a result, the color image is formed on the sheet 3.

In relation to formation of such a color image, the color laser printer 1 has the configuration of a tandem device, wherein a plurality of pairs, each pair consisting of the drum cartridge 31 and the development cartridge 32, are provided for respective colors in the respective process section 27. Therefore, toner images of respective colors are formed substantially at the same speed where a monochrome image is formed.

The fixing section 29 is disposed on the main body casing 7 behind the process housing section 12 where the black process section 16K is housed in the main body casing 2. The fixing section 29 is positioned so as to oppose, in the longitudinal direction, the image forming position, where the photosensitive drum 42 comes into contact with the transport belt 80. This fixing section 29 has the heating roller 82 and the pressure roller 83.

The heating roller 82 is formed from an original metal pipe, wherein a mould releasing layer is formed on the surface of the original metal pipe. A halogen lamp is incorporated in the heating roller in the axial direction thereof. The surface of the heating roller 82 is heated to a fixing temperature by means of the halogen lamp. The pressure roller 82 is provided so as to press the heating roller 82.

The color image transferred onto the sheet 3 is transported to the fixing section 29, and the sheet 3 is thermally-fixd while passing between the heating roller 82 and the pressure roller 81.

The sheet ejection section 6 has a U-shaped sheet-output path 84, a sheet ejection roller 85 serving as ejection mechanism, and a sheet ejection tray 86.

An upstream end portion of the U-shaped sheet ejection path 84 is adjacent to the fixing section 29 at a lower position. A downstream end of the U-shaped sheet ejection path 84 is adjacent to the sheet ejection tray 86 at an upper position. The path is formed as a substantially U-shaped transport path for the sheet 3.

The sheet ejection roller 85 is provided as a pair of rollers at a downstream end of the U-shaped sheet ejection path 84.

The sheet ejection tray 86 is formed as an inclined wall, which is downwardly inclined from front to back, on the upper surface of the main body casing 2.

The sheet transported from the fixing section 29 is backwardly fed to the upstream end portion of the U-shaped sheet ejection path 84. In the U-shaped sheet ejection path 84, the transporting direction of the sheet is inverted, and the sheet is then forwardly ejected to the sheet ejection tray 86 by means of the sheet ejection roller 85.

As mentioned previously, in the color laser printer 1, the direction in which the pickup roller 22 of the sheet feeding section 4 picks up the sheet 3 is forward, and the direction in which the sheet 3 is transported at the respective image forming positions is backward. Thus, the pickup direction and the transporting direction are opposite to each other. Further, the direction in which the sheet 3 is transported at the respective image forming positions is backward, and the direction in which the sheet 3 is output by the sheet ejection roller 85 in the sheet ejection section 6 is forward. Thus, the transporting direction and the ejection direction are opposite to each other. Therefore, an attempt can be made to miniaturize the apparatus while ensuring the transport path for the sheet 3.

In the color laser printer 1, in the respective process housing sections 12, the drum cartridge 31 and the development cartridge 32 are attached to or detached from the drum housing section 13 and the development housing section 14 in a direction at an inclination with respect to the longitudinal direction and the vertical direction (the thicknesswise direction of the sheet 3); namely, a direction inclined rearward from up to down. Therefore, an attempt can be made to enhance ease of operation for attaching or detaching the drum cartridge 31 and the development cartridge 32.

In the color laser printer 1, the plurality of pairs, each pair consisting of the drum cartridge 31 and the development cartridge 32, and the plurality of scanner units corresponding to the pairs are arranged one after another. Therefore, an attempt can be made to miniaturize the apparatus by such an efficient arrangement of the cartridges and the units.

In the color laser printer 1, in each of the process housing sections 12, the extension section 44 of the drum enclosure 41 of the drum cartridge 31 is interposed between the scanner unit 30 and the development cartridge 32. The opening section 58, which allows passage of the laser beam emitted from the scanner unit 30 to the photosensitive drum 42, is formed in the intermediate plate 54 of the extension section 44. Therefore, while an efficient arrangement is ensured by interposing the extension section 44 between the scanner unit 30 and the development cartridge 32, reliable passage of the laser beam emitted from the scanner unit 30 to the photosensitive drum 42 can be ensured by the opening section 58 formed in the extension section 44.

In the above descriptions, as shown in FIG. 22, in the drum shaft lock mechanism 104 the press cam 107 is provided with the contacting shaft 112, and the contacting shaft 112 is brought into contact with the lower end portion of the holder side wall 45, whereby the press cam 107 is pivoted against the urging force of the urging spring 108. However, as shown in FIG. 23, a fitting member 113, which can removably fits to the roller shaft 74 of the development roller 67, can also be provided in place of the contacting shaft 112.

In FIG. 23, those members which are the same as the members shown in FIG. 22 are assigned the same reference numerals, and their explanations are omitted.

In FIG. 23, the fitting member 113 assumes the shape of an substantially-U-shaped plate, and is pivotally supported by a rotary shaft 114 provided so as to protrude to the outside, in the transverse direction, from the outer side surface of the right side plate 8 and the outer side surface of the left side plate 9. When the development roller 32 is attached to or removed from, in the development housing section 14, the drum cartridge 31 attached to the drum housing section 13, the fitting member 113 attaches to or separates from the roller shaft 74 of the development roller 67, to thus be able to forwardly or backwardly rotate in association with the attachment or removal movement of the roller shaft 74.

The upper front portion of the press cam 107 butts against the fitting member 113, and is urged at all times by the urging force of the urging spring 108 so as to pivot in the direction where the contacting section 110 causes the drum shaft 60 to butt against the receiving section 102 and the direction (the counterclockwise direction in FIG. 23) in which the fitting member 113 is pressed to advance to the attachment-and-detachment path of the development cartridge 32 (the attachment-and-detachment path of the roller shaft 74), to thus fit to the roller shaft 74.

Figure 23A:
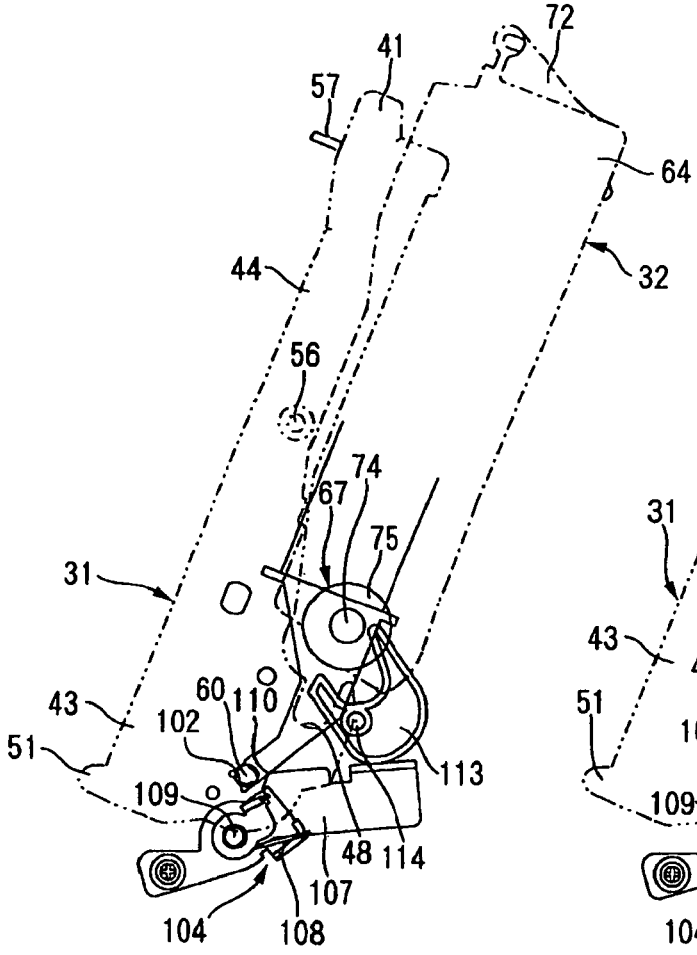

As shown in FIG. 23A, in a state where the development cartridge 32 is detached, the fitting member 113 is pivoted by means of the detaching action of the development roller 67 from the roller shaft 74, which has been performed before detachment of the development cartridge, in defiance of the urging force of the urging spring 108 so as to recede from the attachment-and-detachment path of the roller shaft 74, and is held in the thus-receded state.

Figure 23B:
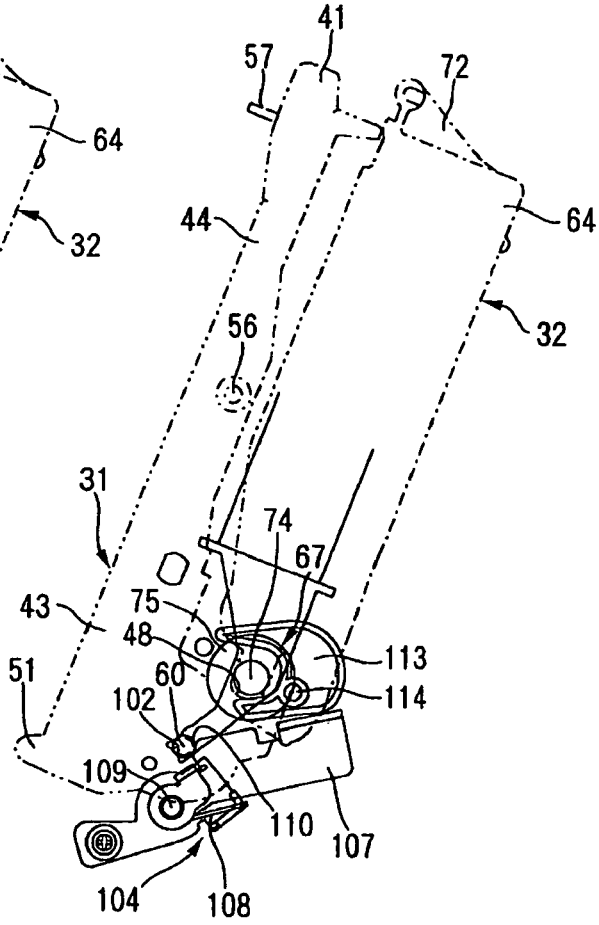

As shown in FIG. 23B, when the development cartridge 32 is attached, the roller shaft 74 fits to the respective fitting member 113, to thus pivot the fitting members 113 in the direction (the counterclockwise direction in FIG. 23) where the fitting members 113 advance to the attachment-and-detachment path of the development cartridge 32. In turn, the press cam 107 is pivoted by the urging force of the respective urging springs 108, whereupon the contacting section 110 advances to the guide groove 101 so as to close the groove and to press the drum shaft 60 toward the receiving section 102, thereby restricting movement of the drum shaft 60 received by the receiving section 102.

As mentioned above, in the drum shaft lock mechanism shown in FIG. 23, the contacting section 110 of the press cam 107 advances to or recedes from the guide groove 101, i.e., the travel path of the drum shaft 60, in synchronism with attachment or detachment of the development cartridge 32 to or from the development housing section 14. Therefore, reliable attachment or detachment of the drum cartridge 31 can be ensured.

Figure 33:
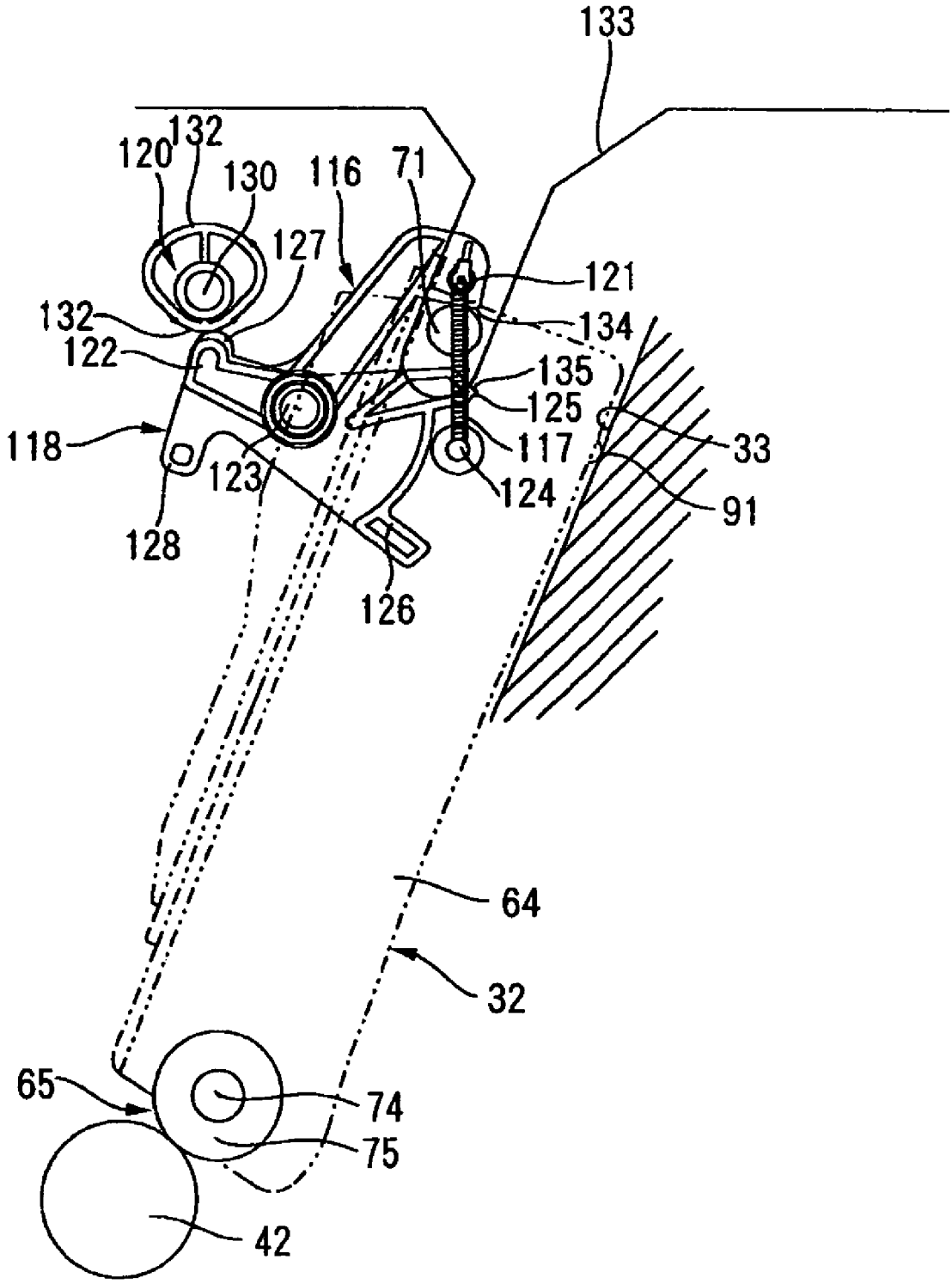
FIG. 33 shows another embodiment of a second pressing member (not having a second urging spring).

In the above descriptions, the second pressing member 118 is provided with the second urging spring 119 in the contacting/separating mechanism 106. However, as shown in FIG. 33, so long as the centroid of the second pressing member 118 is pivotally supported at all times by the support shaft 123 such that the pivotal movement regulation lug section 126 descends and such that the cam contacting protuberance 127 ascends, the second pressing member 118 may be devoid of the second urging spring 119.

The above descriptions have illustrated the tandem color laser printer 1 that directly transfers images from the respective photosensitive drums 42 to the sheet 3. However, the present invention is not limited to this type of printer. For instance, the present invention can also be configured as a color laser printer of intermediate transfer type which transfers toner images of respective colors from respective photosensitive members to an intermediate transfer body and collectively transfers the images to a sheet. Moreover, the present invention can be applied to a monochrome laser printer.

As described with reference to the embodiment, there are provided configurations listed below.

(1) An image forming apparatus including: a process cartridge that is provided in the image forming apparatus to be removable from the image forming apparatus along an attachment-and-detachment path; a first pressing member that is provided to be movable bi-directionally in an advancing direction advancing to the attachment-and-detachment path and in a receding direction receding from the attachment-and-detachment path, the first pressing member being configured to press the process cartridge toward an attachment direction in which the process cartridge is attached in a first state in which the first pressing member is moved toward the advancing direction, and to enable detachment of the process cartridge in a second state in which the first pressing member is moved toward the receding direction.

According to the above configuration of (1), as a result of the first pressing member having been moved in the receding direction with respect to the attachment-and-detachment path of the process cartridge, the process cartridge can be attached or detached without the first pressing member interfering with the process cartridge in the attachment-and-detachment path. Further, as a result of the first pressing member remaining moved in the advancing direction with respect to the attachment-and-detachment path of the process cartridge, the first pressing member can press the process cartridge in the attachment direction. Consequently, the attachment-and-detachment path of the process cartridge can be efficiently routed without regard to the first pressing member. Moreover, the process cartridge can be pressed in the attachment direction by the first pressing member without fail.

(2) The image forming apparatus according to the configuration of (1), wherein the first pressing member is provided at a position that advances to the attachment-and-detachment path within a range where the attachment and detachment of the process cartridge is allowed in the second state.

According to the above configuration, during attachment or detachment of the process cartridge, the first pressing member is brought into contact with the process cartridge within a range where the first pressing member does not hinder attachment or detachment of the process cartridge. During attachment or detachment of the process cartridge, a tactile click can be imparted by the contact. Therefore, positioning of the process cartridge at a midway location on the attachment-and-detachment path can be prevented.

(3) The image forming apparatus according to the configuration of (1), wherein the first pressing member moves from the first state to the second state when a pressing force of a predetermined level or more toward the detachment direction in which the process cartridge is detached is received from the process cartridge.

According to the above configuration, when having received, from the process cartridge, pressing force of a predetermined level or more directed in the detachment direction of the process cartridge with the first pressing member having moved in the advancing direction, the first pressing member moves in the receding direction. Accordingly, the process cartridge can be forcefully detached without inflicting damage to the first pressing member.

(4) The image forming apparatus according to the configuration of (1), wherein the image forming apparatus is provided with a reference plane that contacts with the process cartridge to position the process cartridge, wherein the first pressing member is provided with a first press face that presses the process cartridge, and wherein the first press face contacts with the process cartridge to generate a pressing force to press the process cartridge in the attachment direction and to press the process cartridge toward the reference plane.

According to the above configuration, when being pressed by the first press face of the first pressing member, the process cartridge is pressed toward the reference plane as well as in the attachment direction. Therefore, the process cartridge can be positioned with high accuracy.

(5) The image forming apparatus according to the configuration of (1), wherein the process cartridge is provided with a pressed member that protrudes in a direction crossing the attachment direction, and wherein the first pressing member contacts with the pressed member.

According to the above configuration, the first pressing member comes into contact with the members to be pressed, thereby pressing the process cartridge in the attachment direction. As a result, the first pressing member can be ensured of reliably pressing the process cartridge in the attachment direction.

(6) The image forming apparatus according to the configuration of (1), further including a second pressing member that presses the process cartridge in the detachment direction.

According to the above configuration, the second pressing member can press the process cartridge in the detachment direction. Accordingly, when the process cartridge is not operated, the process cartridge can be receded to an upstream position in the attachment direction.

(7) The image forming apparatus according to the configuration of (6), wherein the process cartridge is provided with a pressed member that protrudes in a direction crossing the attachment direction, and wherein the second pressing member contacts with the pressed member.

According to the above configuration, the second pressing member comes into contact with the members to be pressed, thereby pressing the process cartridge in the detachment direction. Therefore, the second pressing member can be ensured of reliably pressing the process cartridge in the detachment direction.

(8) The image forming apparatus according to the configuration of (6), wherein the second pressing member is provided at an arbitrary position in the attachment-and-detachment path and contacts with the process cartridge during the course of attachment of the process cartridge.

According to the above configuration, the second pressing member comes into contact with the process cartridge during the course of attachment of the process cartridge. Accordingly, even when having been attached with excessive force, the process cartridge comes into contact with the second pressing member, and the second pressing member mitigates the force, thereby preventing infliction of damage on the apparatus including the process cartridge.

(9) The image forming apparatus according to the configuration of (8), wherein the second pressing member is provided at a position downstream of the first pressing member in the attachment direction of the process cartridge.

According to the above configuration, the process cartridge is pressed between the first pressing member and the second pressing member; specifically, the process cartridge is pressed by the first pressing member in the attachment direction while simultaneously being pressed by the second pressing member in the detachment direction, so that the force for pressing the process cartridge in the attachment direction can be adjusted. Therefore, an appropriate attached state of the process cartridge can be ensured.

(10) The image forming apparatus according to the configuration of (6), further including a support shaft that rotatably supports the first pressing member and the second pressing member.

According to the above configuration, the first pressing member and the second pressing member are supported so as to be rotatable around the common support shaft. Hence, an attempt to simplify the configuration and diminish the number of components can be realized.

(11) The image forming apparatus according to the configuration of (10), wherein the support shaft is provided at a position downstream in the attachment direction of a position where the first pressing member presses the process cartridge.

According to the above configuration, the amount of rotation of the first pressing member can be reduced, and an to miniaturize the apparatus can be realized.

(12) The image forming apparatus according to the configuration of (6), wherein the first pressing member is provided with a first press face that presses the process cartridge, wherein the second pressing member is provided with a second press face that presses the process cartridge, and wherein the first press face and the second press face are arranged so as to overlap in the attachment direction of the process cartridge.

According to the above configuration, the position where the first pressing member presses the process cartridge overlaps the position where the second pressing member presses the same, in the attachment or detachment direction of the process cartridge. Hence, the process cartridge can be stably pressed by the first pressing member and the second pressing member.

(13) The image forming apparatus according to the configuration of (1), further including a first urging member that urges the process cartridge toward the attachment direction of the process cartridge.

According to the above configuration, the process cartridge can be urged in the attachment direction by the first urging member. Thereby, the process cartridge can be readily pressed in the attachment direction without fail.

(14) The image forming apparatus according to the configuration of (13), wherein the first pressing member is provided with the first urging member to press the process cartridge toward the attachment direction.

According to the above configuration, the first pressing member urges the process cartridge in the attachment direction by the urging force of the first urging member. Accordingly, the process cartridge can be readily, reliably pressed by the first pressing member in the attachment direction.

(15) The image forming apparatus according to the configuration of (14), further including a cam member that includes: a first face that moves the first pressing member to the first state with an urging force provided by the first urging member; and a second face that moves the first pressing member to the second state against the urging force provided by the first urging member, wherein the cam member is provided to be rotatable and to selectively face one of the first face and the second face to the first pressing member.

According to the above configuration, when the first face of the cam member has opposed the first pressing member, the first pressing member is moved in the advancing direction with respect to the attachment-and-detachment path by means of the urging force of the first urging member. Further, when the second face of the cam member has opposed the first pressing member, the first pressing member is moved in the receding direction with respect to the attachment-and-detachment path against the urging force of the first urging member. Therefore, so long as the first face and the second face are selectively caused to oppose the first pressing member by means of rotation of the cam member, the first pressing member can be appropriately caused to advance to or recede from the attachment-and-detachment path.

(16) The image forming apparatus according to the configuration of (15), wherein the first face and the first pressing member are configured to be noncontact with each other when the first face of the cam member faces the first pressing member.

According to the above configuration, the first face opposes the first pressing member without involvement of a contact. Therefore, all of the urging force of the first urging member can be exerted on the first pressing member, and the first pressing member can press the process cartridge with stable pressing force.

(17) The image forming apparatus according to the configuration of (13), further including a second urging member that urges the process cartridge toward the detachment direction of the process cartridge to lessen the pressing force directed in the attachment direction.

According to the above configuration, since the process cartridge can be urged in the detachment direction by the second urging member, the force for pressing the process cartridge in the attachment direction can be adjusted.

(18) The image forming apparatus according to the configuration of (17), wherein the first urging member and the second urging member include springs, and wherein a spring constant of the second urging member is configured to be smaller than a spring constant of the first urging member.

According to the above configuration, since the spring constant of the second urging member is set so as to become smaller than the spring constant of the first urging member, the force for pressing the process cartridge in the attachment direction can be stably adjusted without fail.

(19) The image forming apparatus according to the configuration of (17), further including a second pressing member that presses the process cartridge in the detachment direction, wherein the second pressing member is provided with the second urging member to press the process cartridge toward the detachment direction.

According to the above configuration, the second pressing member presses the process cartridge in the detachment direction by means of the urging force of the second urging member. Accordingly, the process cartridge can be readily pressed without fail in the detachment direction by means of the second pressing member.

(20) The image forming apparatus according to the configuration of (19), further including a first urging member that urges the process cartridge toward the attachment direction of the process cartridge, wherein the first pressing member is provided with the first urging member to press the process cartridge toward the attachment direction, wherein the image forming apparatus further includes a cam member that includes: a first face that moves the first pressing member to the first state with an urging force provided by the first urging member; and a second face that moves the first pressing member to the second state against the urging force provided by the first urging member, wherein the cam member is provided to be rotatable and to selectively face one of the first face and the second face to the first pressing member, wherein the first face and the second face of the cam member selectively face the second pressing member, wherein the first face presses the second pressing member in the detachment direction of the process cartridge with the urging force of said second urging member when the first face faces the second pressing member, and wherein the second face presses the second pressing member in the detachment direction of the process cartridge with a pressing force that is greater than the urging force of the second urging member when the second face faces the second pressing member.

According to the above configuration, when the first face of the cam member opposes the second pressing member, the second pressing member is pressed in the detachment direction of the process cartridge by means of the urging force of the second urging member. When the second face of the cam member opposes the second pressing member, the second face presses the second pressing member in the detachment direction of the process cartridge by the pressing force that is greater than the urging force of the second urging member. Accordingly, so long as the first face is caused to oppose the second pressing member by means of rotation of the cam member, force for pressing the process cartridge in the attachment direction can be stably adjusted. Moreover, so long as the second face is caused to oppose the second pressing member, detachment of the process cartridge can be facilitated.

(21) The image forming apparatus according to the configuration of (20), wherein the first face and the second pressing member are configured to be noncontact with each other when the first face of the cam member faces the second pressing member.

According to the above configuration, since the first face opposes the second pressing member without involvement of contact, all of the urging force of the second urging member can be exerted on the second pressing member, so that the second pressing member can press the process cartridge with stable pressing force.

(22) The image forming apparatus according to the configuration of (1), wherein the attachment-and-detachment path of the process cartridge is substantially straight.

According to the above configuration, the attachment-and-detachment path of the process cartridge is substantially straight. Hence, an attempt to miniaturize the apparatus and to enhance ease of operation for attaching or detaching the process cartridge can be realized.

(23) The image forming apparatus according to the configuration of (15), wherein the process cartridge is provided in the image forming apparatus in a number of more than one, wherein each of the process cartridges are provided with pressed members that protrude from both sides in a direction orthogonal to the attachment direction, wherein the first pressing member is provided as a pair in association with the pressed members, at both ends of the process cartridge in a direction orthogonal to the attachment direction, wherein the cam member is provided as a pair for each of the process cartridges in association with the pair of first pressing members, and wherein the image forming apparatus further includes: a rotary shaft that extends in a direction orthogonal to the attachment direction, the rotary shaft being coupled to the pair of cam members in a relatively non-rotatable manner, and being supported in a rotatable manner; and a gear train that is provided on either side of a direction orthogonal to the attachment direction, the gear train being coupled to the rotary shaft.

According to the above configuration, when drive force is input to the gear train, the drive force is transmitted from the gear train to the respective rotary shafts. When the drive force has been input to the respective rotary shafts, a pair of cam members are simultaneously rotated. Consequently, a plurality of pairs of cam members provided in association with the plurality of pairs of first pressing members can be rotated without fail by means of a simple configuration. Therefore, the plurality of process cartridges can be reliably attached or removed by means of appropriate operation of the plurality of pairs of first pressing members.

(24) The image forming apparatus according to the configuration of (23), wherein the second pressing member is provided as a pair in association with the pressed members respectively at both ends in a direction orthogonal to the attachment direction.

According to the above configuration, attachment or detachment of the plurality of process cartridges can be performed more reliably by means of appropriate operation of the plurality of pairs of second pressing members.

(25) The image forming apparatus according to the configuration of (1), wherein the process cartridge is a development cartridge having a developing agent carrier, wherein the image forming apparatus further comprises a photosensitive cartridge that is provided with a photosensitive member, the photosensitive cartridge being configured that the development cartridge is removably attached thereto, and wherein the development cartridge is attached to the image forming apparatus such that the development agent carrier contacts with the photosensitive member when performing an image forming operation, and that the development agent carrier separates from the photosensitive member when the image forming operation is unperformed.

According to the above configuration, during the image forming operation, the development cartridge is attached to the photosensitive cartridge such that the developing agent carrier and the photosensitive member come into contact with each other. During a non-image forming operation, the development cartridge is attached to the photosensitive cartridge such that the developing agent carrier and the photosensitive member separate from each other. Thereby, the developing agent carrier and the photosensitive member come into contact with each other only when necessary, and hence their lives can be prolonged.

(26) The image forming apparatus according to the configuration of (25), wherein the process cartridge is provided with a pressed member that protrudes in a direction crossing the attachment direction, wherein the first pressing member contacts with the pressed member, wherein the image forming apparatus further includes: a second pressing member that presses the process cartridge in the detachment direction; a first urging member that is provided on the first pressing member and urges the process cartridge toward the attachment direction of the process cartridge; and a cam member that includes: a first face that moves the first pressing member to the first state with an urging force provided by the first urging member; and a second face that moves the first pressing member to the second state against the urging force provided by the first urging member, wherein the cam member is provided to be rotatable and to selectively face one of the first face and the second face to the first pressing member, wherein the first face of the cam member faces the first pressing member and the second pressing member during the image forming operation, and wherein the second face of the cam member faces the first pressing member and the second pressing member when the image forming operation is unperformed.

According to the above configuration, during the image forming operation, the first face of the cam member opposes the first pressing member and the second pressing member. Hence, the developing agent carrier and the photosensitive member can be brought into contact with each other at the preset stable pressing force, by means of the urging force of the first urging member and the urging force of the second urging member. During the non-image forming operation, the second face of the cam member opposes the first pressing member and the second pressing member. Hence, detachment of the process cartridge can be facilitated.

(27) The image forming apparatus according to the configuration of (25), wherein the photosensitive cartridge and the development cartridge are provided as a pair, and wherein a plurality of pairs of the photosensitive cartridge and the development cartridge are provided in the image forming apparatus for respective colors.

According to the above configuration, the photosensitive cartridge and the development cartridge are provided as a single pair, and a plurality of pairs are provided for respective colors. Hence, a color image can be formed while an attempt to achieve miniaturization is realized.

(28) The image forming apparatus according to the configuration of (27), further including: a feeding mechanism that picks up and feeds a recording medium; and an ejection mechanism that ejects the recording medium, wherein the plurality of pairs of the photosensitive cartridge and the development cartridge are disposed along a transport path of the recording medium between the feeding mechanism and the ejection mechanism, wherein a pickup direction of the recording medium picked up by the feeding mechanism is opposite a transport direction of the recording medium at image forming positions where images are sequentially formed by the plurality of pairs of the photosensitive cartage and the development cartridge, and wherein the transport direction of the recording medium at the image forming positions is opposite an ejection direction of the recording medium ejected by the ejection mechanism.

According to the above configuration, the arrangement is set such that a pickup direction of the recording medium is opposite the transport direction of the recording medium achieved at an image forming position, and such that the transport direction of the recording medium achieved at the image forming position is opposite the ejection direction of the recording medium. Accordingly, an attempt to miniaturize the apparatus can be realized while ensuring the transport path of the recording medium.

(29) The image forming apparatus according to the configuration of (28), wherein the photosensitive cartridge and the development cartridge are attached or detached in a direction inclined with reference to the transport direction of the recording medium at the image forming positions and in a thicknesswise direction of the recording medium orthogonal to the transport direction.

According to the above configuration, the photosensitive cartridge and the development cartridge are attached or detached in a direction inclined with reference to the transport direction of the recording medium achieved in the image forming position and a thicknesswise direction of the recording medium orthogonal to the transport direction. Accordingly, there can be realized an attempt to enhance ease of operation for attaching or detaching the photosensitive cartridge and the development cartridge.

(30) The image forming apparatus according to the configuration of (28), further including a plurality of exposure devices are provided in association with the plurality of pairs of the photosensitive cartridge and the development cartridge, wherein the plurality of pairs of the photosensitive cartridge and the development cartridge, and the plurality of exposure devices corresponding thereto are arranged one after another in the transport direction of the recording medium at the image forming positions.

According to the above configuration, the plurality of pairs, each pair consisting of the photosensitive cartridge and the development cartridge and the plurality of exposure devices provided in association therewith are arranged successively. Therefore, an attempt to miniaturize the apparatus can be realized by means of the efficient layout of the cartridges and the exposure devices.

The foregoing description of the embodiment has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a process cartridge that is provided in the image forming apparatus to be removable from the image forming apparatus along an attachment-and-detachment path;

a first pressing member that is provided to be movable bi-directionally in an advancing direction advancing to the attachment-and-detachment path and in a receding direction receding from the attachment-and-detachment path, the first pressing member being configured to press the process cartridge toward an attachment direction in which the process cartridge is attached in a first state in which the first pressing member is moved toward the advancing direction, and to enable detachment of the process cartridge in a second state in which the first pressing member is moved toward the receding direction.

2. The image forming apparatus according to claim 1, wherein the first pressing member is provided at a position that advances to the attachment-and-detachment path within a range where the attachment and detachment of the process cartridge is allowed in the second state.

3. The image forming apparatus according to claim 1, wherein the first pressing member moves from the first state to the second state when a pressing force of a predetermined level or more toward a detachment direction in which the process cartridge is detached is received from the process cartridge.

4. The image forming apparatus according to claim 1, wherein the image forming apparatus is provided with a reference plane that contacts with the process cartridge to position the process cartridge, wherein the first pressing member is provided with a first press face that presses the process cartridge, and wherein the first press face contacts with the process cartridge to generate a pressing force to press the process cartridge in the attachment direction and to press the process cartridge toward the reference plane.

5. The image forming apparatus according to claim 1, wherein the process cartridge is provided with a pressed member that protrudes in a direction crossing the attachment direction, and wherein the first pressing member contacts with the pressed member.

6. The image forming apparatus according to claim 1, further comprising a second pressing member that presses the process cartridge in a detachment direction in which the process cartridge is detached.

7. The image forming apparatus according to claim 6, wherein the process cartridge is provided with a pressed member that protrudes in a direction crossing the attachment direction, and wherein the second pressing member contacts with the pressed member.

8. The image forming apparatus according to claim 6, wherein the second pressing member is provided at an arbitrary position in the attachment-and-detachment path and contacts with the process cartridge during the course of attachment of the process cartridge.

9. The image forming apparatus according to claim 8, wherein the second pressing member is provided at a position downstream of the first pressing member in the attachment direction of the process cartridge.

10. The image forming apparatus according to claim 6, further comprising a support shaft that rotatably supports the first pressing member and the second pressing member.

11. The image forming apparatus according to claim 10, wherein the support shaft is provided at a position downstream in the attachment direction of a position where the first pressing member presses the process cartridge.

12. The image forming apparatus according to claim 6, wherein the first pressing member is provided with a first press face that presses the process cartridge, wherein the second pressing member is provided with a second press face that presses the process cartridge, and wherein the first press face and the second press face are arranged so as to overlap in the attachment direction of the process cartridge.

13. The image forming apparatus according to claim 1, further comprising a first urging member that urges the process cartridge toward the attachment direction of the process cartridge.

14. The image forming apparatus according to claim 13, wherein the first pressing member is provided with the first urging member to press the process cartridge toward the attachment direction.

15. The image forming apparatus according to claim 14, further comprising a cam member that includes:

a first face that moves the first pressing member to the first state with an urging force provided by the first urging member; and a second face that moves the first pressing member to the second state against the urging force provided by the first urging member, wherein the cam member is provided to be rotatable and to selectively face one of the first face and the second face to the first pressing member.

16. The image forming apparatus according to claim 15, wherein the first face and the first pressing member are configured to be noncontact with each other when the first face of the cam member faces the first pressing member.

17. The image forming apparatus according to claim 15, wherein the process cartridge is provided in the image forming apparatus in a number of more than one, wherein each of the process cartridges are provided with pressed members that protrude from both sides in a direction orthogonal to the attachment direction, wherein the first pressing member is provided as a pair in association with the pressed members, at both ends of the process cartridge in a direction orthogonal to the attachment direction, wherein the cam member is provided as a pair for each of the process cartridges in association with the pair of first pressing members, and wherein the image forming apparatus further comprises:

a rotary shaft that extends in a direction orthogonal to the attachment direction, the rotary shaft being coupled to the pair of cam members in a relatively non-rotatable manner, and being supported in a rotatable manner; and a gear train that is provided on either side of a direction orthogonal to the attachment direction, the gear train being coupled to the rotary shaft.

18. The image forming apparatus according to claim 17, wherein the second pressing member is provided as a pair in association with the pressed members respectively at both ends in a direction orthogonal to the attachment direction.

19. The image forming apparatus according to claim 13, further comprising a second urging member that urges the process cartridge toward a detachment direction of the process cartridge in which the process cartridge is detached to lessen the pressing force directed in the attachment direction.

20. The image forming apparatus according to claim 19, wherein the first urging member and the second urging member include springs, and wherein a spring constant of the second urging member is configured to be smaller than a spring constant of the first urging member.

21. The image forming apparatus according to claim 19, further comprising a second pressing member that presses the process cartridge in the detachment direction, wherein the second pressing member is provided with the second urging member to press the process cartridge toward the detachment direction.

22. The image forming apparatus according to claim 21, further comprising a first urging member that urges the process cartridge toward the attachment direction of the process cartridge, wherein the first pressing member is provided with the first urging member to press the process cartridge toward the attachment direction, wherein the image forming apparatus further comprises a cam member that includes:

a first face that moves the first pressing member to the first state with an urging force provided by the first urging member; and a second face that moves the first pressing member to the second state against the urging force provided by the first urging member, wherein the cam member is provided to be rotatable and to selectively face one of the first face and the second face to the first pressing member, wherein the first face and the second face of the cam member selectively face the second pressing member, wherein the first face presses the second pressing member in the detachment direction of the process cartridge with the urging force of said second urging member when the first face faces the second pressing member, and wherein the second face presses the second pressing member in the detachment direction of the process cartridge with a pressing force that is greater than the urging force of the second urging member when the second face faces the second pressing member.

23. The image forming apparatus according to claim 22, wherein the first face and the second pressing member are configured to be noncontact with each other when the first face of the cam member faces the second pressing member.

24. The image forming apparatus according to claim 1, wherein the attachment-and-detachment path of the process cartridge is substantially straight.

25. The image forming apparatus according to claim 1, wherein the process cartridge is a development cartridge having a developing agent carrier, wherein the image forming apparatus further comprises a photosensitive cartridge that is provided with a photosensitive member, the photosensitive cartridge being configured that the development cartridge is removably attached thereto, and wherein the development cartridge is attached to the image forming apparatus such that the development agent carrier contacts with the photosensitive member when performing an image forming operation, and that the development agent carrier separates from the photosensitive member when the image forming operation is unperformed.

26. The image forming apparatus according to claim 25, wherein the process cartridge is provided with a pressed member that protrudes in a direction crossing the attachment direction, wherein the first pressing member contacts with the pressed member, wherein the image forming apparatus further comprises:

a second pressing member that presses the process cartridge in a detachment direction in which the process cartridge is detached;

a first urging member that is provided on the first pressing member and urges the process cartridge toward the attachment direction of the process cartridge; and a cam member that includes:

a first face that moves the first pressing member to the first state with an urging force provided by the first urging member; and a second face that moves the first pressing member to the second state against the urging force provided by the first urging member, wherein the cam member is provided to be rotatable and to selectively face one of the first face and the second face to the first pressing member, wherein the first face of the cam member faces the first pressing member and the second pressing member during the image forming operation, and wherein the second face of the cam member faces the first pressing member and the second pressing member when the image forming operation is unperformed.

27. The image forming apparatus according to claim 25, wherein the photosensitive cartridge and the development cartridge are provided as a pair, and wherein a plurality of pairs of the photosensitive cartridge and the development cartridge are provided in the image forming apparatus for respective colors.

28. The image forming apparatus according to claim 27, further comprising:

a feeding mechanism that picks up and feeds a recording medium; and an ejection mechanism that ejects the recording medium, wherein the plurality of pairs of the photosensitive cartridge and the development cartridge are disposed along a transport path of the recording medium between the feeding mechanism and the ejection mechanism, wherein a pickup direction of the recording medium picked up by the feeding mechanism is opposite a transport direction of the recording medium at image forming positions where images are sequentially formed by the plurality of pairs of the photosensitive cartage and the development cartridge, and wherein the transport direction of the recording medium at the image forming positions is opposite an ejection direction of the recording medium ejected by the ejection mechanism.

29. The image forming apparatus according to claim 28, wherein the photosensitive cartridge and the development cartridge are attached or detached in a direction inclined with reference to the transport direction of the recording medium at the image forming positions and in a thicknesswise direction of the recording medium orthogonal to the transport direction.

30. The image forming apparatus according to claim 28, further comprising a plurality of exposure devices are provided in association with the plurality of pairs of the photosensitive cartridge and the development cartridge, wherein the plurality of pairs of the photosensitive cartridge and the development cartridge, and the plurality of exposure devices corresponding thereto are arranged one after another in the transport direction of the recording medium at the image forming positions.

* * * * *